US006787000B2

(12) United States Patent
Burazin et al.

(10) Patent No.: US 6,787,000 B2
(45) Date of Patent: Sep. 7, 2004

(54) FABRIC COMPRISING NONWOVEN ELEMENTS FOR USE IN THE MANUFACTURE OF TISSUE PRODUCTS HAVING VISUALLY DISCERNABLE BACKGROUND TEXTURE REGIONS BORDERED BY CURVILINEAR DECORATIVE ELEMENTS AND METHOD THEREOF

(75) Inventors: Mark Alan Burazin, Oshkosh, WI (US); Jeffrey D. Lindsay, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 83 days.

(21) Appl. No.: 10/015,859

(22) Filed: Nov. 2, 2001

(65) Prior Publication Data

US 2003/0085013 A1 May 8, 2003

(51) Int. Cl.[7] ..... D21F 11/00; D21F 7/12

(52) U.S. Cl. ..... 162/362; 162/902; 162/116; 428/141

(58) Field of Search ..... 162/109–117, 204, 162/205, 289, 246, 306, 308, 312, 348, 361, 362, 358.2, 358.4, 900–904; 428/105, 107, 112, 141, 147, 152–154, 163, 169, 173, 179, 196; 442/33, 203, 239, 268, 286; 430/323–326; 427/466, 468; 139/383 A, 383 AA, 425 A

(56) References Cited

U.S. PATENT DOCUMENTS 241,522 A 5/1881 Ambjorn (List continued on next page.)

FOREIGN PATENT DOCUMENTS

CA 809923 4/1969

(List continued on next page.)

OTHER PUBLICATIONS

Derwent World Patent Database abstract of Der Nederlanden J C: Description of NL 1006151, "Forming wire for making paper with watermark."

(List continued on next page.)

*Primary Examiner*—Steven P. Griffin
*Assistant Examiner*—Eric Hug
(74) *Attorney, Agent, or Firm*—Hatvicia A. Charlier

(57) ABSTRACT

The present invention is a sculpted fabric for the manufacture of a tissue web, having a tissue machine contacting side and a tissue contacting side. The tissue contacting side includes an upper porous member comprising a base with nonwoven elevated regions thereon. The nonwoven elevated regions comprise a first group of nonwoven raised elements and a second group of nonwoven raised elements, both raised relative to the base. The first group of nonwoven raised elements extends in at least a first direction and the second group of nonwoven raised elements extends in at least a second direction. The first and second groups of nonwoven raised elements are arranged on the base to produce elevated and depressed regions defining a three-dimensional tissue contacting surface comprising:

a) a first background region having a set of substantially parallel first elevated regions comprising at least a subset of the first group of nonwoven raised elements, and comprising a first group of depressed regions, wherein the first elevated regions and the first depressed regions alternate;

b) a second background region having a set of substantially parallel second elevated regions comprising at least a subset of the second group of nonwoven raised elements, and comprising a second group of depressed regions, wherein the second elevated regions and the second depressed regions alternate; and, c) a transition region positioned between the first and second background regions, wherein the first elevated regions of the first background region terminate and the second elevated regions of the second background region terminate.

45 Claims, 27 Drawing Sheets

U.S. PATENT DOCUMENTS

| | | | | |
|---|---|---|---|---|
| 1,616,222 | A | 2/1927 | Harrigan | |
| 2,038,712 | A | 4/1936 | Brodin | |
| 2,086,505 | A | 7/1937 | Kloeckener | 139/418 |
| 3,121,660 | A | 2/1964 | Hall, Jr. | |
| 3,309,263 | A | 3/1967 | Grobe | |
| 3,705,079 | A | 12/1972 | Lee et al. | |
| 3,832,758 | A | 9/1974 | Johnson | |
| 3,866,277 | A | 2/1975 | Hojyo | |
| 3,879,257 | A | 4/1975 | Gentile et al. | |
| 3,915,202 | A | 10/1975 | Curtis et al. | |
| 3,974,025 | A | 8/1976 | Ayers | |
| 4,072,557 | A | 2/1978 | Schiel | |
| 4,149,571 | A | 4/1979 | Burroughs | |
| 4,154,883 | A | 5/1979 | Elias | |
| 4,161,195 | A | 7/1979 | Khan | |
| 4,171,009 | A | 10/1979 | Karm | |
| 4,191,609 | A | 3/1980 | Trokhan | |
| 4,212,703 | A | 7/1980 | D'Amico et al. | |
| 4,239,065 | A | 12/1980 | Trokhan | |
| 4,382,987 | A | 5/1983 | Smart | |
| 4,423,755 | A | 1/1984 | Thompson | 139/383 A |
| 4,440,597 | A | 4/1984 | Wells et al. | |
| 4,514,345 | A | 4/1985 | Johnson et al. | |
| 4,515,853 | A | 5/1985 | Borel | |
| 4,528,239 | A | 7/1985 | Trokhan | |
| 4,529,480 | A | 7/1985 | Trokhan | |
| 4,533,437 | A | 8/1985 | Curran et al. | |
| 4,541,895 | A | 9/1985 | Albert | |
| 4,551,199 | A | 11/1985 | Weldon | |
| 4,552,620 | A | 11/1985 | Adams | |
| 4,556,451 | A | 12/1985 | Ely | |
| 4,588,632 | A | 5/1986 | Gisbourne et al. | |
| 4,637,859 | A | 1/1987 | Trokhan | |
| 4,671,983 | A | 6/1987 | Burt | |
| 4,680,873 | A | 7/1987 | Fellers et al. | |
| 4,739,803 | A | 4/1988 | Borel | 139/383 A |
| 4,741,376 | A | 5/1988 | Landqvist et al. | |
| 4,759,391 | A | 7/1988 | Waldvogel et al. | |
| 4,799,318 | A | 1/1989 | Hansson | |
| 4,849,054 | A | 7/1989 | Klowak | |
| 4,919,877 | A | 4/1990 | Parsons et al. | |
| 4,921,750 | A | 5/1990 | Todd | |
| 4,942,077 | A | 7/1990 | Wendt et al. | |
| 4,967,805 | A | 11/1990 | Chiu et al. | |
| 5,013,330 | A | 5/1991 | Durkin et al. | |
| 5,048,589 | A | 9/1991 | Cook et al. | |
| 5,066,532 | A | 11/1991 | Gaisser | |
| 5,069,548 | A | 12/1991 | Boehnlein | |
| 5,071,697 | A | 12/1991 | Gulya et al. | |
| 5,098,522 | A | 3/1992 | Smurkoski et al. | |
| 5,114,777 | A | 5/1992 | Gaisser | |
| 5,126,015 | A | 6/1992 | Pounder | |
| 5,151,316 | A | 9/1992 | Durkin et al. | |
| 5,161,207 | A | 11/1992 | Pikulski | |
| 5,178,729 | A | 1/1993 | Janda | |
| 5,219,004 | A | 6/1993 | Chiu | |
| 5,223,092 | A | 6/1993 | Grinnell et al. | |
| 5,227,242 | A | 7/1993 | Walter et al. | |
| 5,230,776 | A | 7/1993 | Anderson et al. | |
| 5,233,733 | A | 8/1993 | Rich et al. | |
| 5,245,025 | A | 9/1993 | Trokhan et al. | |
| 5,254,398 | A | 10/1993 | Gaisser | |
| 5,260,171 | A | 11/1993 | Smurkoski et al. | |
| 5,275,700 | A | 1/1994 | Trokhan | |
| 5,277,761 | A | 1/1994 | Van Phan et al. | |
| 5,300,347 | A | 4/1994 | Underhill et al. | |
| 5,314,584 | A | 5/1994 | Grinnell et al. | |
| 5,328,565 | A | 7/1994 | Rasch et al. | |
| 5,330,604 | A | 7/1994 | Allum et al. | |
| 5,334,289 | A | 8/1994 | Trokhan et al. | |
| 5,348,620 | A | 9/1994 | Hermans et al. | |
| 5,353,521 | A | 10/1994 | Orloff | |
| 5,364,504 | A | 11/1994 | Smurkoski et al. | |
| 5,366,785 | A | 11/1994 | Sawdai | |
| 5,366,786 | A | 11/1994 | Connor et al. | |
| 5,372,876 | A | 12/1994 | Johnson et al. | |
| 5,391,419 | A | 2/1995 | Davenport | |
| 5,399,412 | A | 3/1995 | Sudall et al. | |
| 5,401,557 | A | 3/1995 | Inomata et al. | |
| 5,429,686 | A | 7/1995 | Chiu et al. | |
| 5,431,786 | A | 7/1995 | Rasch et al. | |
| 5,437,908 | A | 8/1995 | Demura et al. | |
| 5,443,691 | A | 8/1995 | Phan et al. | |
| 5,449,548 | A | 9/1995 | Bowen, Jr. | |
| 5,456,293 | A | 10/1995 | Ostermayer et al. | |
| 5,462,642 | A | * 10/1995 | Kajander | 162/116 |
| 5,496,624 | A | 3/1996 | Stelljes, Jr. et al. | |
| 5,500,277 | A | 3/1996 | Trokhan et al. | |
| 5,501,768 | A | 3/1996 | Hermans et al. | |
| 5,503,715 | A | 4/1996 | Trokhan et al. | |
| 5,507,915 | A | 4/1996 | Durkin et al. | |
| 5,508,095 | A | 4/1996 | Allum et al. | |
| 5,510,002 | A | 4/1996 | Hermans et al. | |
| 5,512,319 | A | 4/1996 | Cook et al. | |
| 5,514,523 | A | 5/1996 | Trokhan et al. | |
| 5,520,225 | A | 5/1996 | Quigley et al. | |
| 5,527,429 | A | 6/1996 | Dambreville et al. | |
| 5,545,295 | A | 8/1996 | Fujita et al. | |
| 5,549,790 | A | 8/1996 | Van Phan | |
| 5,554,467 | A | 9/1996 | Trokhan et al. | |
| 5,556,509 | A | 9/1996 | Trokhan et al. | |
| 5,565,132 | A | 10/1996 | Salyer | |
| 5,566,724 | A | 10/1996 | Trokhan et al. | |
| 5,573,637 | A | 11/1996 | Ampulski et al. | |
| 5,580,423 | A | 12/1996 | Ampulski et al. | |
| 5,591,309 | A | 1/1997 | Rugowski et al. | |
| 5,593,545 | A | 1/1997 | Rugowski et al. | |
| 5,598,642 | A | 2/1997 | Orloff et al. | |
| 5,598,643 | A | 2/1997 | Chuang et al. | |
| 5,607,551 | A | 3/1997 | Farrington, Jr. et al. | |
| 5,607,980 | A | 3/1997 | McAtee et al. | |
| 5,609,725 | A | 3/1997 | Van Phan | |
| 5,614,061 | A | 3/1997 | Van Phan et al. | |
| 5,614,293 | A | 3/1997 | Krzysik et al. | |
| 5,624,790 | A | 4/1997 | Trokhan et al. | |
| 5,628,876 | A | 5/1997 | Ayers et al. | |
| 5,637,106 | A | 6/1997 | Mitchell et al. | |
| 5,637,194 | A | 6/1997 | Ampulski et al. | |
| 5,643,588 | A | 7/1997 | Roe et al. | |
| 5,650,218 | A | 7/1997 | Krzysik et al. | |
| D381,811 | S | 8/1997 | du Grosriez | |
| D382,162 | S | 8/1997 | Ertolacci et al. | |
| 5,656,132 | A | 8/1997 | Farrington, Jr. et al. | |
| D384,210 | S | 9/1997 | du Grosriez | |
| 5,667,636 | A | 9/1997 | Engel et al. | |
| 5,672,248 | A | 9/1997 | Wendt et al. | |
| 5,679,222 | A | 10/1997 | Rasch et al. | |
| 5,693,187 | A | 12/1997 | Ampulski et al. | |
| 5,699,626 | A | 12/1997 | Chuang et al. | |
| 5,701,682 | A | 12/1997 | Chuang et al. | |
| 5,709,775 | A | 1/1998 | Trokhan et al. | |
| 5,713,397 | A | 2/1998 | Quigley | 139/383 A |
| 5,714,041 | A | 2/1998 | Ayers et al. | |
| 5,716,692 | A | 2/1998 | Warner et al. | |
| 5,746,887 | A | 5/1998 | Wendt et al. | |
| 5,772,845 | A | 6/1998 | Farrington, Jr. et al. | |
| D395,955 | S | 7/1998 | du Grosriez | |
| 5,776,307 | A | 7/1998 | Ampulski et al. | |
| 5,776,312 | A | 7/1998 | Trokhan et al. | |
| 5,779,965 | A | 7/1998 | Beuther et al. | |
| 5,795,440 | A | 8/1998 | Ampulski et al. | |

| | | | | |
|---|---|---|---|---|
| 5,804,036 | A | 9/1998 | Phan et al. | |
| 5,804,281 | A | 9/1998 | Phan et al. | |
| 5,814,190 | A | 9/1998 | Van Phan | |
| 5,820,730 | A | 10/1998 | Phan et al. | |
| 5,830,316 | A | 11/1998 | Ampulski | |
| 5,830,321 | A | 11/1998 | Lindsay et al. | |
| 5,832,962 | A | 11/1998 | Kaufman et al. | |
| 5,837,102 | A * | 11/1998 | Graf | 162/296 |
| 5,840,403 | A | 11/1998 | Trokhan et al. | |
| 5,840,411 | A | 11/1998 | Stelljes, Jr. et al. | |
| 5,843,279 | A | 12/1998 | Phan et al. | |
| 5,846,379 | A | 12/1998 | Ampulski et al. | |
| 5,855,739 | A | 1/1999 | Ampulski et al. | |
| 5,857,497 | A | 1/1999 | Gaisser | |
| 5,861,082 | A | 1/1999 | Ampulski et al. | |
| 5,871,763 | A | 2/1999 | Luu et al. | |
| 5,874,156 | A | 2/1999 | Schulz | |
| 5,885,416 | A | 3/1999 | Marinack et al. | |
| 5,885,418 | A | 3/1999 | Anderson et al. | |
| 5,888,347 | A | 3/1999 | Engel et al. | |
| 5,893,965 | A | 4/1999 | Trokhan et al. | |
| 5,897,745 | A | 4/1999 | Ampulski et al. | |
| 5,900,122 | A | 5/1999 | Huston | |
| 5,904,811 | A | 5/1999 | Ampulski et al. | |
| 5,906,710 | A | 5/1999 | Trokhan | |
| 5,925,217 | A | 7/1999 | Kaufman et al. | |
| 5,935,381 | A | 8/1999 | Trokhan et al. | |
| 5,938,893 | A | 8/1999 | Trokhan et al. | |
| 5,948,210 | A | 9/1999 | Huston | |
| 5,954,097 | A | 9/1999 | Boutilier | |
| 5,972,813 | A | 10/1999 | Polat et al. | |
| D416,393 | S | 11/1999 | Enderby et al. | |
| 5,990,377 | A | 11/1999 | Chen et al. | |
| 6,010,598 | A | 1/2000 | Boutilier et al. | |
| 6,017,417 | A | 1/2000 | Wendt et al. | |
| D419,782 | S | 2/2000 | Saito et al. | |
| 6,039,838 | A | 3/2000 | Kaufman et al. | |
| 6,039,839 | A | 3/2000 | Trokhan et al. | |
| 6,096,169 | A | 8/2000 | Hermans et al. | |
| 6,103,060 | A | 8/2000 | Munerelle et al. | |
| 6,120,642 | A | 9/2000 | Lindsay et al. | |
| 6,140,260 | A | 10/2000 | Johnson et al. | |
| 6,143,135 | A | 11/2000 | Hada et al. | |
| 6,149,768 | A | 11/2000 | Hepford | |
| 6,197,154 | B1 | 3/2001 | Chen et al. | |
| 6,237,644 | B1 | 5/2001 | Hay et al. | 139/383 A |
| 2002/0056536 | A1 | 5/2002 | Lamb | |

FOREIGN PATENT DOCUMENTS

| | | | |
|---|---|---|---|
| CA | 873651 | | 6/1971 |
| CA | 919467 | | 1/1973 |
| DE | 199 17 869 | A1 | 10/2000 |
| EP | 0 140 404 | A1 | 5/1985 |
| EP | 0 566 775 | A1 | 10/1993 |
| EP | 0 667 612 | A1 | 8/1995 |
| EP | 0 837 179 | A2 | 4/1998 |
| GB | 1059983 | | 2/1967 |
| GB | 2 006 296 | A | 5/1979 |
| GB | 2 228 594 | A | 8/1990 |
| GB | 2 254 228 | B | 10/1992 |
| GB | 2 279 372 | A | 1/1995 |
| WO | WO 95/17548 | A1 | 6/1995 |
| WO | WO 96/35018 | A1 | 11/1996 |
| WO | WO 97/24487 | A1 | 7/1997 |
| WO | WO 97/32081 | A1 | 9/1997 |
| WO | WO 98/01618 | A1 | 1/1998 |
| WO | WO 98/21404 | A1 | 5/1998 |
| WO | WO 98/21405 | A1 | 5/1998 |
| WO | WO 98/21406 | A1 | 5/1998 |
| WO | WO 98/21409 | A1 | 5/1998 |
| WO | WO 98/59110 | A1 | 12/1998 |
| WO | WO 99/10597 | A1 | 3/1999 |
| WO | WO 99/39050 | A1 | 8/1999 |
| WO | WO 99/49131 | A1 | 9/1999 |
| WO | WO 99/51814 | A1 | 10/1999 |
| WO | WO 99/54547 | A1 | 10/1999 |
| WO | WO 99/66124 | A1 | 12/1999 |
| WO | WO 00/08253 | A1 | 2/2000 |
| WO | WO 00/12818 | A1 | 3/2000 |
| WO | WO 00/39393 | A1 | 7/2000 |
| WO | WO 00/39394 | A1 | 7/2000 |
| WO | WO 00/63489 | A1 | 10/2000 |
| WO | WO 01/48310 | A1 | 7/2001 |
| WO | WO 03/040450 | A2 | 5/2003 |

OTHER PUBLICATIONS

Asten, Inc., *Paper Machine Clothing*, "Forming", Technomic Publishing, 1997, pp. 33–113, 139–148, 159–168 & 211–229.

"Cadeyes Product Guide," Medar, Inc., Farmington Hills, MI, 1994, pp. 1–19.

L. Bieman, K. Harding, A. Boehnlein, "Absolute Measurement Using Field–Shifted Moiré ", SPIE Optical Conference Proceedings, vol. 1614, pp. 259–264, 1991.

Lindsay, Jeffrey D., "Displacement Dewatering To Maintain Bulk," *Paperi Ja Puu—Paper And Timber*, vol. 74, No. 3, 1992, pp. 232–242.

Mummery, Leigh, *Surface Texture Analysis: The Handbook*, published by Hommelwerke GmbH, Muhlhausen, Germany, 1990, pp. 28–29.

TAPPI Official Test Method T 402 om–93, "Standard Conditioning and Testing Atmospheres For Paper, Board, Pulp Handsheets, and Related Products," published by the TAPPI Press, Atlanta, Georgia, revised 1993, pp. 1–3.

Adanur, Sabit, "Forming Fabric Designs," Section 2.2.1, *Paper Machine Clothing*, Technomic Publishing Co., Inc., Lancaster, PA, 1997, pp. 38–39.

* cited by examiner

FABRIC COMPRISING NONWOVEN ELEMENTS FOR USE IN THE MANUFACTURE OF TISSUE PRODUCTS HAVING VISUALLY DISCERNABLE BACKGROUND TEXTURE REGIONS BORDERED BY CURVILINEAR DECORATIVE ELEMENTS AND METHOD THEREOF

BACKGROUND

The present invention relates to the field of paper manufacturing. More particularly, the present invention relates to the manufacture of absorbent tissue products such as bath tissue, facial tissue, napkins, towels, wipers, and the like. Specifically, the present invention relates to improved fabrics used to manufacture absorbent tissue products having visually discernible background texture regions bordered by curvilinear decorative elements, methods of tissue manufacture, methods of fabric manufacture, and the actual tissue products produced.

In the manufacture of tissue products, particularly absorbent tissue products, there is a continuing need to improve the physical properties and final product appearance. It is generally known in the manufacture of tissue products that there is an opportunity to mold a partially dewatered cellulosic web on a papermaking fabric specifically designed to enhance the finished paper product's physical properties. Such molding can be applied by fabrics in an uncreped through air dried process as disclosed in U.S. Pat. No. 5,672,248 issued on Sep. 30, 1997 to Wendt et al., or in a wet pressed tissue manufacturing process as disclosed U.S. Pat. No. 4,637,859 issued on Jan. 20, 1987 to Trokhan. Wet molding typically imparts desirable physical properties independent of whether the tissue web is subsequently creped, or an uncreped tissue product is produced.

However, absorbent tissue products are frequently embossed in a subsequent operation after their manufacture on the paper machine, while the dried tissue web has a low moisture content, to impart consumer preferred visually appealing textures or decorative lines. Thus, absorbent tissue products having both desirable physical properties and pleasing visual appearances often require two manufacturing steps on two separate machines. Hence, there is a need to combine the generation of visually discernable background texture regions bordered by curvilinear decorative elements with the paper manufacturing process to reduce manufacturing costs. There is also a need to develop a paper manufacturing process that not only imparts visually discernable background texture regions bordered by curvilinear decorative elements to the sheet, but also maximizes desirable physical properties of the absorbent tissue products without deleteriously affecting other desirable physical properties.

Previous attempts to combine the above needs, such as those disclosed in U.S. Pat. No. 4,967,805 issued on Nov. 6, 1990 to Chiu, U.S. Pat. No. 5,328,565 issued on Jul. 12, 1994 to Rasch et al., and in U.S. Pat. No. 5,820,730 issued on Oct. 13, 1998 to Phan et al., have manipulated the papermaking fabric's drainage in different localized regions to produce a pattern in the wet tissue web in the forming section of the paper machine. Thus, the texture results from more fiber accumulation in areas of the fabric having high drainage and fewer fibers in areas of the fabric having low drainage. Such a method can produce a dried tissue web having a non-uniform basis weight in the localized areas or regions arranged in a systematic manner to form the texture. While such a method can produce textures, the sacrifice in the uniformity of the dried tissue web's physical properties such as tear, burst, absorbency, and density can degrade the dried tissue web's performance while in use.

For the foregoing reasons, there is a need to generate aesthetically pleasing combinations of background texture regions and curvilinear decorative elements in the dried or partially dried tissue web, while being manufactured on the paper machine, using a method that produces a substantially uniform density dried tissue web which has improved performance while in use.

Numerous woven fabric designs are known in papermaking. Examples are provided by Sabut Adanur in *Paper Machine Clothing*, Lancaster, Pa.: Technomic Publishing, 1997, pp. 33–113, 139–148,159–168, and 211–229. Another example is provided in Patent Application WO 00/63489, entitled "Paper Machine Clothing and Tissue Paper Produced with Same," by H. J. Lamb, published on Oct. 26, 2000.

SUMMARY

The present invention comprises paper manufacturing processes that may satisfy one or more of the foregoing needs. For example, a paper manufacturing fabric of the present invention, when used as a throughdrying fabric in an uncreped tissue making process, produces an absorbent tissue product having a substantially uniform density as well as possessing visually discernable background texture regions bordered by curvilinear decorative elements. The present invention is also directed towards fabrics for manufacturing the absorbent tissue product, processes of making the absorbent tissue product, processes of making the fabric, and the absorbent tissue products themselves.

Therefore in one aspect, the present invention relates to a fabric for producing an absorbent tissue product with visually discernible background texture regions bordered by curvilinear decorative elements comprising: a woven fabric having background texture regions formed by MD warp floats alternating with MD warp sinkers woven into a support structure (i.e., at least a single layer of CD shutes) below the MD floats; the warps and shutes at the borders of the background texture regions are arrayed to form transition regions comprising the curvilinear decorative elements.

In another aspect, the present invention relates to a method for manufacturing an absorbent tissue product with visually discernable background texture regions bordered by curvilinear decorative elements comprising: forming the wet tissue web, partially dewatering the wet tissue web, rush transferring the wet tissue web, wet molding the wet tissue web into a fabric having visually discernible background texture regions bordered by curvilinear decorative elements, and throughdrying the web.

In an additional aspect, the present invention relates to a tissue product with background texture regions bordered by curvilinear decorative elements that form aesthetically pleasing repeating patterns comprising: visually discernable background texture regions of MD ripples, ridges, or the like, corresponding to a image of the background texture regions of the fabric, bordered by curvilinear decorative elements, corresponding to an image of the curvilinear transition regions of the fabric, where the curvilinear decorative elements in the tissue web are visually distinct from the background texture regions in the tissue.

Unlike U.S. Pat. No. 5,672,248 issued on Sep. 30, 1997 to Wendt et al., where the warp knuckles are closely spaced or contacting and arranged into patterns, the present invention produces the curvilinear decorative elements in the absorbent tissue product at a substantially continuous transition region which forms borders between background texture regions. The curvilinear decorative elements comprise geometric configurations with the leading end of one or more raised MD floats adjacent to or in proximity to the trailing end of another raised MD float. The decorative pattern consists of the visually discernable background texture regions, such as corrugations, lines, ripples, ridges, and the like, and the curvilinear decorative elements which form transition regions between the background texture regions. It is the arrangement of the transition regions in the present invention that provide the decorative pattern. Because the curvilinear decorative elements are produced at the transition region (rather than from a decorative pattern resulting from shoulder to shoulder or side by side positioning of warp knuckles of other fabrics) the raised MD floats can be purposely distributed more uniformly across the sheet side surface of the fabric to improve the uniformity and CD stretch properties of the tissue web with respect to physical properties while still imparting a distinctive texture highlighted by curvilinear decorative elements as a decorative pattern to the tissue web. In addition, because the curvilinear decorative elements producing the distinctive pattern occurs at the relatively small transition area, it is possible to weave the fabric with more intricate patterns than possible in the fabrics disclosed in U.S. Pat. No. 5,672,248.

The background texture regions are designed to impart preferred finished product properties when used as an UCTAD throughdrying fabric, including roll bulk, stack bulk, CD stretch, drape, and durability. The curvilinear decorative elements may provide additional hinge points to enhance finished product drape. The background texture regions in the finished product contrast visually with the curvilinear transition regions, providing the decorative effect.

In one aspect of the present invention, the curvilinear decorative elements form woven transition regions which allow the warps to alternate function between MD warp float and MD warp sinker. When finished so the warps are parallel to the MD, the background texture regions across each transition region are out of phase with each other, with the highest parts of one background texture region corresponding to the lowest part of the other. This out of phase alternation results in improved anti-nesting behavior, significantly improving the roll firmness—roll bulk relationship at a given one-sheet caliper.

In some embodiments, all of the floats (or elevated regions) in a background region are surrounded by sinkers (or depressed regions), with the possible exception of floats adjacent to a transition region or fabric edge, and all of the sinkers (or depressed regions) in a background region are surrounded by floats (or elevated regions), with the possible exception of sinkers adjacent to a transition region or fabric edge.

BRIEF DESCRIPTION OF THE DRAWINGS

These and other features, aspects, and advantages of the present invention will be better understood with regard to the following description, appended claims, and accompanying drawings where:

DEFINITIONS

Figure 1A:
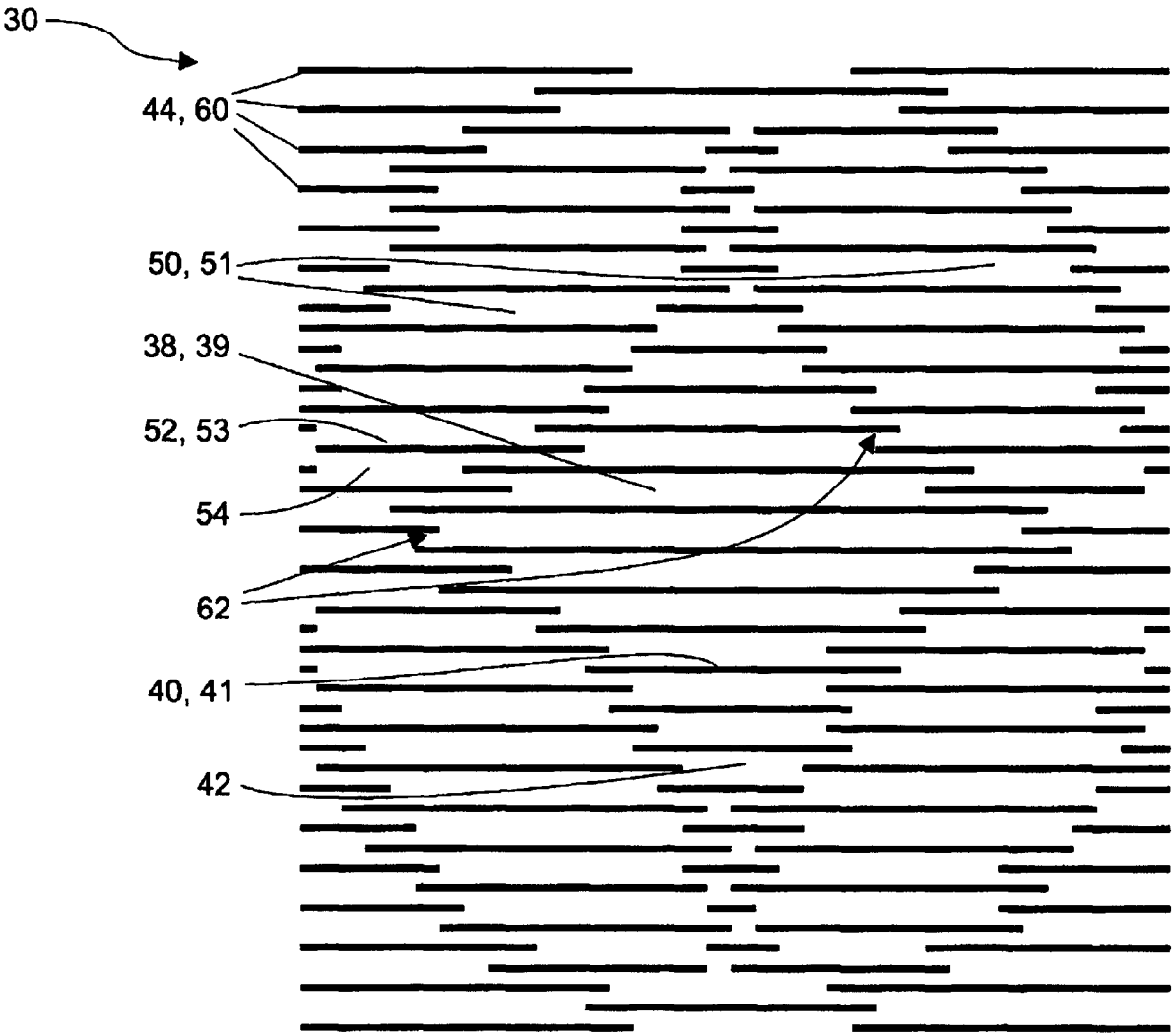
FIG. 1A is a schematic diagram of one embodiment of the fabric of the present invention.

As used herein, "curvilinear decorative element" refers to any line or visible pattern that contains either straight sections, curved sections, or both that are substantially connected visually. Thus, a decorative pattern of interlocking circles may be formed from many curvilinear decorative elements shaped into circles. Similarly, a pattern of squares may be formed from many curvilinear decorative elements shaped into individual squares. It is understood that curvilinear decorative elements also may appear as undulating lines, substantially connected visually, forming signatures or patterns as well as multiple warp mixed with single warp to generate textures of more complicated patterns.

Also, as used herein "decorative pattern" refers to any non-random repeating design, figure, or motif. It is not necessary that the curvilinear decorative elements form recognizable shapes, and a repeating design of the curvilinear decorative elements is considered to constitute a decorative pattern.

As used herein, the term "float" means an unwoven or non-interlocking portion of a warp emerging from the topmost layer of shutes that spans at least two consecutive shutes of the topmost layer of shutes.

As used herein, a "sinker" means a span of a warp that is generally depressed relative to adjacent floats, further having two end regions both of which pass under one or more consecutive shutes.

As used herein, "machine-direction" or "MD" refers to the direction of travel of the fabric, the fabric's individual strands, or the paper web while moving through the paper machine. Thus, the MD test data for the tissue refers to the tissue's physical properties in a sample cut lengthwise in the machine-direction. Similarly, "cross-machine direction" or "CD" refers to a direction orthogonal to the machine-direction extending across the width of the paper machine. Thus, the CD test data for the tissue refers to the tissue's physical properties in a sample cut lengthwise in the cross-machine direction. In addition, the strands may be arranged at acute angles to the MD and CD directions. One such arrangement is described in "Rolls of Tissue Sheets Having Improved Properties", Burazin et al., EP 1 109 969 A1 which published on Jun. 27, 2001 and incorporated herein by reference to the extent it is not contradictory herewith.

As used herein, "plane difference" refers to the z-direction height difference between an elevated region and the highest immediately adjacent depressed region. Specifically, in a woven fabric, the plane difference is the z-direction height difference between a float and the highest immediately adjacent sinker or shute. Z-direction refers to the axis mutually orthogonal to the machine direction and cross-machine direction.

As used herein, "transfer fabric" is a fabric that is positioned between the forming section and the drying section of the web manufacturing process.

As used herein, "transition region" is defined as the intersection of three or more floats on three or more consecutive MD strands. The transition regions are formed by deliberate interruptions in the textured background regions, which may result from a variety of arrangements of intersections of the floats. The floats may be arranged in an overlapping intersection or in a non-overlapping intersection.

As used herein, a "filled" transition region is defined as a transition region where the space between the floats in the transition region is partially or completely filled with material, raising the height in the transition area. The filling material may be porous. The filling material may be any of the materials discussed hereinafter for use in the construction of fabrics. The filling material may be substantially deformable, as measured by High Pressure Compressive Compliance (defined hereinafter).

As used herein, the term "warp" can be understood as a strand substantially oriented in the machine direction, and "shute" can be understood to refer to the strands substantially oriented in the cross-machine direction of the fabric as used on a papermachine. The warps and shutes may be interwoven via any known fabric method of manufacture. In the production of endless fabrics, the normal orientation of warps and shutes, according to common weaving terminology, is reversed, but as used herein, the structure of the fabric and not its method of manufacture determine which strands are classified as warps and which are shutes.

As used herein "strand" refers a substantially continuous filament suitable for weaving sculptured fabrics of the present invention. Strands may include any known in the prior art. Strands may comprise monofilament, cabled monofilament, staple fiber twisted together to form yarns, cabled yarns, or combinations thereof. Strand cross-sections, filament cross sections, or stable fiber cross sections may be circular, elliptical, flattened, rectangular, oval, semi-oval, trapezoidal, parallelogram, polygonal, solid, hollow, sharp edged, rounded edged, bi-lobal, multi-lobal, or can have capillary channels. Strand diameter or strand cross sectional shape may vary along its length.

As used herein "multi-strand" refers to two or more strands arranged side by side or twisted together. It is not necessary for each side-by-side strand in a multi-strand group to be woven identically. For example, individual strands of a multi-strand warp may independently enter and exit the topmost layer of shutes in sinker regions or transition regions. As a further example, a single multi-strand group need not remain a single multi-strand group throughout the length of the strands in the fabric, but it is possible for one or more strands in a multi-strand group to depart from the remaining strand(s) over a specific distance and serve, for example, as a float or sinker independently of the remaining strand(s).

As used herein, "Frazier air permeability" refers to the measured value of a well-known test with the Frazier Air Permeability Tester in which the permeability of a fabric is measured as standard cubic feet of air flow per square foot of material per minute with an air pressure differential of 0.5 inches (12.7 mm) of water under standard conditions. The fabrics of the present invention can have any suitable Frazier air permeability. For example, thoughdrying fabrics can have a permeability from about 55 standard cubic feet per square foot per minute (about 16 standard cubic meters per square meter per minute) or higher, more specifically from about 100 standard cubic feet per square foot per minute (about 30 standard cubic meters per square meter per minute) to about 1,700 standard cubic feet per square foot per minute (about 520 standard cubic meters per square meter per minute), and most specifically from about 200 standard cubic feet per square foot per minute (about 60 standard cubic meters per square meter per minute) to about 1,500 standard cubic feet per square foot per minute (about 460 standard cubic meters per square meter per minute).

DETAILED DESCRIPTION

The Process

Figure 27:
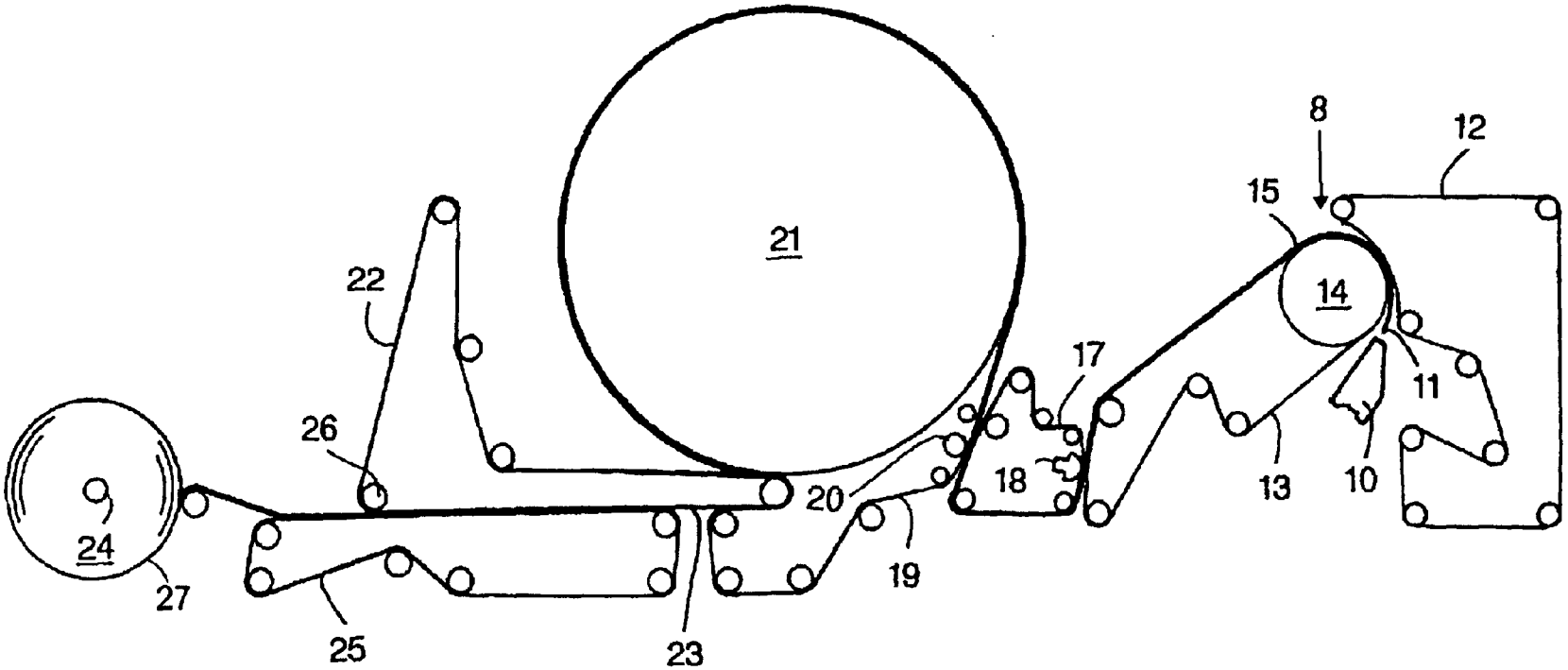
FIG. 27 is a schematic diagram for making an uncreped dried tissue web in accordance with an embodiment of the present invention.

Referring to FIG. 27, a process of carrying out the present invention will be described in greater detail. The process shown depicts an uncreped through dried process, but it will be recognized that any known papermaking method or tissue making method can be used in conjunction with the fabrics of the present invention. Related uncreped through air dried tissue processes are described in U.S. Pat. No. 5,656,132 issued on Aug. 12, 1997 to Farrington et al. and in U.S. Pat. No. 6,017,417 issued on Jan. 25, 2000 to Wendt et al. Both patents are herein incorporated by reference to the extent they are not contradictory herewith. In addition, fabrics having a sculpture layer and a load bearing layer useful for making uncreped through air dried tissue products are disclosed in U.S. Pat. No. 5,429,686 issued on Jul. 4, 1995 to Chiu et al. also herein incorporated by reference to the extent it is not contradictory herewith. Exemplary methods for the production of creped tissue and other paper products are disclosed in U.S. Pat. No. 5,855,739, issued on Jan. 5, 1999 to Ampulski et al.; U.S. Pat. No. 5,897,745, issued on Apr. 27, 1999 to Ampulski et al.; U.S. Pat. No. 5,893,965, issued on Apr. 13, 1999 to Trokhan et al.; U.S. Pat. No. 5,972,813 issued on Oct. 26, 1999 to Polat et al.; U.S. Pat. No. 5,503,715, issued on Apr. 2, 1996 to Trokhan et al.; U.S. Pat. No. 5,935,381, issued on Aug. 10, 1999 to Trokhan et al.; U.S. Pat. No. 4,529,480, issued on Jul. 16, 1985 to Trokhan; U.S. Pat. No. 4,514,345, issued on Apr. 30, 1985 to Johnson et al.; U.S. Pat. No. 4,528,239, issued on Jul. 9, 1985 to Trokhan; U.S. Pat. No. 5,098,522, issued on Mar. 24, 1992 to Smurkoski et al.; U.S. Pat. No. 5,260,171, issued on Nov. 9, 1993 to Smurkoski et al.; U.S. Pat. No. 5,275,700, issued on Jan. 4, 1994 to Trokhan; U.S. Pat. No. 5,328,565, issued on Jul. 12, 1994 to Rasch et al.; U.S. Pat. No. 5,334,289, issued on Aug. 2, 1994 to Trokhan et al.; U.S. Pat. No. 5,431,786, issued on Jul. 11, 1995 to Rasch et al.; U.S. Pat. No. 5,496,624, issued on Mar. 5, 1996 to Stelljes, Jr. et al.; U.S. Pat. No. 5,500,277, issued on Mar. 19, 1996 to Trokhan et al.; U.S. Pat. No. 5,514,523, issued on May 7, 1996 to Trokhan et al.; U.S. Pat. No. 5,554,467, issued on Sep. 10, 1996, to Trokhan et al.; U.S. Pat. No. 5,566,724, issued on Oct. 22, 1996 to Trokhan et al.; U.S. Pat. No. 5,624,790, issued on Apr. 29, 1997 to Trokhan et al.; U.S. Pat. No. 6,010,598, issued on Jan. 4, 2000 to Boutilier et al.; and, U.S. Pat. No. 5,628,876, issued on May 13, 1997 to Ayers et al., the specification and claims of which are incorporated herein by reference to the extent that they are not contradictory herewith.

In FIG. 27, a twin wire former 8 having a papermaking headbox 10 injects or deposits a stream 11 of an aqueous suspension of papermaking fibers onto a plurality of forming fabrics, such as the outer forming fabric 12 and the inner forming fabric 13, thereby forming a wet tissue web 15. The forming process of the present invention may be any conventional forming process known in the papermaking industry. Such formation processes include, but are not limited to, Fourdriniers, roof formers such as suction breast roll formers, and gap formers such as twin wire formers and crescent formers.

The wet tissue web 15 forms on the inner forming fabric 13 as the inner forming fabric 13 revolves about a forming roll 14. The inner forming fabric 13 serves to support and carry the newly-formed wet tissue web 15 downstream in the process as the wet tissue web 15 is partially dewatered to a consistency of about 10 percent based on the dry weight of the fibers. Additional dewatering of the wet tissue web 15 may be carried out by known paper making techniques, such as vacuum suction boxes, while the inner forming fabric 13 supports the wet tissue web 15. The wet tissue web 15 may be additionally dewatered to a consistency of at least about 20%, more specifically between about 20% to about 40%, and more specifically about 20% to about 30%. The wet tissue web 15 is then transferred from the inner forming fabric 13 to a transfer fabric 17 traveling preferably at a slower speed than the inner forming fabric 13 in order to impart increased MD stretch into the wet tissue web 15.

The wet tissue web 15 is then transferred from the transfer fabric 17 to a throughdrying fabric 19 whereby the wet tissue web 15 preferentially is macroscopically rearranged to conform to the surface of the throughdrying fabric 19 with the aid of a vacuum transfer roll 20 or a vacuum transfer shoe like the vacuum shoe 18. If desired, the throughdrying fabric 19 can be run at a speed slower than the speed of the transfer fabric 17 to further enhance MD stretch of the resulting absorbent tissue product 27. The transfer is preferably carried out with vacuum assistance to ensure conformation of the wet tissue web 15 to the topography of the throughdrying fabric 19. This yields a dried tissue web 23 having the desired bulk, flexibility, CD stretch, and enhances the visual contrast between the background texture regions 38 and 50 and the curvilinear decorative elements which border the background texture regions 38 and 50.

In one embodiment, the throughdrying fabric 19 is woven in accordance with the present invention, and it imparts the curvilinear decorative elements and background texture regions 38 and 50, such as substantially broken-line like corduroy, to the wet tissue web 15. It is possible, however, to weave the transfer fabric 17 in accordance with the present invention to achieve similar results. Furthermore, it is also possible to eliminate the transfer fabric 17, and transfer the wet tissue web 15 directly to the throughdrying fabric 19 of the present invention. Both alternative papermaking processes are within the scope of the present invention, and will produce a decorative absorbent tissue product 27.

While supported by the throughdrying fabric 19, the wet tissue web 15 is dried to a final consistency of about 94 percent or greater by a throughdryer 21 and is thereafter transferred to a carrier fabric 22. Alternatively, the drying process can be any noncompressive drying method that tends to preserve the bulk of the wet tissue web 15.

In another aspect of the present invention, the wet tissue web 15 is pressed against a Yankee dryer by a pressure roll while supported by a woven sculpted fabric 30 comprising visually discernable background texture regions 38 and 50 bordered by curvilinear decorative elements. Such a process, without the use of the sculpted fabrics 30 of the present invention, is shown in U.S. Pat. No. 5,820,730 issued on Oct. 13, 1998 to Phan et al. The compacting action of a pressure roll will tend to densify a resulting absorbent tissue product 27 in the localized regions corresponding to the highest portions of the sculpted fabric 30.

The dried tissue web 23 is transported to a reel 24 using a carrier fabric 22 and an optional carrier fabric 25. An optional pressurized turning roll 26 can be used to facilitate transfer of the dried tissue web 23 from the carrier fabric 22 to the carrier fabric 25. If desired, the dried tissue web 23 may additionally be embossed to produce a combination of embossments and the background texture regions and curvilinear decorative elements on the absorbent tissue product 27 produced using the throughdrying fabric 19 and a subsequent embossing stage.

Once the wet tissue web 15 has been non-compressively dried, thereby forming the dried tissue web 23, it is possible to crepe the dried tissue web 23 by transferring the dried tissue web 23 to a Yankee dryer prior to reeling, or using alternative foreshortening methods such as microcreping as disclosed in U.S. Pat. No. 4,919,877 issued on Apr. 24, 1990 to Parsons et al.

In an alternative embodiment not shown, the wet tissue web 15 may be transferred directly from the inner forming fabric 13 to the throughdrying fabric 19 and the transfer fabric 17 eliminated. The throughdrying fabric 19 is constructed with raised MD floats 60, and illustrative embodiments are shown in FIGS. 1A, 1B, 2, 9, and 28. The throughdrying fabric 19 may be traveling at a speed less than the inner forming fabric 13 such that the wet tissue web 15 is rush transferred, or, in the alternative, the throughdrying fabric 19 may be traveling at substantially the same speed as the inner forming fabric 13. If the throughdrying fabric 19 is traveling at a slower speed than the speed of the inner forming fabric 13, an uncreped absorbent tissue product 27 is produced. Additional foreshortening after the drying stage may be employed to improve the MD stretch of the absorbent tissue product 27. Methods of foreshortening the absorbent tissue product 27 include, by way of illustration and without limitation, conventional Yankee dryer creping, microcreping, or any other method known in the art.

Differential velocity transfer from one fabric to another can follow the principles taught in any one of the following patents, each of which is herein incorporated by reference to the extent it is not contradictory herewith: U.S. Pat. No. 5,667,636, issued on Sep. 16, 1997 to Engel et al.; U.S. Pat. No. 5,830,321, issued on Nov. 3, 1998 to Lindsay et al.; U.S. Pat. No. 4,440,597, issued on Apr. 3, 1984 to Wells et al.; U.S. Pat. No. 4,551,199, issued on Nov. 5, 1985 to Weldon; and, U.S. Pat. No. 4,849,054, issued on Jul. 18, 1989 to Klowak.

In yet another alternative embodiment of the present invention, the inner forming fabric 13, the transfer fabric 17, and the throughdrying fabric 19 can all be traveling at substantially the same speed. Foreshortening may be employed to improve MD stretch of the absorbent tissue product 27. Such methods include, by way of illustration without limitation, conventional Yankee dryer creping or microcreping.

Any known papermaking or tissue manufacturing method may be used to create a three-dimensional web 23 using the fabrics 30 of the present invention as a substrate for imparting texture to the wet tissue web 15 or the dried tissue web 16. Though the fabrics 30 of the present invention are especially useful as through drying fabrics and can be used with any known tissue making process that employs throughdrying, the fabrics 30 of the present invention can also be used in the formation of paper webs as forming fabrics, transfer fabrics, carrier fabrics, drying fabrics, imprinting fabrics, and the like in any known papermaking or tissue making process. Such methods can include variations comprising any one or more of the following steps in any feasible combination:

web formation in a wet end in the form of a classical Fourdrinier, a gap former, a twin-wire former, a crescent former, or any other known former comprising any known headbox, including a stratified headbox for bringing layers of two or more furnishes together into a single web, or a plurality of headboxes for forming a multilayered web, using known wires and fabrics or fabrics of the present invention;

web formation or web dewatering by foam-based processes, such as processes wherein the fibers are entrained or suspended in a foam prior to dewatering, or wherein foam is applied to an embryonic web prior to dewatering or drying, including the methods disclosed in U.S. Pat. No. 5,178,729, issued on Jan. 12, 1993 to Janda, and U.S. Pat. No. 6,103,060, issued on Aug. 15, 2000 to Munerelle et al., both of which are herein incorporated by reference to the extent they are not contradictory herewith;

differential basis weight formation by draining a slurry through a forming fabric having high and low permeability regions, including fabrics of the present invention or any known forming fabric;

rush transfer of a wet web from a first fabric to a second fabric moving at a slower velocity than the first fabric, wherein the first fabric can be a forming fabric, a transfer fabric, or a throughdrying fabric, and wherein the second fabric can be a transfer fabric, a throughdrying fabric, a second throughdrying fabric, or a carrier fabric disposed after a throughdrying fabric (one exemplary rush transfer process is disclosed in U.S. Pat. No. 4,440,597 to Wells et al, herein incorporated by reference to the extent it is not contradictory herewith), wherein the aforementioned fabrics can be selected from any known suitable fabric including fabrics of the present invention;

application of differential air pressure across the web to mold it into one or more of the fabrics on which the web rests, such as using a high vacuum pressure in a vacuum transfer roll or transfer shoe to mold a wet web into a throughdrying fabric as it is transferred from a forming fabric or intermediate carrier fabric, wherein the carrier fabric, throughdrying fabric, or other fabrics can be selected from the fabrics of the present invention or other known fabrics;

use of an air press or other gaseous dewatering methods to increase the dryness of a web and/or to impart molding to the web, as disclosed in U.S. Pat. No. 6,096,169, issued on Aug. 1, 2000 to Hermans et al.; U.S. Pat. No. 6,197,154, issued on Mar. 6, 2001 to Chen et al.; and, U.S. Pat. No. 6,143,135, issued on Nov. 7, 2000 to Hada et al., all of which are herein incorporated by reference to the extent they are not contradictory herewith;

drying the web by any compressive or noncompressive drying process, such as throughdrying, drum drying, infrared drying, microwave drying, wet pressing, impulse drying (e.g., the methods disclosed in U.S. Pat. No. 5,353,521, issued on Oct. 11, 1994 to Orloff and U.S. Pat. No. 5,598,642, issued on Feb. 4, 1997 to Orloff et al.), high intensity nip dewatering, displacement dewatering (see J. D. Lindsay, "Displacement Dewatering To Maintain Bulk," Paperi Ja Puu, vol. 74, No. 3, 1992, pp. 232–242), capillary dewatering (see any of U.S. Pat. Nos. 5,598,643; 5,701,682; and 5,699,626, all of which issued to Chuang et al.), steam drying, etc.

printing, coating, spraying, or otherwise transferring a chemical agent or compound on one or more sides of the web uniformly or heterogeneously, as in a pattern, wherein any known agent or compound useful for a web-based product can be used (e.g., a softness agent such as a quaternary ammonium compound, a silicone agent, an emollient, a skin-wellness agent such as aloe vera extract, an antimicrobial agent such as citric acid, an odor-control agent, a pH control agent, a sizing agent; a polysaccharide derivative, a wet strength agent, a dye, a fragrance, and the like), including the methods of U.S. Pat. No. 5,871,763, issued on Feb. 16, 1999 to Luu et al.; U.S. Pat. No. 5,716,692, issued on Feb. 10, 1998 to Warner et al.; U.S. Pat. No. 5,573,637, issued on Nov. 12, 1996 to Ampulski et al.; U.S. Pat. No. 5,607,980, issued on Mar. 4, 1997 to McAtee et al.; U.S. Pat. No. 5,614,293, issued on Mar. 25, 1997 to Krzysik et al.; U.S. Pat. No. 5,643,588, issued on Jul. 1, 1997 to Roe et al.; U.S. Pat. No. 5,650,218, issued on Jul. 22, 1997 to Krzysik et al.; U.S. Pat. No. 5,990,377, issued on Nov. 23, 1999 to Chen et al.; and, U.S. Pat. No. 5,227,242, issued on Jul. 13, 1993 to Walter et al., each of which is herein incorporated by reference to the extent they are not contradictory herewith;

imprinting the web on a Yankee dryer or other solid surface, wherein the web resides on a fabric that can have deflection conduits (openings) and elevated regions (including the fabrics of the present invention), and the fabric is pressed against a surface such as the surface of a Yankee dryer to transfer the web from the fabric to the surface, thereby imparting densification to portions of the web that were in contact with the elevated regions of the fabric, whereafter the selectively densified web can be creped from or otherwise removed from the surface;

creping the web from a drum dryer, optionally after application of a strength agent such as latex to one or more sides of the web, as exemplified by the methods disclosed in U.S. Pat. No. 3,879,257, issued on Apr. 22, 1975 to Gentile et al.; U.S. Pat. No. 5,885,418, issued on Mar. 23, 1999 to Anderson et al.; U.S. Pat. No. 6,149,768, issued on Nov. 21, 2000 to Hepford, all of which are herein incorporated by reference to the extent they are not contradictory herewith;

creping with serrated crepe blades (e.g., see U.S. Pat. No. 5,885,416, issued on Mar. 23, 1999 to Marinack et al.) or any other known creping or foreshortening method; and, converting the web with known operations such as calendering, embossing, slitting, printing, forming a multiply structure having two, three, four, or more plies, putting on a roll or in a box or adapting for other dispensing means, packaging in any known form, and the like.

The fabrics 30 of the present invention can also be used to impart texture to airlaid webs, either serving as a substrate for forming a web, for embossing or imprinting an airlaid web, or for thermal molding of a web.

Fabric Structure

FIG. 1A is a schematic showing the relative placement of the floats 60 on the paper-contacting side of the woven sculpted fabric 30 according to the present invention. The floats 60 consist of the elevated portions of the warps 44 (strands substantially oriented in the machine direction). Not shown for clarity are the shutes (strands substantially oriented in the cross-machine direction) and depressed portions of the warps 44 interwoven with the shutes, but it is understood that the warps 44 can be continuous in the machine direction, periodically rising to serve as a float 60 and then descending as one moves horizontally in the portion of the woven sculpted fabric 30 schematically shown in FIG. 1A.

In a first background region 38 of the woven sculpted fabric 30, the floats 60 define a first elevated region 40 comprising first elevated strands 41. Between each pair of neighboring first elevated strands 41 in the first background region 38 is a first depressed region 42. The depressed warps 44 in the first depressed region 42 are not shown for clarity. The combination of machine-direction oriented, alternating elevated and depressed regions forms a first background texture 39.

In a second background region 50 of the woven sculpted fabric 30, there are second elevated strands 53 defining a second elevated region 52. Between each pair of the neighboring second elevated strands 53 in the second background region 50 is a second depressed region 54. The depressed warps 44 in the second depressed region 54 are not shown for clarity. The combination of machine-direction oriented, alternating second elevated and depressed regions 52 and 54 forms a second background texture 51.

Between the first background region 38 and the second background region 50 is a transition zone 62 where the floats 44 from either the first background region 38 or the second background region 50 descend to become sinkers (not shown) or depressed regions 54 and 42 in the second background region 50 or first background region 38, respectively. In the transition region 62, ends or beginning sections of the floats 60 from different background texture regions 38 and 50 overlap, creating a texture comprising adjacent floats 60 rather than the first or second background textures 39 and 51 which have alternating floats 60 and first or second depressed regions 42 and 54, respectively. Thus, the transition region 62 provides a visually distinctive interruption to the first and second background textures 39 and 51 of the first and second background regions 38 and 50, respectively, and form a substantially continuous transition region to provide a macroscopic, visually distinctive curvilinear decorative element that extends in directions other than solely the machine direction orientation of the floats 60. In FIG. 1A, the transition region 62 forms a curved diamond pattern.

Figure 1B:
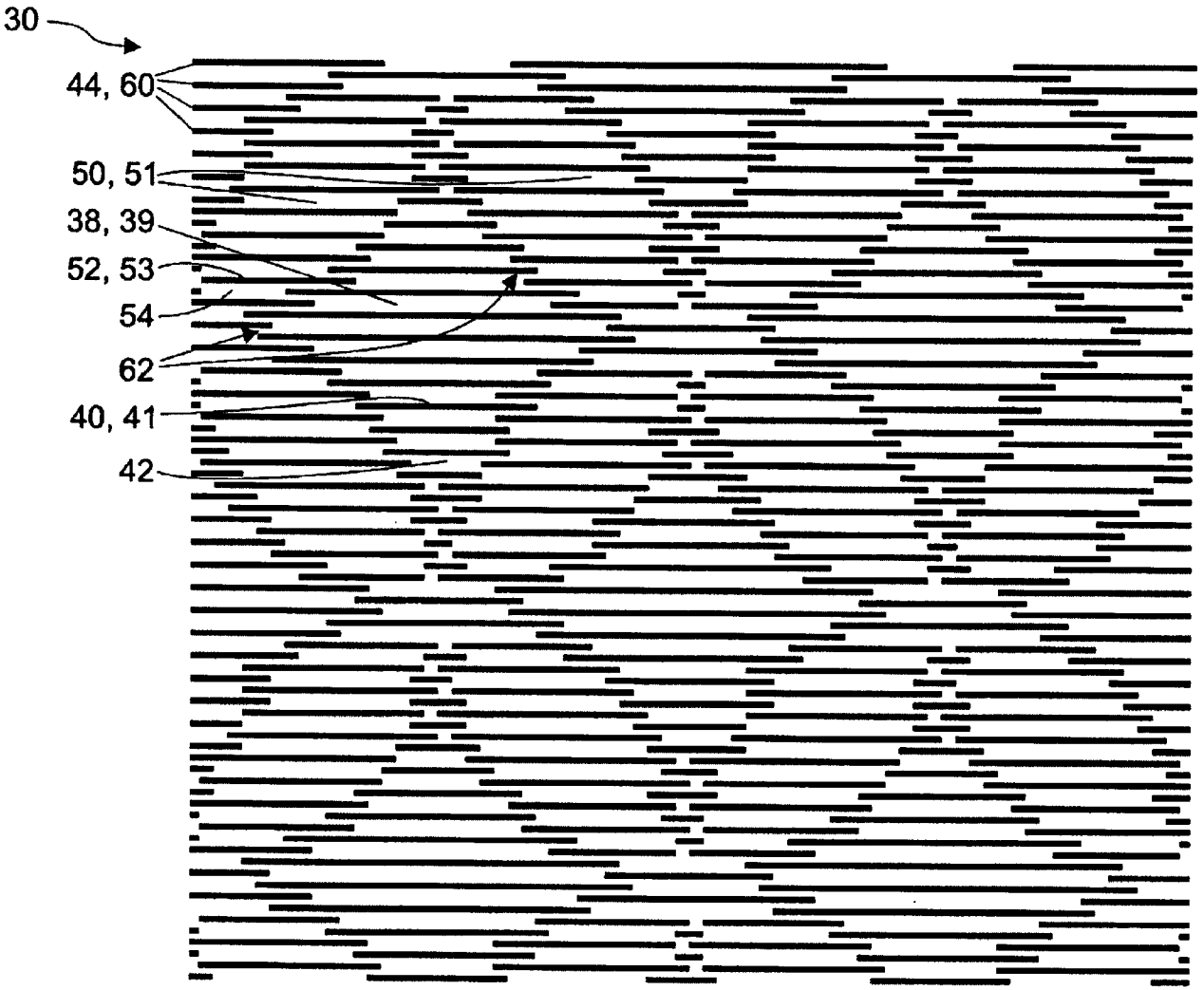
FIG. 1B is a schematic diagram of one embodiment of the fabric of the present invention.

The overall visual effect created by a repeating unit cell comprising the curvilinear transition region 62 of FIG. 1A is shown in FIG. 1B, which depicts several continuous transition regions 62 forming a repeating wedding ring pattern of curvilinear decorative elements.

Figure 2:
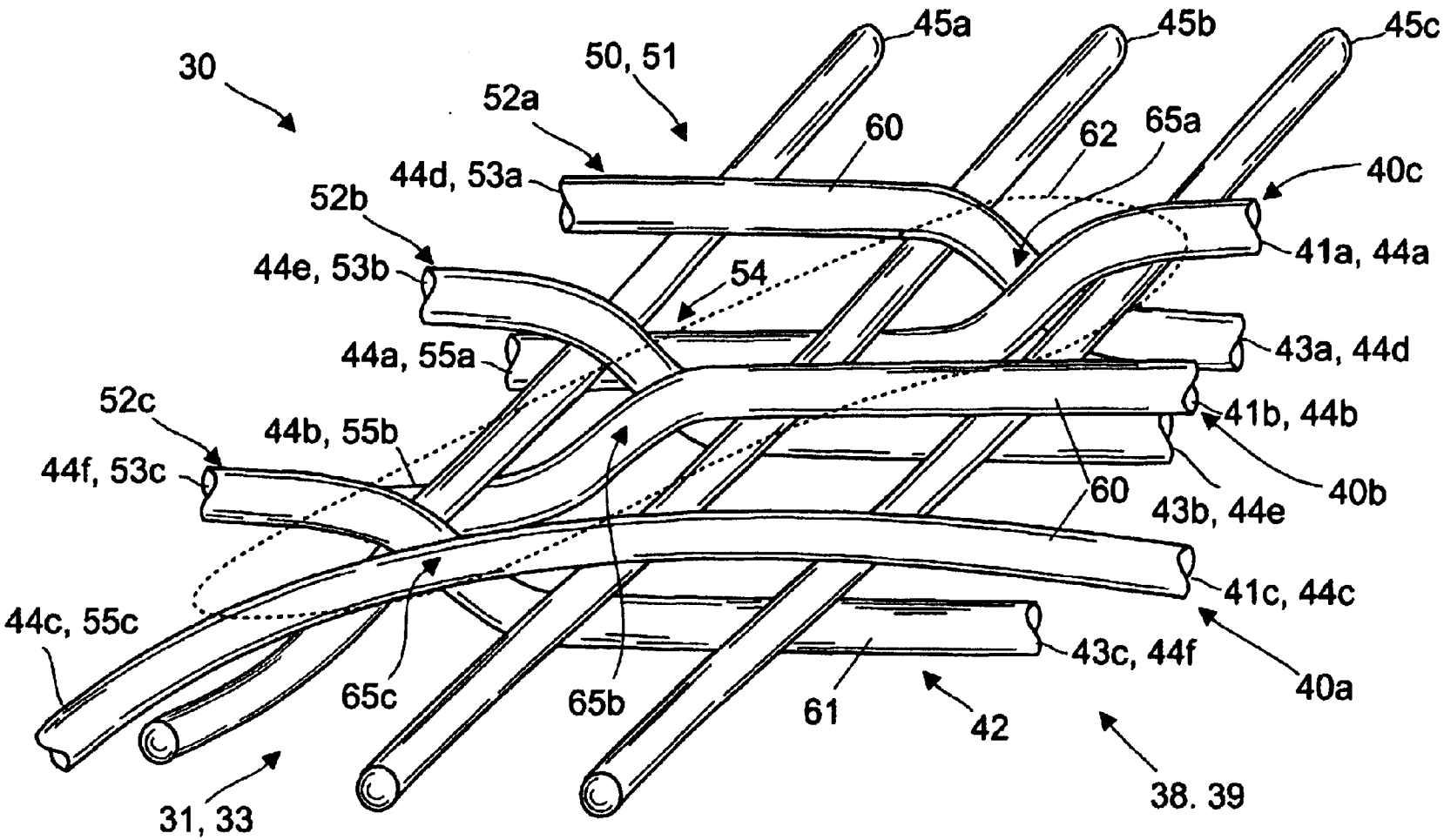
FIG. 2 is a schematic diagram of one embodiment of the fabric of the present invention.

FIG. 2 depicts a portion of a woven sculpted fabric 30 made according to the present invention. In this portion, the three shutes 45*a*, 45*b*, and 45*c* are interwoven with the six warps 44*a*–44*f*. A transition region 62 separates a first background region 38 from a second background region 50. The first background region 38 has first elevated strands 41*a*, 41*b*, and 41*c* which define the first elevated regions 40*a*, 40*b*, and 40*c*, and the first depressed strands 43*a*, 43*b*, and 43*c* which define the first depressed regions 42 (only one of which is labeled). The alternation between the first elevated regions 40*a*, 40*b*, and 40*c* and the first depressed regions 42 creates a first background texture 39 in the first background region 38.

Likewise, the second background region 50 has second elevated strands 53*a*, 53*b*, and 53*c* which define the second elevated regions 52*a*, 52*b*, and 52*c*, and the second depressed strands 55*a*, 55*b*, and 55*c* which define the second depressed regions 54 (only one of which is labeled).

The alternation of second elevated regions 52*a*, 52*b*, and 52*c* with the second depressed regions 54 creates a second background texture 51 in the second background region 50. The warps 44*a*, 44*b*, and 44*c* forming the first elevated regions 40*a*, 40*b*, and 40*c* in the first background region 38 become the second depressed regions 54 (second depressed strands 55*a*, 55*b*, and 55*c*) in the second background region 50, and visa versa.

In general, the warps 44 in either of the first and second background region 38 and 50 alternate in the cross-machine direction between being floats 60 and sinkers 61, providing a background texture 39 or 51 dominated by machine direction elongated features which become inverted (floats 60 become sinkers 61 and visa versa) after passing through the transition zone 62.

Three crossover zones 65*a*, 65*b*, and 65*c* occur in the transition region 62 where a first elevated strand 41*a*, 41*b*, or 41*c* descends below a shute 45*a*, 45*b*, or 45*c* in the vicinity where a second elevated strand 53*a*, 53*b*, or 53*c* also descends below a shute 45*a*, 45*b*, or 45*c*. In the crossover zone 65*a*, the warps 44*a* and 44*d* both descend from their status as floats 60 in the first and second background regions 38 and 50, respectively, to become sinkers 61, with the descent occurring between the shutes 45*b* and 45*c*.

The crossover zone 65*c* differs from the crossover zones 65*a* and 65*b* in that the two adjacent warps 44*c* and 44*f* descend on opposite sides of a single shute 45*a*. The tension in the warps 44*c* and 44*f* can act in the crossover zone 65*c* to bend the shute 45*a* downward more than normally encountered in the first and second background regions 38 and 50, resulting in a depression in the woven sculpted fabric 30 that can result in increased depth of molding in the vicinity of the crossover zone 65*c*. Overall, the various crossover zones 65*a*, 65*b*, and 65*c* in the transition region 62 provide increased molding depth in the woven sculpted fabric 30 that can impart visually distinctive curvilinear decorative elements to an absorbent tissue product 27 molded thereon, with the visually distinct nature of the curvilinear decorative elements being achieved by means of the interruption in the texture dominated by the MD-oriented floats 60 between two adjacent background regions 38 and 50 and optionally by the increased molding depth in the transition region 62 due to pockets or depressions in the woven sculpted fabric 30 created by the crossover zones 65*a*, 65*b*, and 65*c*.

The first and second depressed strands 43 and 55 can be classified as sinkers 61, while the first and second elevated strands 41 and 53 can be classified as floats 60.

The shutes 45 depicted in FIG. 2 represent the topmost layer of CD shutes 33 of the woven sculpted fabric 30, which can be part of a base layer 31 of the woven sculpted fabric 30. A base layer 31 can be a load-bearing layer. The base layer 31 can also comprise multiple groups of interwoven warps 44 and shutes 45 or nonwoven layers (not shown), metallic elements or bands, foam elements, extruded polymeric elements, photocured resin elements, sintered particles, and the like.

Figure 3:
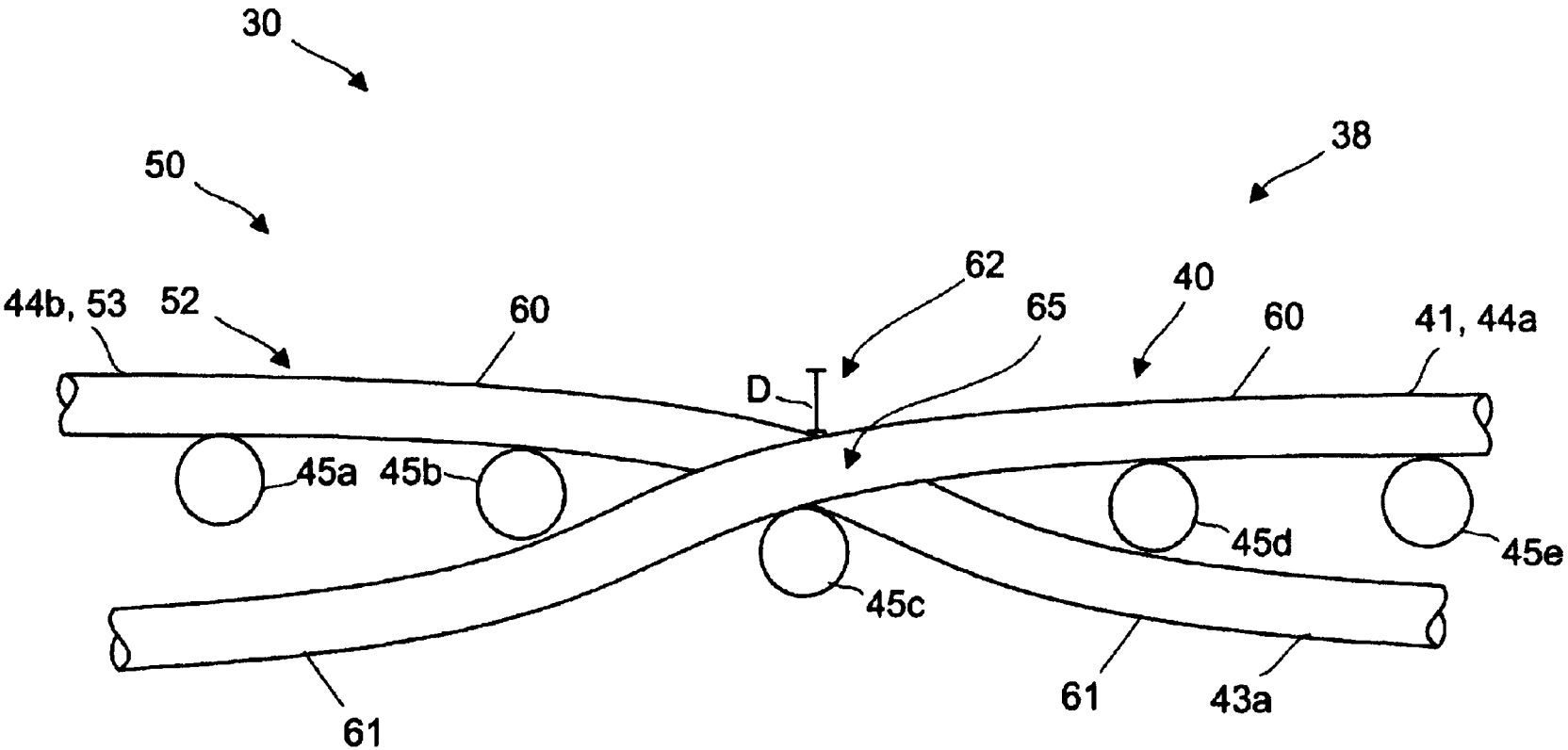
FIG. 3 is a cross-sectional view of one embodiment of the fabric of the present invention.

FIG. 3 is a cross-sectional view of a portion of a woven sculpted fabric 30 showing a crossover region 65 similar to that of crossover region 65*c* in FIG. 2. Five consecutive shutes 45*a*–45*e* and two adjacent warps 44*a* and 44*b* are shown. The two warps 44*a* and 44*b* serve as a first elevated strand 41 and second elevated strand 53, respectively, in a first background region 38 and a second background region 50, respectively, where the warps 44*a* and 44*b* are floats 60 defining a first elevated region 40 and a second elevated region 52, respectively. After passing through the transition region 62 and crossing over the shute 45*c* in a crossover region 65, the two warps 44*a* and 44*b* each become sinkers 61 as the two warps 44*a* and 44*b* extend into the second background region 50 and the first background region 38, respectively.

In the crossover zone 65, the two adjacent warps 44*a* and 44*b* descend on opposite sides of a single shute 45*c*. The tension in the warps 44*c* and 44*f* can act in the crossover zone 65 to bend the shute 45*c* downward relative to the neighboring shutes 45*a*, 45*b*, 45*d*, and 45*e*, and particularly relative to the adjacent shutes 45*b* and 45*d*, resulting in a depression in the woven sculpted fabric 30 having a depression depth D relative to the maximum plane difference of the float 60 portions of the warps 44*a* and 44*b* in the adjacent first and second background regions 38 and 50, respectively, that can result in increased depth of molding in the vicinity of the crossover zone 65.

The maximum plane difference of the floats 60 may be at least about 30% of the width of at least one of the floats 60. In other embodiments, the maximum plane difference of the floats 60 may be at least about 70%, more specifically at least about 90%. The maximum plane difference of the floats 60 may be at least about 0.12 millimeter (mm). In other embodiments, the maximum plane difference of the floats 60 may be at least about 0.25 mm, more specifically at least about 0.37 mm, and more specifically at least about 0.63 mm.

Figure 4:
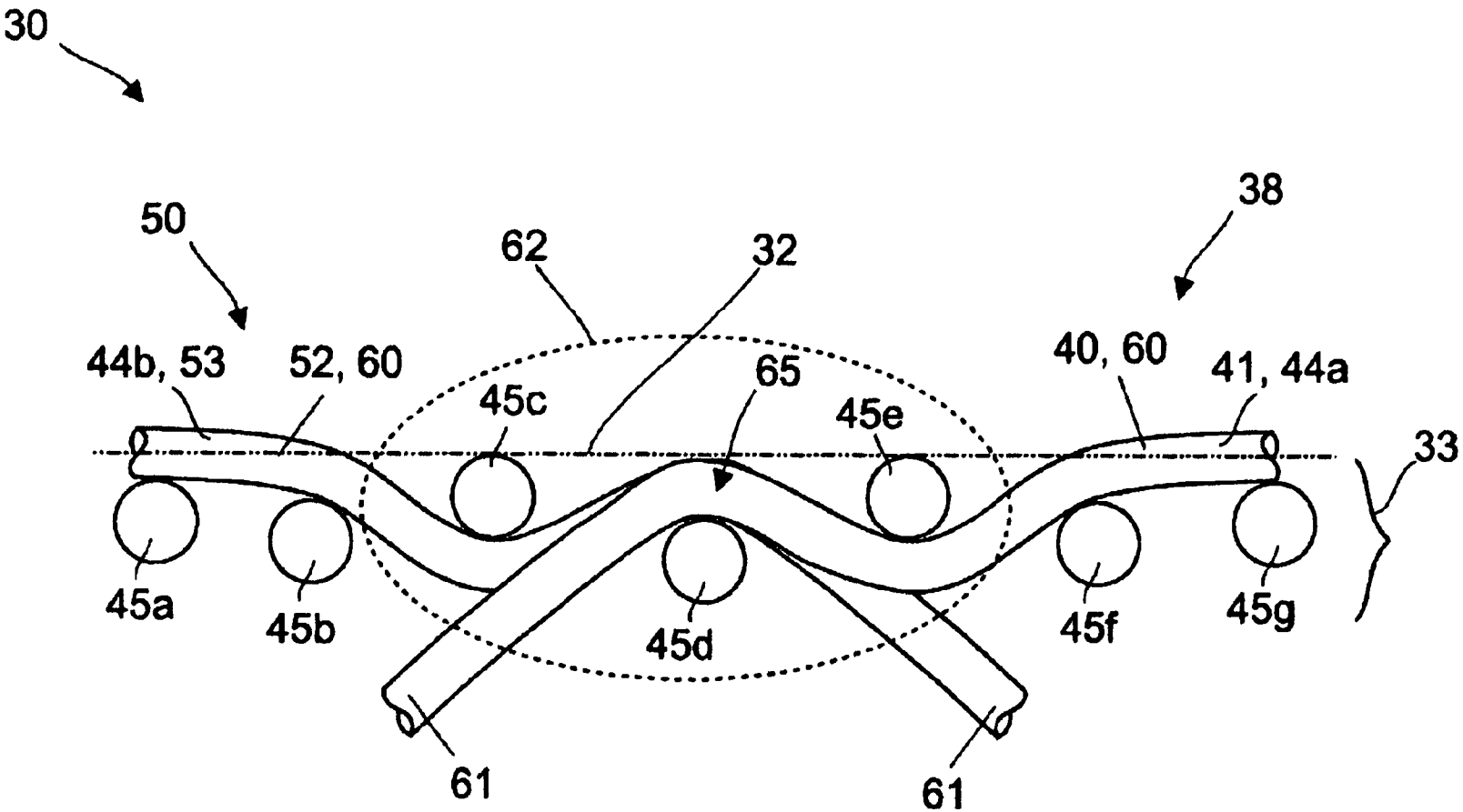
FIG. 4 is a cross-sectional view of one embodiment of the fabric of the present invention.

FIG. 4 depicts another cross-sectional view of a portion of a woven sculpted fabric 30 showing a crossover region 65. Seven consecutive shutes 45*a*–45*g* and two adjacent warps 44*a* and 44*b* are shown.

The two warps 44*a* and 44*b* serve as a first elevated strand 41 and second elevated strand 53, respectively, in a first background region 38 and second background region 50, respectively, where the warps 44*a* and 44*b* are floats 60 defining a first elevated region 40 and second elevated region 52, respectively. The transition region 62 spans three shutes 45*c*, 45*d* and 45*e*. Proceeding from right to left, the first elevated strand 41 enters the transition region 62 between the shutes 45*f* and 45*e*, descending from its status as a float 60 in first background region 38 as it passes beneath the float 45*e*. It then passes over the shute 45*d* and then descends below the shute 45*c*, continuing on into the second background region 50 where it becomes a sinker 61. The second elevated strand 53 is a mirror image of the first elevated strand 41 (reflected about an imaginary vertical axis, not shown, passing through the center of the shute 45*d*) in the portion of the woven sculpted fabric 30 depicted in FIG. 4. Thus, the second elevated strand 53 enters the transition region 62 between the shutes 45*b* and 45*c*, passes over the shute 45*d*, and then descends beneath the shute 45*e* to become a sinker 61 in the first background region 38. The first elevated strand 41 and the second elevated strand 53 cross over each other in a crossover region 65 above the shute 45*d*, which may be deflected downward by tension in the warps 44*a* and 44*b*.

Also depicted is the topmost layer of CD shutes 33 of the woven sculpted fabric 30, which can define an upper plane 32 of the topmost layer of CD shutes 33 when the fabric 30 is resting on a substantially flat surface. Not all shutes 45 in the topmost layer of CD shutes 33 sit at the same height; the uppermost shutes 45 of the topmost layer of CD shutes 33 determine the elevation of the upper plane 32 of the topmost layer of CD shutes 33. The difference in elevation between the upper plane 32 of the topmost layer of CD shutes 33 and the highest portion of a float 60 is the "Upper Plane Difference," as used herein, which can be 30% or greater of the diameter of the float 60, or can be about 0.1 mm or greater; about 0.2 mm or greater; or, about 0.3 mm or greater.

Figure 5:
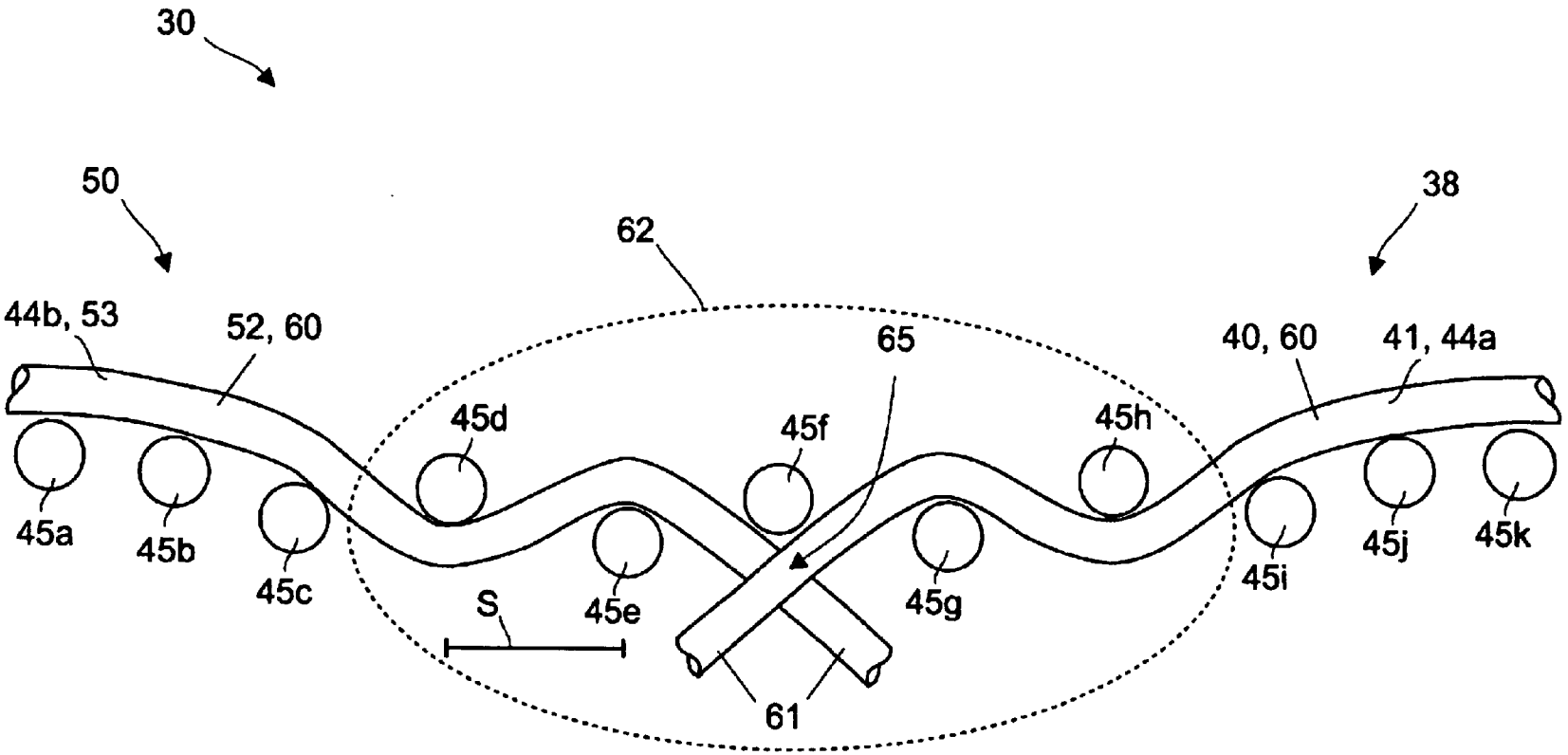
FIG. 5 is a cross-sectional view of one embodiment of the fabric of the present invention.

FIG. 5 depicts another cross-sectional view of a portion of a woven sculpted fabric 30 showing a transition region 62 with a crossover region 65, the transition region 62 being between a first background region 38 and a second background region 50. Eleven consecutive shutes 45*a*–45*k* and two adjacent warps 44*a* and 4*b* are shown. The configuration is similar to that of FIG. 4 except that the warp 44*a* which forms the first elevated strand 41 is shifted to the right by about twice the typical shute spacing S such that the warp 44*a* no longer passes over the same shute (45*e* in FIG. 5, analogous to 45*d* in FIG. 4 ) as the warp 44*b* that forms the second elevated strand 53 before descending to become a sinker 61. Rather, the warp 44*a* is shifted such that the warp 44*a* passes over the shute 45*g* before descending to become a sinker 61. Both the warps 44*a* and 44*b* pass below the shute 45*f* in the crossover region 65.

Figure 6:
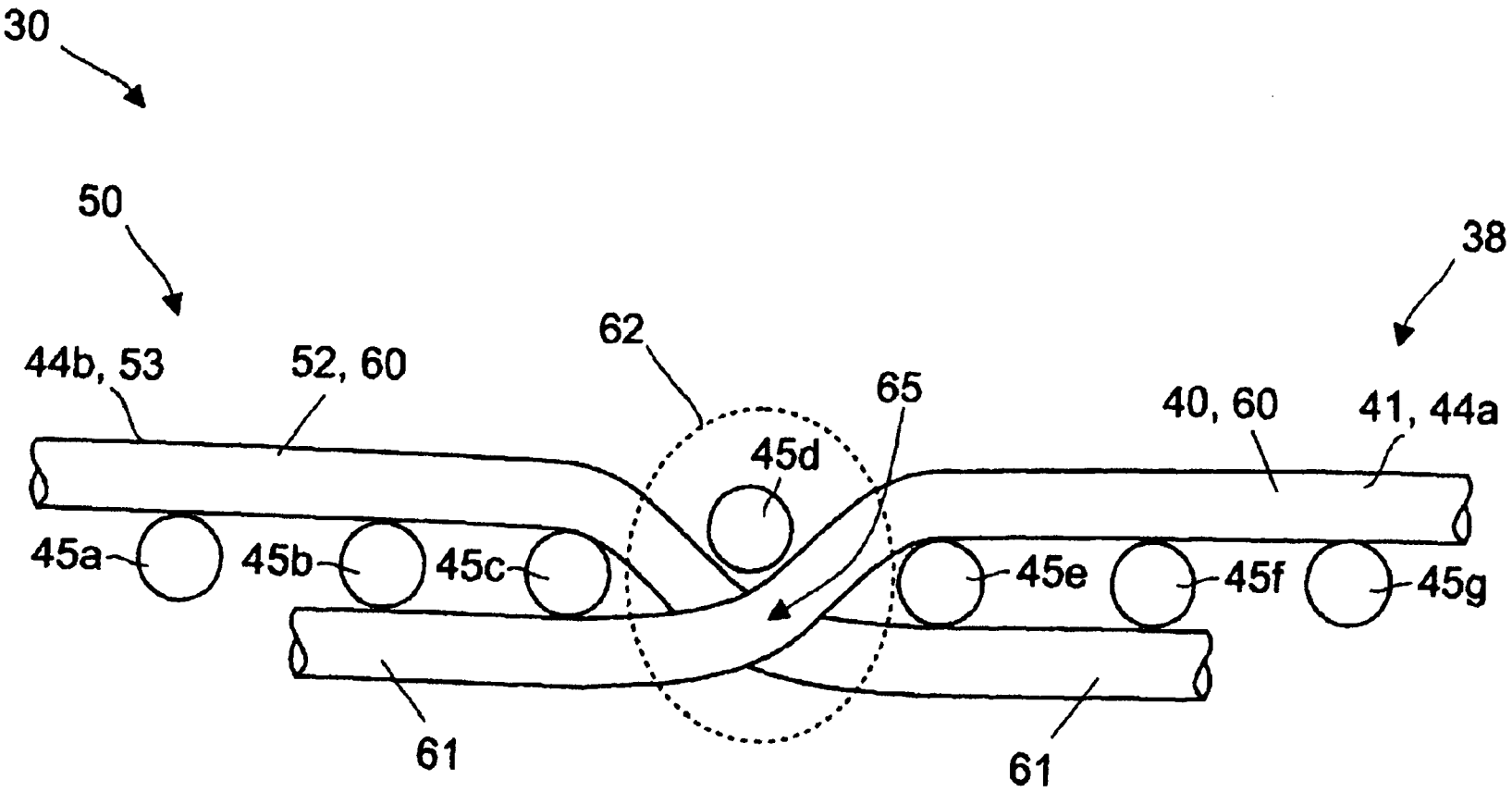
FIG. 6 is a cross-sectional view of one embodiment of the fabric of the present invention.

FIG. 6 depicts yet another cross-sectional view of a portion of a woven sculpted fabric 30 showing a transition region 62 with a crossover region 65. Seven consecutive shutes 45*a*–45*g* and two adjacent warps 44*a* and 44*b* are shown. The crossover region 65 is similar to the crossover regions 65*a* and 65*b* of FIG. 2. Both warps 44*a* and 44*b* descend below a common shute 45*d* in the transition region 62, becoming the sinkers 61.

Figure 7:
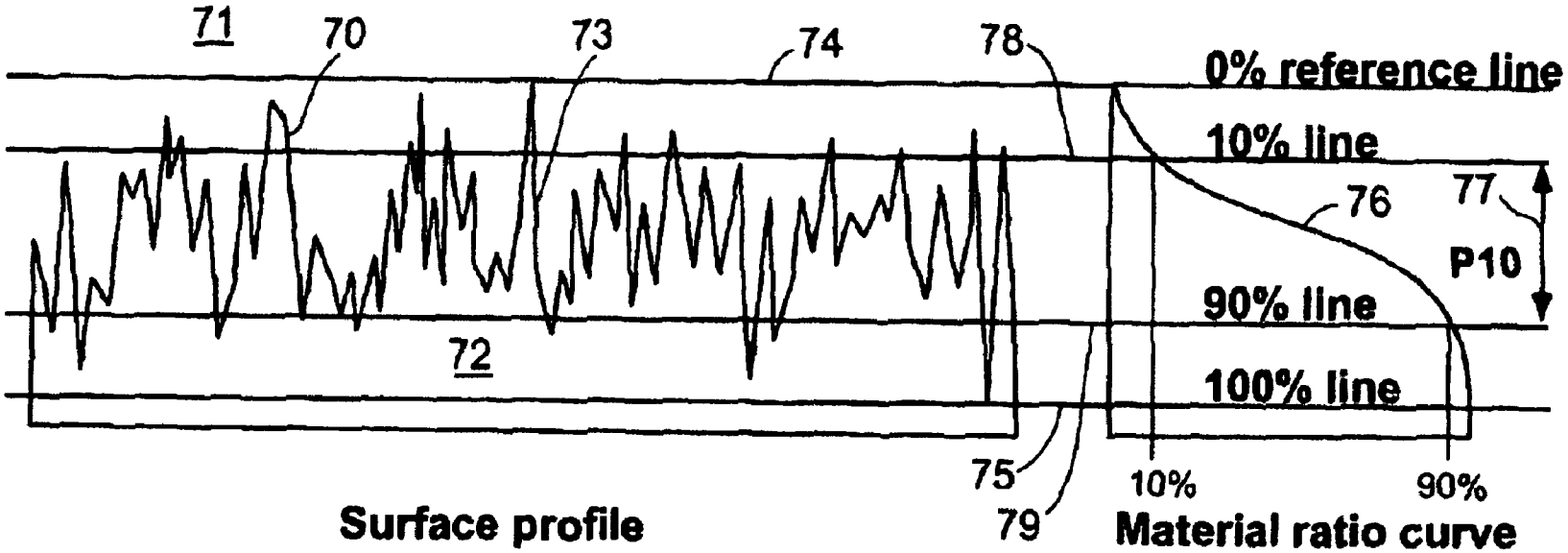
FIG. 7 is a schematic diagram of a surface profile and corresponding material lines of one embodiment of the fabric of the present invention.

FIG. 7 will be discussed hereinafter with respect to the analysis of the profile lines.

Figure 8:
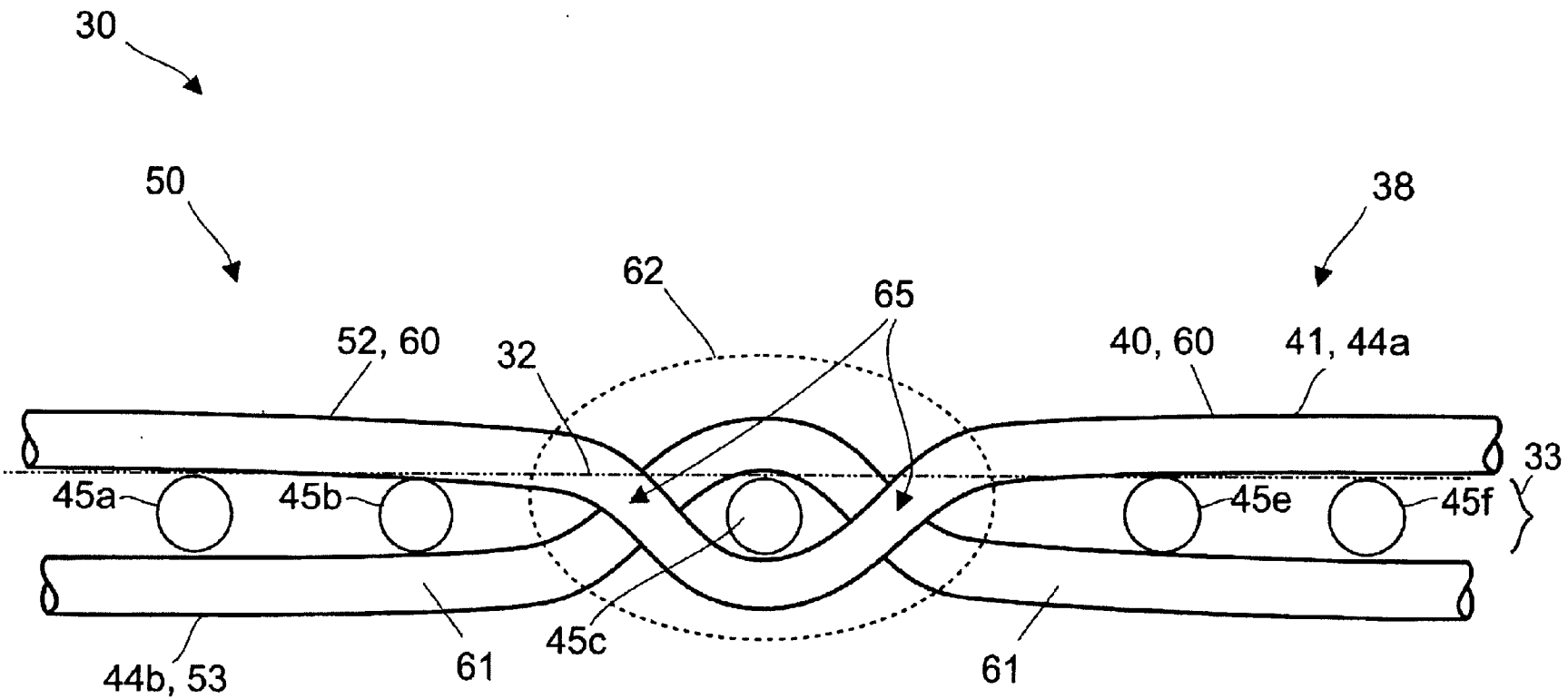
FIG. 8 is a cross-sectional view of one embodiment of the fabric of the present invention.

FIG. 8 is a cross-sectional view depicting another embodiment of a woven sculpted fabric 30. Here the two adjacent warps 44*a* and 44*b* are shown interwoven with the five consecutive shutes 45*a*–45*e*. As the warp 44*a* enters the transition region 62 from the first background region 38 where the warp 44*a* is a float 60, the warp 44*a* descends below the shute 45*c* in the transition region 62 and then rises again as it leaves the transition region 62 to become a float 60 in the second background region 50. Likewise, the warp 44*b* is a sinker 61 in the second background region 50, rises in the transition region 62 to pass above the shute 45*c*, then descends near the end of the transition region 62 to become a sinker 61 in the first background region 38. In the transition region 62, there are two crossover regions 65 for the two adjacent warps 44*a* and 44*b*. One can recognize that the first and second background textures 39 and 51 (not shown) formed by successive pairs of warps 44 (e.g., adjacent floats 60 and sinkers 61, such as the warp 44*a* and the warp 44*b*) would be interrupted at the transition region 62, and if multiple transition regions 62 were positioned to form a substantially continuous transition region 62 across a plurality of adjacent warps 44 (e.g., 8 or more adjacent warps 44), a curvilinear decorative element could be formed from the interruption in the background textures 39 and 51 of the background regions 38 and 50, respectively, imparting a visually distinctive texture to the wet tissue web 15 of an absorbent tissue product 27 molded on the woven sculpted fabric 30.

The sheets of the absorbent tissue products 27 (shown in FIGS. 29 and 30) of the present invention have two or more distinct textures. There may be at least one background texture 39 or 51 (also referred to as local texture) created by elevated warps 44, shutes 45, or other elevated elements in a woven sculpted fabric 30. For example, a first background region 38 of such a woven sculpted fabric 30 may have a first background texture 39 corresponding to a series of elevated and depressed regions 40 and 42 having a characteristic depth. The characteristic depth can be the elevation difference between the elevated and depressed strands 41 and 43 that define the first background texture 39, or the elevation difference between raised elements, such as the elevated warps 44 and shutes 45, and the upper plane 32 which sits on the topmost layer of CD shutes 33 of the woven sculpted fabric 30 (shown in FIG. 4). The shutes 45 can be part of a base layer 31 of the woven sculpted fabric 30, which can be a load-bearing base layer 31 (the base layer in the woven sculpted fabric 30 of FIG. 2 is depicted as the layer 31 of the shutes 45, but can comprise additional woven or interwoven layers, or can comprise nonwoven layers or composite materials).

Figure 9:
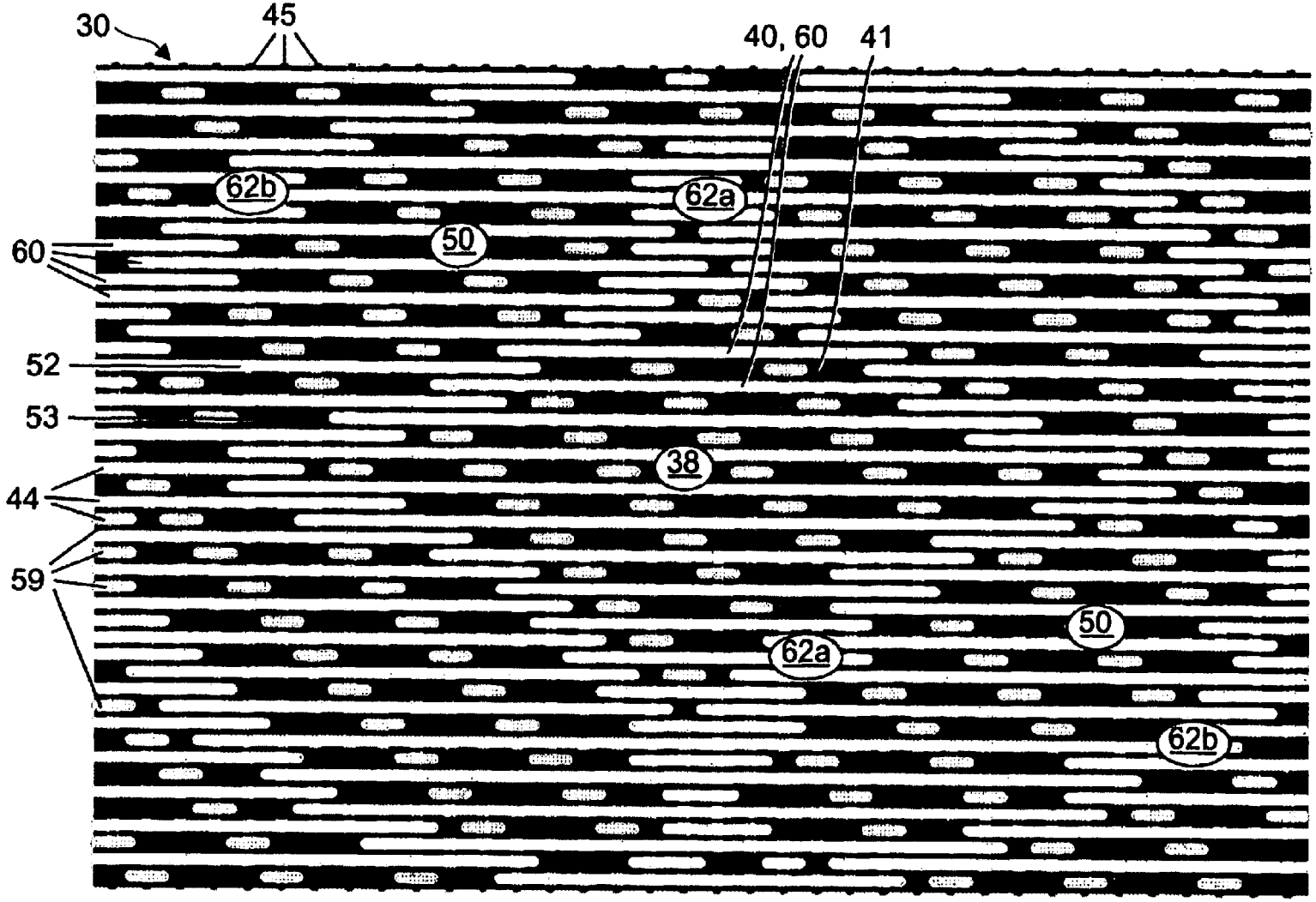
FIG. 9 is a schematic diagram of one embodiment of the fabric of the present invention.

FIG. 9 is a computer generated graphic of a woven sculpted fabric 30 according to the present invention depicting the shutes 45 and only the relatively elevated portions of the warps 44 on a black background for clarity. The most elevated portions of the warps 44, namely, the floats 60 that pass over two or more of the shutes 45, are depicted in white. Short intermediate knuckles 59, which are portions of the warps 44 that pass over a single shute 45, are more tightly pulled into the woven sculpted fabric 30 and protrude relatively less. To indicate the relatively lesser height of the intermediate knuckles 59, the intermediate knuckles 59 are depicted in gray, as are the shutes 45. In the center of the graphic lies a first background region 38 having first elevated regions 40 (machine direction floats 60) separated from one another by the first depressed regions 41 comprising intermediate knuckles 59, shutes 45, and sinkers 61 (not shown). As a warp 44 having a first elevated region 40 passes through the transition region 62*a* and enters the second background region 50, it descends into the woven sculpted fabric 30 and at least part of the warp 44 in the second background region 50 becomes a second depressed region 53. Likewise, the warps 44 that form a second elevated region 52 in the second background region 50 become depressed after passing through the transition region 62*a* such that at least part of such warps 44 now form the first depressed regions 41.

A second transition region 62*b* is shown in FIG. 9, although in this case it is part of repeating elements substantially identical to portions of the first transition region 62*a*. In other embodiments, the woven sculpted fabric 30 can have a complex pattern such that a basic repeating unit has a plurality of background regions (e.g., three or more distinct regions) and a plurality of transition regions 62.

Tissue Description

A second background region 50 of the woven sculpted fabric 30 may have a second background texture 51 with a similar or different characteristic depth compared to the first background texture 39 of the first background region 38. The first and second background regions 38 and 50 are separated by a transition region 62 which forms a visually noticeable border 63 between the first and second background regions 38 and 50 and which provides a surface structure molding the wet tissue web 15 to a different depth or pattern than is possible in the first and second background regions 38 and 50. The transition region 62 created is preferably oriented at an angle to the warp or shute directions. Thus, a wet tissue web 15 molded against the woven sculpted fabric 62 is provided with a distinctive texture corresponding to the first and/or second background textures 39 and/or 51 and substantially continuous curvilinear decorative elements corresponding to the transition region 62, which can stand out from the surrounding first and second background texture regions 39 and 51 of the first and second background regions 38 and 50 of the wet tissue web 15 by virtue of having a different elevation (higher or lower as well as equal) or a visually distinctive area of interruption between the first and second background texture regions 39 and 51 of the first and second background regions 38 and 50, respectively.

In one embodiment, the transition region 62 provides a surface structure wherein the wet tissue web 15 is molded to a greater depth than is possible in the first and second background regions 38 and 50. Thus, a wet tissue web 15 molded against the woven sculpted fabric 30 is provided with greater indentation (higher surface depth) in the transition region 62 than in the first and second background regions 38 and 50.

In other embodiments, the transition region 62 can have a surface depth that is substantially the same as the surface depth of either the first or second background regions 38 and 50, or that is between the surface depths of the first and second background regions 38 and 50 (an intermediate surface depth), or that is within plus or minus 50% of the average surface depth of the first and second background regions 38 and 50, or more specifically within plus or minus 20% of the average surface depth of the first and second background regions 38 and 50.

When the surface depth of the transition region 62 is not greater than that of the first and second background regions 38 and 50, the curvilinear decorative elements corresponding to the transition region 62 imparted to the wet tissue web 15 by molding against the transition region 62 is at least partially due to the interruption in the curvilinear decorative elements provided by the first and second background regions 38 and 50 which creates a visible border 63 or marking extending along the transition region 62. The curvilinear decorative elements imparted to the wet tissue web 15 in the transition region 62 may simply be the result of a distinctive texture interrupting the first and second background regions 38 and 50.

In one embodiment of the present invention, the first and second background regions 38 and 50 both have substantially parallel woven first and second elevated strands 41 and 53, respectively, with a dominant direction (e.g., machine direction, cross-machine direction, or an angle therebetween), wherein first background texture 39 in the first background region 38 is offset from the second background texture 51 in the second background region 50 such that as one moves horizontally (parallel to the plane of the woven sculpted fabric 30) along a woven first elevated strand 41 in the first background region 38 toward the transition region 62 and continues in a straight line into the second background region 50, a second depressed region 54 rather than a second elevated strand 58 is encountered in the second background region 50.

Likewise, a first depressed region 42 that approaches the transition region 62 in the first background region 38 becomes a second elevated strand 53 in the second background region 50. When the woven sculpted fabric 30 is comprised of woven warps 44 (machine direction strands) and shutes 45 (cross-machine direction strands), the first and second elevated regions 40 and 52 are floats 60 rising above the topmost layer of CD shutes 33 of the woven sculpted fabric 30 and crossing over a plurality of roughly orthogonal strands before descending into the topmost layer of CD shutes 33 of the woven sculpted fabric 30 again.

For example, a warp 44 rising above the topmost layer of CD shutes 33 of the woven sculpted fabric 30 can pass over 4 or more shutes 45 before descending into the woven sculpted fabric 30 again, such as at least any of the following number of shutes 45: 5, 6, 7, 8, 9, 10, 15, 20, and 30. While the warp 44 in question is above the topmost layer of CD shutes 33, the immediately adjacent warps 44 are generally lower, passing into the topmost layer of CD shutes 33. As the warp 44 in question then sinks into the topmost layer of CD shutes 33, the adjacent warps 44 rise and extend over a plurality of shutes 45. Generally, over much of the woven sculpted fabric 30, four adjacent warps 44 arbitrarily numbered in order 1, 2, 3, and 4, can have warps 44 1 and 3 rise above the topmost layer of CD shutes 33 to descend below the topmost layer of CD shutes 33 after a distance, at which point warps 44 2 and 4 are initially primarily below the surface of the warps 44 in the topmost layer of CD shutes 33 but rise in the region where warps 44 1 and 3 descend.

In another embodiment of the present invention, the first and second background regions 38 and 50 both have substantially parallel woven first and second elevated strands 41 and 53 with a dominant direction (e.g., machine direction, cross-machine direction, or an angle therebetween), wherein first background texture 39 in the first background region 38 is offset from the second background texture 51 in the second background region 50 such that as one moves horizontally (parallel to the plane of the woven sculpted fabric 30) along a woven first elevated strand 41 in the first background region 38 toward the transition region 62 and continues in a straight line into the second background region 50, a woven second elevated strand 53 rather than a second depressed region 54 is encountered in the second background region 50. Likewise, a first depressed region 42 that approaches the transition region 62 in the first background region 38 becomes a second depressed region 54 in the second background region 50.

In another embodiment of the present invention, the woven sculpted fabric 30 is a woven fabric having a tissue contacting surface including at least two groups of strands, a first group of strands 46 extending in a first direction, and a second group of strands 58 extending in a second direction which can be substantially orthogonal to the first direction, wherein the first group of strands 46 provides elevated floats 60 defining a three-dimensional fabric surface comprising:

a) a first background region 38 comprising a plurality of substantially parallel first elevated strands 41 separated by substantially parallel first depressed strands 43, wherein each first depressed strand 43 is surrounded by an adjacent first elevated strand 41 on each side, and each first elevated strand 41 is surrounded by an adjacent first depressed strand 43 on each side;

b) a second background region 50 comprising a plurality of substantially parallel second elevated strands 53 separated by substantially parallel second depressed strands 55, wherein each second depressed strand 55 is surrounded by an adjacent second elevated strand 53 on each side, and each second elevated strand 53 is surrounded by an adjacent second depressed strand 55 on each side; and, c) a transition region 62 between the first and second background regions 38 and 50, wherein the first and second elevated strands 41 and 53 of both the first and second background regions 38 and 50 descend to become, respectively, the first and second depressed strands 43 and 55 of the second and first background regions 38 and 50.

In the transition region 62, the first group of strands 46 may overlap with a number of strands in the second group of strands 58, such as any of the following: 1, 2, 3, 4, 5, 10, two or more, two or less, and three or less.

Each pair of first elevated floats 41 is separated by a distance of at least about 0.3 mm. In other embodiments, each pair of first elevated floats 41 is separated by a distance ranging between about 0.3 mm to about 25 mm, more specifically between about 0.3 mm to about 8 mm, more specifically between about 0.3 mm to about 3 mm, more specifically between about 0.3 mm to about 1 mm, more specifically between about 0.8 mm to about 1 mm. Each pair of second elevated floats 53 is separated by a distance of at least about 0.3 mm. In other embodiments, each pair of second elevated floats 53 is separated by a distance ranging between about 0.3 mm to about 25 mm, more specifically between about 0.3 mm to about 8 mm, more specifically between about 0.3 mm to about 3 mm, more specifically between about 0.3 mm to about 1 mm, more specifically between about 0.8 mm to about 1 mm.

The resulting surface topography of the dried tissue web 23 may comprise a primary pattern 64 having a regular repeating unit cell that can be a parallelogram with sides between 2 and 180 mm in length. For wetlaid materials, these three-dimensional basesheet structures can be created by molding the wet tissue web 15 against the woven sculpted fabrics 30 of the present invention, typically with a pneumatic pressure differential, followed by drying. In this manner, the three-dimensional structure of the dried tissue web 23 is more likely to be retained upon wetting of the dried tissue web 23, helping to provide high wet resiliency.

In addition to the regular geometrical patterns (resulting from the first and second background texture regions 39 and 51, and the curvilinear decorative elements of the primary pattern 64, imparted by the woven sculpted fabrics 30 and other typical fabrics used in creating a dried tissue web 23, additional fine structure, with an in-plane length scale less than about 1 mm, can be present in the dried tissue web 23. Such a fine structure may stem from microfolds created during differential velocity transfer of the wet tissue web 15 from one fabric or wire to another fabric or wire prior to drying. Some of the absorbent tissue products 27 of the present invention, for example, appear to have a fine structure with a fine surface depth of 0.1 mm or greater, and sometimes 0.2 mm or greater, when height profiles are measured using a commercial moiré interferometer system. These fine peaks have a typical half-width less than 1 mm. The fine structure from differential velocity transfer and other treatments may be useful in providing additional softness, flexibility, and bulk. Measurement of the fine surface structures and the geometrical patterns is described below.

Cadeyes Measurements

One measure of the degree of molding created in a wet tissue web 15 using the woven sculpted fabrics 30 of the present invention involves the concept of optically measured surface depth. As used herein, "surface depth" refers to the characteristic height of peaks relative to surrounding valleys in a portion of a structure such as a wet tissue web 15 or putty impression of a woven sculpted fabric 30. In many embodiments of the present invention, topographical measurements along a particular line will reveal many valleys having a relatively uniform elevation, with peaks of different heights corresponding to the first and second background texture regions 39 and 51 and a more prominent primary pattern 64. The characteristic elevation relative to a baseline defined by surrounding valleys is the surface depth of a particular portion of the structure being measured. For example, the surface depth of a first or second background texture regions 39 or 51 of a wet tissue web 15 may be 0.4 mm or less, while the surface depth of the primary pattern 66 may be 0.5 mm or greater, allowing the primary pattern 64 to stand out from the first or second background texture regions 39 or 51.

The wet tissue webs 15 created in the present invention possess three-dimensional structures and can have a Surface Depth for the first or second background texture regions 39 or 51 and/or primary pattern 64 of about 0.15 mm. or greater, more specifically about 0.3 mm. or greater, still more specifically about 0.4 mm. or greater, still more specifically about 0.5 mm. or greater, and most specifically from about 0.4 to about 0.8 mm. The primary pattern 64 may have a surface depth that is greater than the surface depth of the first or second background texture regions 39 or 51 by at least about 10%, more specifically at least about 25%, more specifically still at least about 50%, and most specifically at least about 80%, with an exemplary range of from about 30% to about 100%. Obviously, elevated molded structures on one side of a wet tissue web 15 can correspond to depressed molded structures on the opposite of the wet tissue web 15. The side of the wet tissue web 15 giving the highest Surface Depth for the primary pattern 64 generally is the side that should be measured.

A suitable method for measurement of Surface Depth is moiré interferometry, which permits accurate measurement without deformation of the surface of the wet tissue webs 15. For reference to the wet tissue webs 15 of the present invention, the surface topography of the wet tissue webs 15 should be measured using a computer-controlled white-light field-shifted moiré interferometer with about a 38 mm field of view. The principles of a useful implementation of such a system are described in Bieman et al. (L. Bieman, K. Harding, and A. Boehnlein, "Absolute Measurement Using Field-Shifted Moiré," SPIE Optical Conference Proceedings, Vol. 1614, pp. 259–264, 1991). A suitable commercial instrument for moiré interferometry is the CADEYES® interferometer produced by Integral Vision (Farmington Hills, Mich.), constructed for a 38-mm field-of-view (a field of view within the range of 37 to 39.5 mm is adequate). The CADEYES® system uses white light which is projected through a grid to project fine black lines onto the sample surface. The surface is viewed through a similar grid, creating moiré fringes that are viewed by a CCD camera. Suitable lenses and a stepper motor adjust the optical configuration for field shifting (a technique described below). A video processor sends captured fringe images to a PC computer for processing, allowing details of surface height to be back-calculated from the fringe patterns viewed by the video camera.

In the CADEYES moiré interferometry system, each pixel in the CCD video image is said to belong to a moiré fringe that is associated with a particular height range. The method of field-shifting, as described by Bieman et al. (L. Bieman, K. Harding, and A. Boehnlein, "Absolute Measurement Using Field-Shifted Moiré," SPIE Optical Conference Proceedings, Vol. 1614, pp. 259–264, 1991) and as originally patented by Boehnlein (U.S. Pat. No. 5,069,548, herein incorporated by reference), is used to identify the fringe number for each point in the video image (indicating which fringe a point belongs). The fringe number is needed to determine the absolute height at the measurement point relative to a reference plane. A field-shifting technique (sometimes termed phase-shifting in the art) is also used for sub-fringe analysis (accurate determination of the height of the measurement point within the height range occupied by its fringe). These field-shifting methods coupled with a camera-based interferometry approach allows accurate and rapid absolute height measurement, permitting measurement to be made in spite of possible height discontinuities in the surface. The technique allows absolute height of each of the roughly 250,000 discrete points (pixels) on the sample surface to be obtained, if suitable optics, video hardware, data acquisition equipment, and software are used that incorporates the principles of moiré interferometry with field-shifting. Each point measured has a resolution of approximately 1.5 microns in its height measurement.

The computerized interferometer system is used to acquire topographical data and then to generate a grayscale image of the topographical data, said image to be hereinafter called "the height map". The height map is displayed on a computer monitor, typically in 256 shades of gray and is quantitatively based on the topographical data obtained for the sample being measured. The resulting height map for the 38-mm square measurement area should contain approximately 250,000 data points corresponding to approximately 500 pixels in both the horizontal and vertical directions of the displayed height map. The pixel dimensions of the height map are based on a 512×512 CCD camera which provides images of moiré patterns on the sample which can be analyzed by computer software. Each pixel in the height map represents a height measurement at the corresponding x- and y-location on the sample. In the recommended system, each pixel has a width of approximately 70 microns, i.e. represents a region on the sample surface about 70 microns long in both orthogonal in-plane directions). This level of resolution prevents single fibers projecting above the surface from having a significant effect on the surface height measurement. The z-direction height measurement must have a nominal accuracy of less than 2 microns and a z-direction range of at least 1.5 mm. (For further background on the measurement method, see the CADEYES Product Guide, Integral Vision, Farmington Hills, Mich., 1994, or other CADEYES manuals and publications of Integral Vision, formerly known as Medar, Inc.).

The CADEYES system can measure up to 8 moiré fringes, with each fringe being divided into 256 depth counts (sub-fringe height increments, the smallest resolvable height difference). There will be 2048 height counts over the measurement range. This determines the total z-direction range, which is approximately 3 mm in the 38-mm field-of-view instrument. If the height variation in the field of view covers more than eight fringes, a wrap-around effect occurs, in which the ninth fringe is labeled as if it were the first fringe and the tenth fringe is labeled as the second, etc. In other words, the measured height will be shifted by 2048 depth counts. Accurate measurement is limited to the main field of 8 fringes.

The moiré interferometer system, once installed and factory calibrated to provide the accuracy and z-direction range stated above, can provide accurate topographical data for materials such as paper towels. (Those skilled in the art may confirm the accuracy of factory calibration by performing measurements on surfaces with known dimensions). Tests are performed in a room under Tappi conditions (23° C., 50% relative humidity). The sample must be placed flat on a surface lying aligned or nearly aligned with the measurement plane of the instrument and should be at such a height that both the lowest and highest regions of interest are within the measurement region of the instrument.

Once properly placed, data acquisition is initiated using Integral Visions's PC software and a height map of 250,000 data points is acquired and displayed, typically within 30 seconds from the time data acquisition was initiated. (Using the CADEYES® system, the "contrast threshold level" for noise rejection is set to 1, providing some noise rejection without excessive rejection of data points). Data reduction and display are achieved using CADEYES® software for PCs, which incorporates a customizable interface based on Microsoft Visual Basic Professional for Windows (version 3.0). The Visual Basic interface allows users to add custom analysis tools.

The height map of the topographical data can then be used by those skilled in the art to identify characteristic unit cell structures (in the case of structures created by fabric patterns; these are typically parallelograms arranged like tiles to cover a larger two-dimensional area) and to measure the typical peak to valley depth of such structures. A simple method of doing this is to extract two-dimensional height profiles from lines drawn on the topographical height map which pass through the highest and lowest areas of the unit cells. These height profiles can then be analyzed for the peak to valley distance, if the profiles are taken from a sheet or portion of the sheet that was lying relatively flat when measured. To eliminate the effect of occasional optical noise and possible outliers, the highest 10% and the lowest 10% of the profile should be excluded, and the height range of the remaining points is taken as the surface depth. Technically, the procedure requires calculating the variable which we term "P10," defined at the height difference between the 10% and 90% material lines, with the concept of material lines being well known in the art, as explained by L. Mummery, in *Surface Texture Analysis: The Handbook*, Hommelwerke GmbH, Mühlhausen, Germany, 1990. In this approach, which will be illustrated with respect to FIG. 7, the surface 70 is viewed as a transition from air 71 to material 72. For a given profile 73, taken from a flat-lying sheet, the greatest height at which the surface begins—the height of the highest peak—is the elevation of the "0% reference line" 74 or the "0% material line," meaning that 0% of the length of the horizontal line at that height is occupied by material 72. Along the horizontal line passing through the lowest point of the profile 73, 100% of the line is occupied by material 72, making that line the "100% material line" 75. In between the 0% and 100% material lines 74 and 75 (between the maximum and minimum points of the profile), the fraction of horizontal line length occupied by material 72 will increase monotonically as the line elevation is decreased. The material ratio curve 76 gives the relationship between material fraction along a horizontal line passing through the profile 73 and the height of the line. The material ratio curve 76 is also the cumulative height distribution of a profile 73. (A more accurate term might be "material fraction curve").

Once the material ratio curve 76 is established, one can use it to define a characteristic peak height of the profile 73. The P10 "typical peak-to-valley height" parameter is defined as the difference 77 between the heights of the 10% material line 78 and the 90% material line 79. This parameter is relatively robust in that outliers or unusual excursions from the typical profile structure have little influence on the P10 height. The units of P10 are mm. The Overall Surface Depth of a material 72 is reported as the P10 surface depth value for profile lines encompassing the height extremes of the typical unit cell of that surface 70. "Fine surface depth" is the P10 value for a profile 73 taken along a plateau region of the surface 70 which is relatively uniform in height relative to profiles 73 encompassing a maxima and minima of the unit cells. Unless otherwise specified, measurements are reported for the surface 70 that is the most textured side of the wet tissue webs 15 of the present invention, which is typically the side that was in contact with the through-drying fabric 19 when air flow is toward the throughdryer 21.

DETAILED DESCRIPTION OF FIGURES

Figure 10:
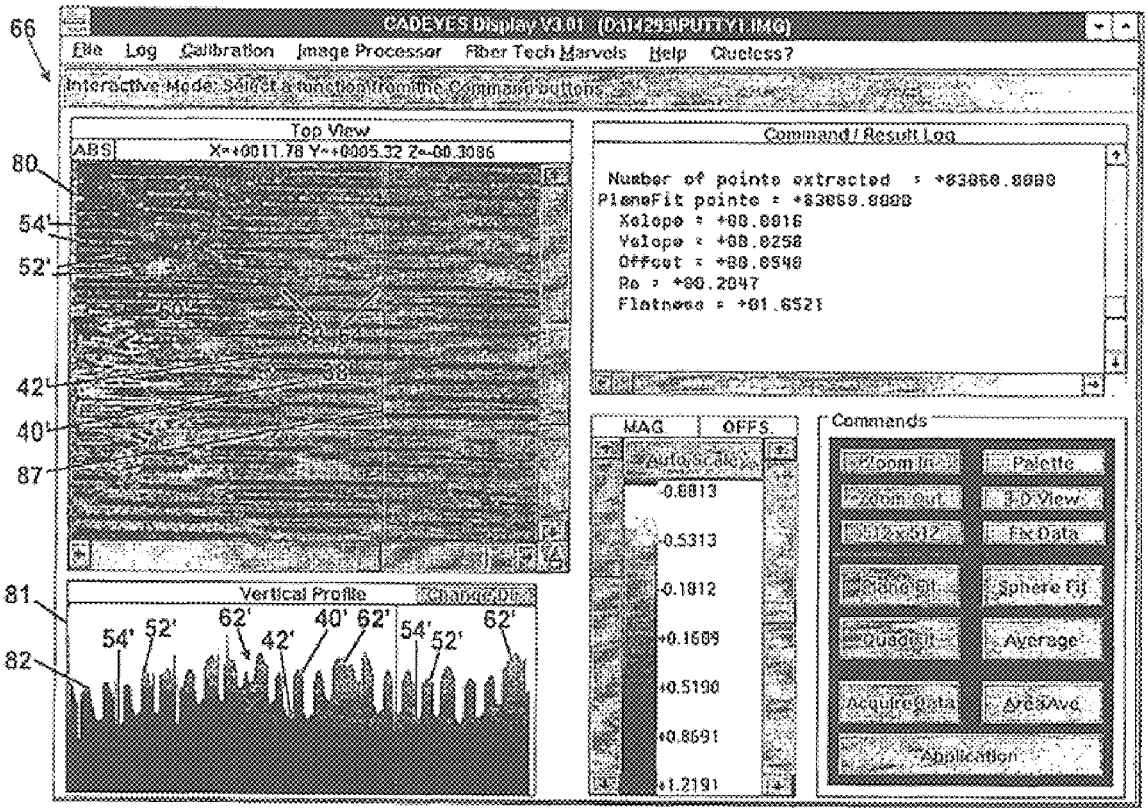
FIG. 10 is a CADEYES display screen shot of a putty impression of one embodiment of the fabric of the present invention.

FIG. 10 shows a screen shot 66 of the CADEYES® software main window containing a height map 80 of a putty impression of the woven sculpted fabric 30 made in accordance with the present invention. The height map 80 was created with a 35-mm field of view optical head with the CADEYES® moiré interferometry system. The putty impression was made using 65 grams of coral-colored Dow Corning 3179 Dilatant Compound (believed to be the original "Silly Putty®" material) in a conditioned room at 23° C. and 50% relative humidity. The Dilatant Compound was rendered more opaque for better results with moiré interferometry by the addition of 0.8 g of white solids applied by painting white Pentel® (Torrance, Calif.) Correction Pen fluid (purchased 1997) on portions of the putty, allowing the fluid to dry, and then blending the painted portions to uniformly disperse the white solids (believed to be primarily titanium dioxide) throughout the putty. This action was repeated approximately a dozen times until a mass increase of 0.8 grams was obtained. The putty was rolled into a flat, smooth 9-cm wide disk, about 0.7 cm thick, which was placed over the woven sculpted fabric 30. A stiff, clear plastic block with dimensions 22 cm×9 cm×1.3 cm, having a mass of 408 g, was centered over the putty disk and a 3.73 kg brass cylinder of 6.3-cm diameter was placed on the plastic block, also centered over the putty disk, and allowed to reside on the block for 8 seconds to drive the putty into the woven sculpted fabric 30. After 8 seconds, the brass cylinder and plastic block were removed, and the putty was gently lifted from the woven sculpted fabric 30. The molded side of the putty was turned face up and placed under a 35-mm field-of-view optical head of the CADEYES® device for measurement.

In the height map 80 in FIG. 10, the horizontal bands of dark and light areas correspond to elevated and depressed regions. In a first background region 38', there are first elevated regions 40' and first depressed regions 42' created by molding against the first depressed regions 42 and the first elevated regions 40, respectively, in a first background region 38 of a woven sculpted fabric 30 (not shown). In a second background region 50', there are second elevated regions 52' and second depressed regions 54' corresponding to the second depressed regions 52 and the second elevated regions 54 in a second background region 50 of a woven sculpted fabric 30 (not shown). Between the first background region 38' and the second background region 50' is a transition region 62' which is elevated, corresponding to a depressed transition region 62 of a woven sculpted fabric 30 (not shown). The elevated curvilinear decorative elements forming a transition region 62' on the molded surface define a repeating elevated primary pattern 64 in which the repeating unit can be described as a diamond with concave sides. The junctions of the opposing MD strands in the transition region 62 of a woven sculpted fabric 30 (not shown) form pockets or segments of different plane height which visually connect to form curvilinear decorative elements making aesthetically pleasing design highlights in materials molded thereon.

The height map 80 contains some optical noise distorting the image along the left border of the height map 80, and occasional spikes from optical noise in other portions of the image. Nevertheless, the structure of the putty impression is clearly discernible. The profile display 81 below the height map 80 shows the topography in the form of a profile 82 taken along a vertical profile line 87. The topographical features of the profile 82 include peaks and valleys corresponding to first and second elevated regions 40' and 52' (the peaks) and first and second depressed regions 42' and 54' (the valleys), respectively, and the elevated transition regions 62' that form the repeating curvilinear primary pattern 64.

Figure 11:
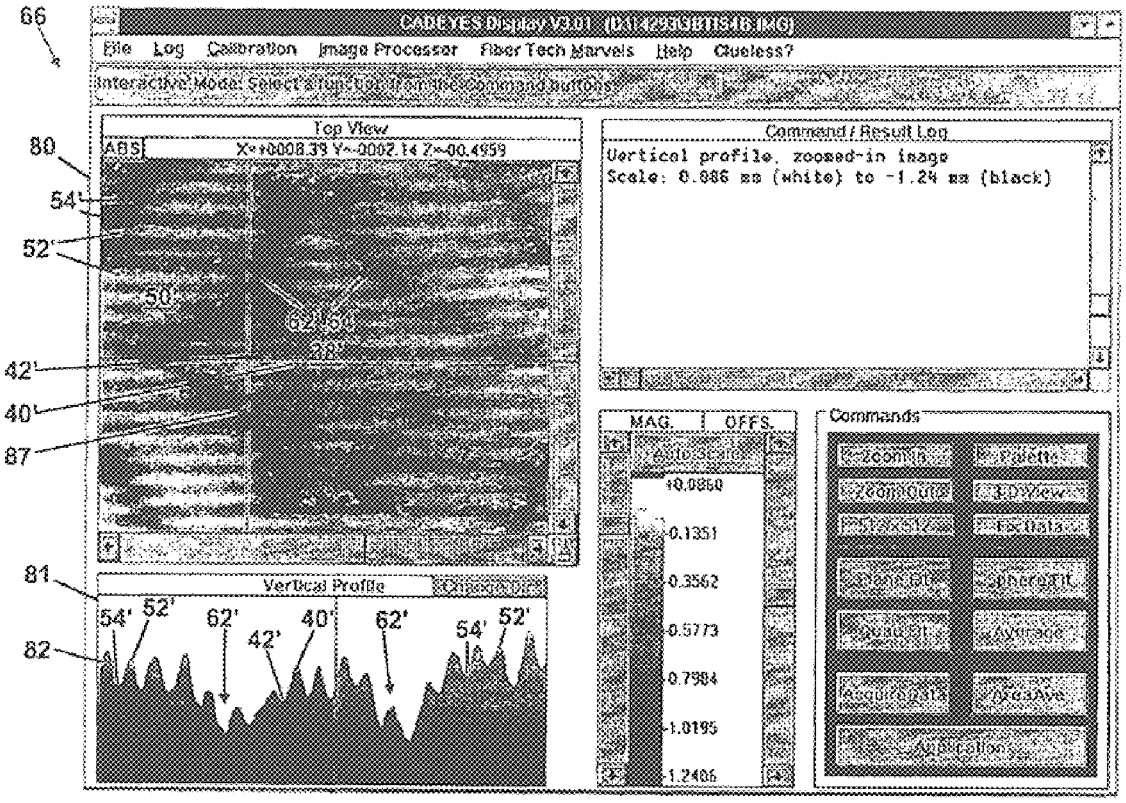
FIG. 11 is a CADEYES display screen shot of dried tissue molded on one embodiment of the fabric of the present invention.

FIG. 11 shows a screen shot 66 of the CADEYES® software main window containing a height map 80 of a dried tissue web 23 molded on a woven sculpted fabric 30, using a process substantially the same as the one described in the Example. The height map 80 is for a zoomed-in region covering a single unit cell of the curvilinear primary pattern 64. The face-up side of the dried tissue web 23—i.e., the surface being measured—is the side that was remote from the woven sculpted fabric 30 during through air drying, termed the "air side" of the dried tissue web 23, as opposed to the opposing "fabric side" (not shown) that was in contact with the woven sculpted fabric 30 during through drying. Here, through drying on the woven sculpted fabric 30 imparted a molded texture that resembles the inverse of the texture in FIG. 10. Thus, in the first background region 38', there are first elevated regions 40' and first depressed regions 42' created by molding of the fabric side of the tissue against first elevated regions 40 and first depressed regions 42, respectively, in a first background region 38 of a woven sculpted fabric 30 (not shown). In the second background region 50', there are second elevated regions 52' and second depressed regions 54' corresponding to second elevated regions 52 and second depressed regions 54 in a second background region 50 of a woven sculpted fabric 30 (not shown). Between the first background region 38' and the second background region 50' is a transition region 62' which is depressed on the side of the dried tissue web 23 measured (the air side), but elevated on the opposing side (the fabric side), corresponding to a depressed transition region 62 of a woven sculpted fabric 30 (not shown). The depressed curvilinear decorative elements forming the transition region 62' on the molded surface of the dried tissue web 23 define a repeating elevated primary pattern 64 in which the repeating unit can be described as a diamond with concave sides. The junctions of the opposing MD strands in the transition region 62 of a woven sculpted fabric 30 (not shown) form pockets or segments of different plane height which visually connect to form curvilinear decorative elements making aesthetically pleasing design highlights in materials molded thereon. Thus, the depressed transition regions 62' form a repeating curvilinear primary pattern 64.

The profile 82 along a vertical profile line 87 on the height map 80 is shown in the profile display 81 below the height map 80, in which two depressed transition regions 62' can be seen in the midst of the otherwise regular peaks and valleys, wherein the peaks correspond to first and second elevated regions 40' and 52', respectively, and the valleys correspond to first and second depressed regions 42' and 54', respectively.

Figure 12:
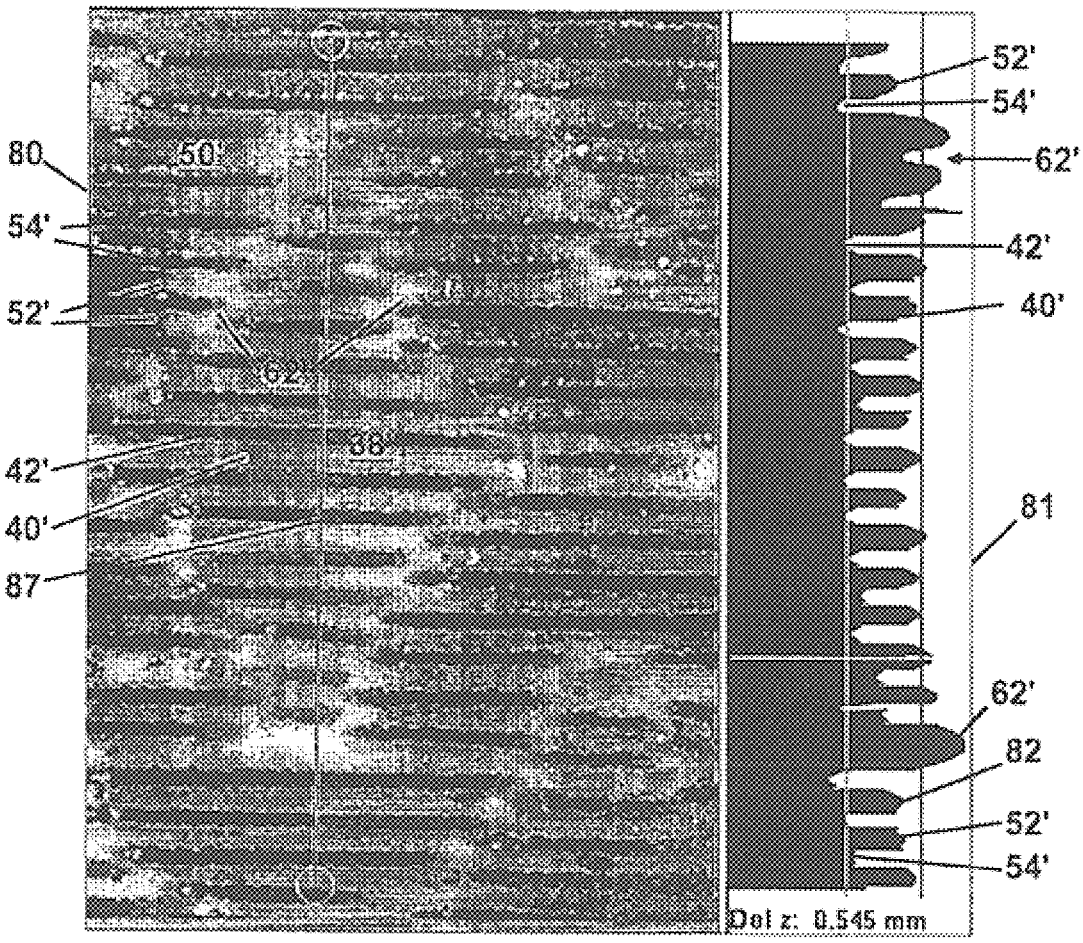
FIG. 12 is a CADEYES display screen shot of dried tissue molded on one embodiment of the fabric of the present invention.

FIG. 12 depicts a section of the height map 80 of FIG. 10 further displaying a profile 82 along a vertical profile line 87 on the height map 80. The profile 82 shown in a vertically oriented profile display 81 comprises peaks and valleys, wherein the peaks correspond to first and second elevated regions 40' and 52', respectively, and the valleys correspond to first and second depressed regions 42' and 54', respectively, with transition regions 62' also visible as relatively elevated features. A characteristic height of the peaks away from the transition regions 62' is about 0.54 mm, while the transition regions 62' display higher and broader peaks, with heights of about 0.75 mm.

Figure 13:
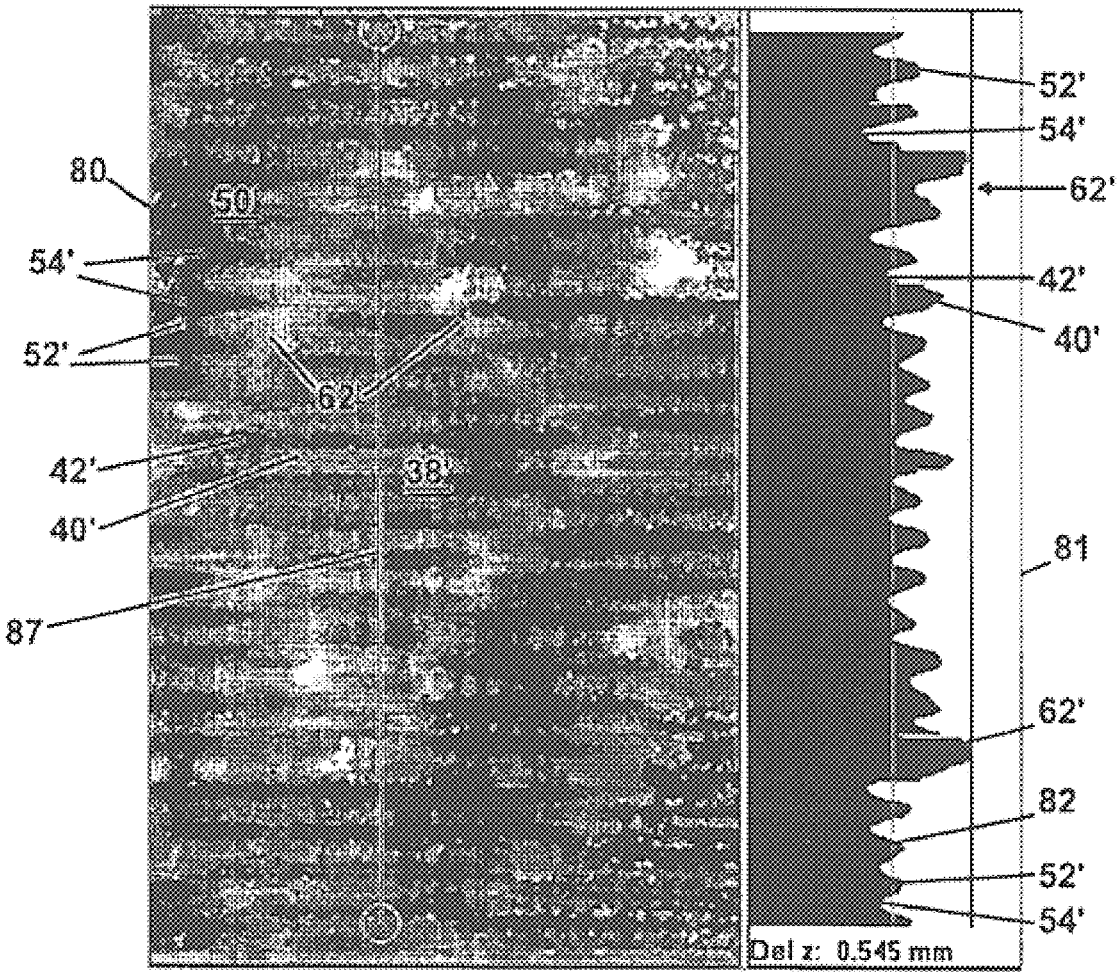
FIG. 13 is a CADEYES display screen shot of dried tissue molded on one embodiment of the fabric of the present invention.

FIG. 13 shows a section of a height map 80 for the dried tissue web 23 throughdried on the woven sculpted fabric 30 used in FIG. 10, but with the sculpted fabric face up of the dried tissue web 23 (the side that was in contact with the woven sculpted fabric 30 during through drying). The profile display 81 shows a profile 82 measured along the vertical profile line 87 drawn across the height map 80 corresponding to the cross-machine direction of the tissue web 23. The profile 82 has peaks corresponding to first and second elevated regions 40' and 52', respectively, and the valleys corresponding to first and second depressed regions 42' and 54', respectively, with transition regions 62' also visible as relatively elevated features. The profile 82 shows that the broad peaks in the transition region 62' have a greater height than the peaks away from the transition region 62'. Relative to the valleys (the first depressed regions 42') in the first background region 38, the peaks of the transition region 62' show a height of about 0.55 mm. In the first background region 38', the peaks (the first elevated regions 40') have about half the height of the transition region 62' (e.g., a height of about 0.25 mm).

Figure 14:
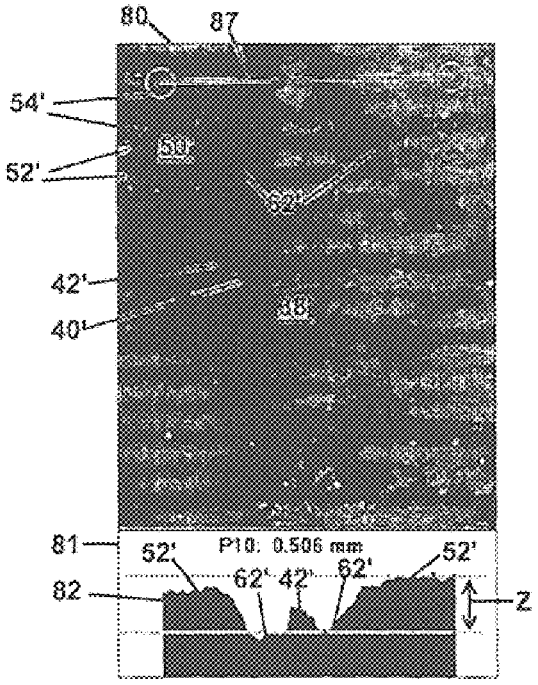
FIG. 14 is a CADEYES display screen shot of dried tissue molded on one embodiment of the fabric of the present invention.

FIG. 14 shows a portion of the height map 80 of FIG. 11 with an accompanying profile display 81 showing a profile 82 taken along the horizontal (machine direction) profile line 87 drawn on the height map 80. The profile 82 extends along the second elevated regions 52' outside of the first background region 38' and along the first depressed region 42' within the first background region 38'. A height difference Z of about 0.5 mm is spanned from the higher portion of the second elevated region 52' to the depressed transition region 62'.

Figure 15:
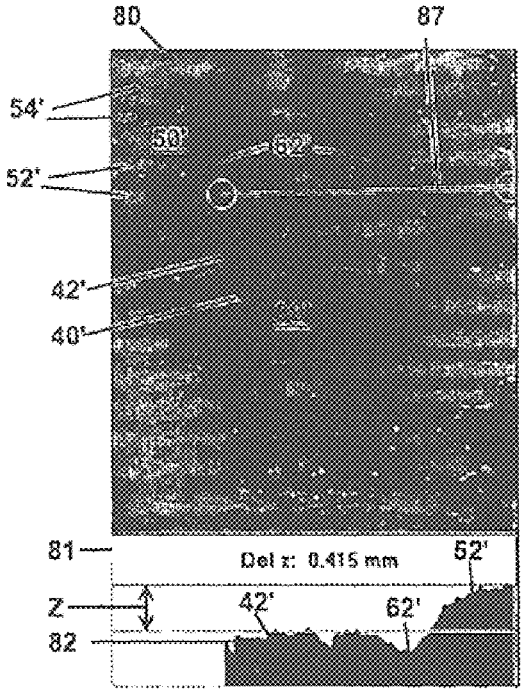
FIG. 15 is a CADEYES display screen shot of dried tissue molded on one embodiment of the fabric of the present invention.

FIG. 15 is similar to FIG. 14 except that a different profile line 87 is used, resulting in a different displayed profile 82 in the profile display 81. The profile line 87 runs substantially in the machine direction, passing along a first depressed region 42' in the first background region 38', then passing through a transition region 62' and then along a second elevated region 52' in the second background region 50'. A vertical height difference Z of about 0.42 mm is spanned from the second elevated region 52' to the first depressed region 42'. The transition region 62 is about 0.2 mm lower than the first depressed region 42' on this view of the fabric side of a molded dried tissue web 23 that has been throughdried on a woven sculpted fabric 30 according to the present invention.

Figure 16:
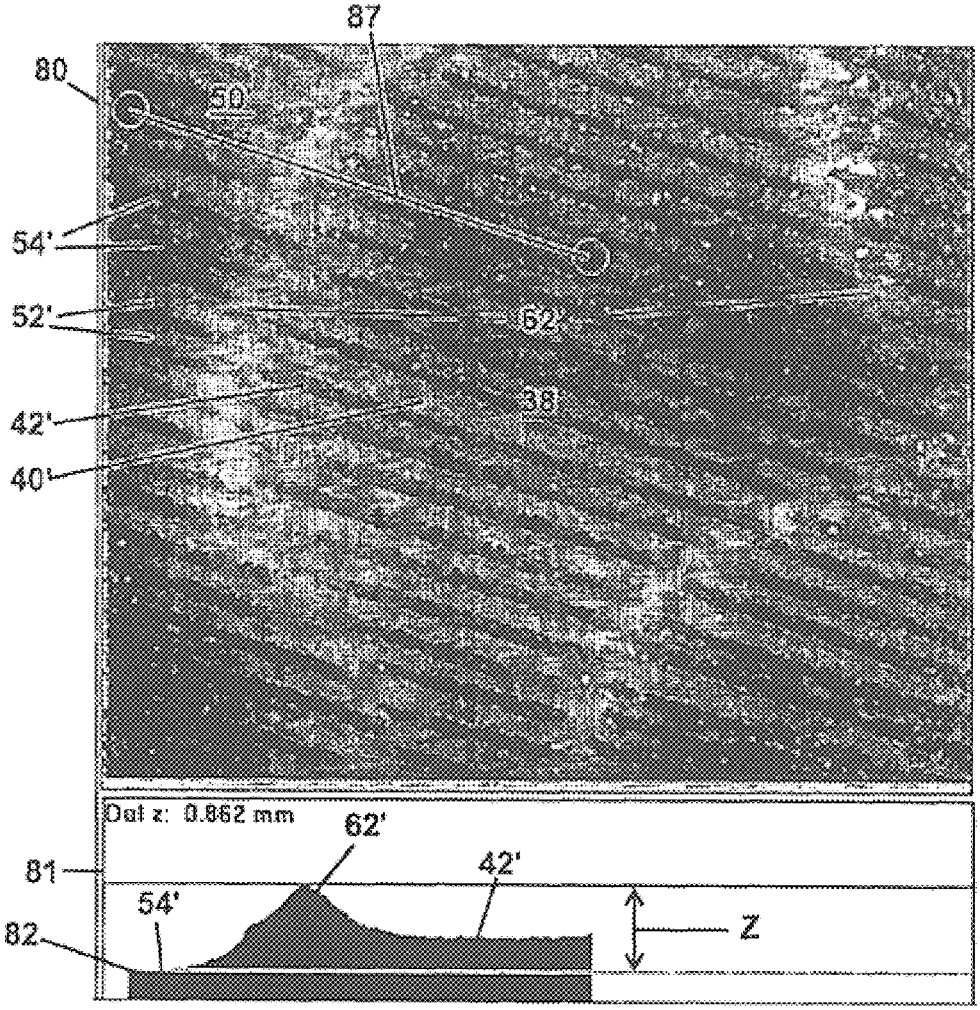
FIG. 16 is a CADEYES display screen shot of a putty impression of one embodiment of the fabric of the present invention.

FIG. 16 shows a height map 80 of a putty impression of another woven sculpted fabric 30 made in accordance to the present invention, with a profile display 81 showing a profile 82 measured along a profile line 87 that spans a first background region 38' and a second background region 50' with a transition region 62' therebetween. Based on the profile 82, the transition region 62' differs from the first elevated region 40' by over than 0.4 mm, and differs from the second depressed region 54' by over 0.8 mm (the height Z). Here the transition region 62' forms a curvilinear decorative element with arcuate sides that entirely bound a closed area, though a portion of the closed area is not shown. Such closed areas can have a maximum diameter (maximum length of a line that can fit within the closed boundary while in the plane of the woven sculpted fabric 30) of any of the following: 5 mm or greater; 10 mm or greater; 25 mm or greater; 50 mm or greater; and, 180 mm or greater, with an exemplary range of from about 8 mm to about 75 mm.

Figure 17:
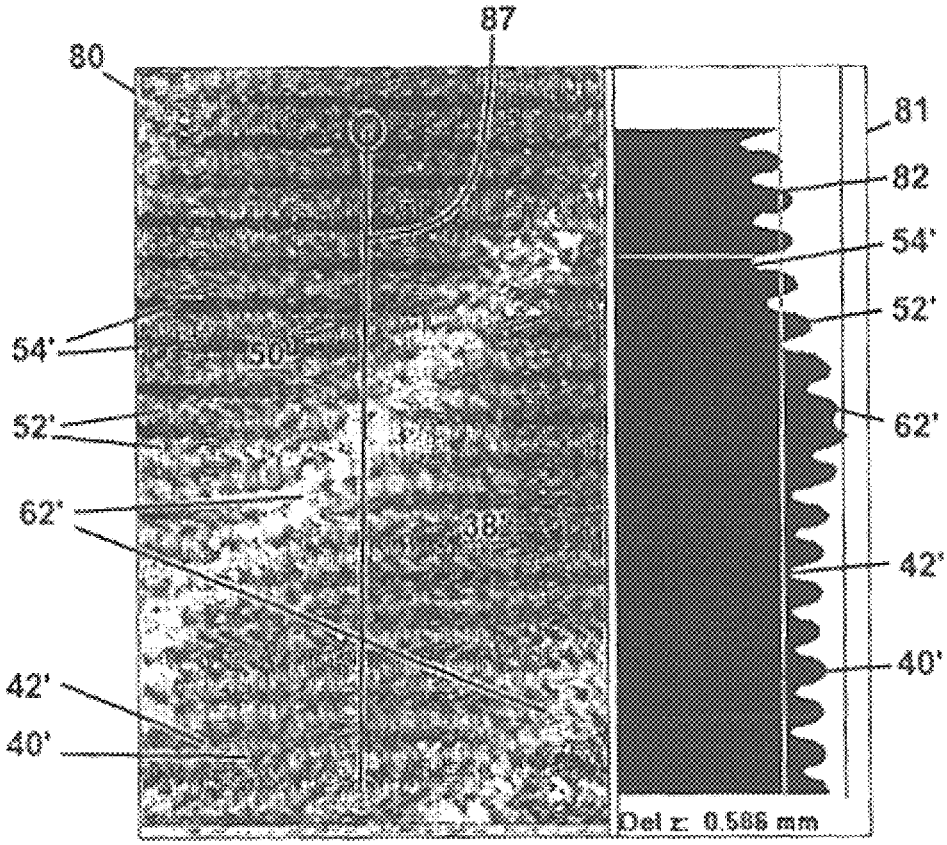
FIG. 17 is a CADEYES display screen shot of a putty impression of one embodiment of the fabric of the present invention.

FIG. 17 shows a height map 80 of a putty impression of yet another woven sculpted fabric 30 made in accordance to the present invention, wherein the transition regions 62' form parallel lines at an angle relative to the substantially unidirectional warps 44 of the woven sculpted fabric 30. In the profile display 81, a profile 82 is shown corresponding to the surface height along the profile line 87 is substantially oriented in the cross-machine direction. The profile line 87 passes over second elevated regions 52' and second depressed regions 54' in the second background region 50', then passes across a transition region 62' and then over first elevated regions 40' and second depressed regions 42'. Here each transition region 62' is substantially straight and forms a long line parallel to other transition regions 62'. In general, when a transition region 62' defines a line, the line can be at any angle to the machine direction (direction of the warps 44), such as an absolute angle of 20 degrees or more, more specifically from about 20 degrees to less than 90 degrees, most specifically from about 30 degree to about 65 degrees. The height difference Z between the most elevated portion of the transition region 62' along the profile 82 and the first depressed region of the first background region 38 is about 0.6 mm.

Figure 18:
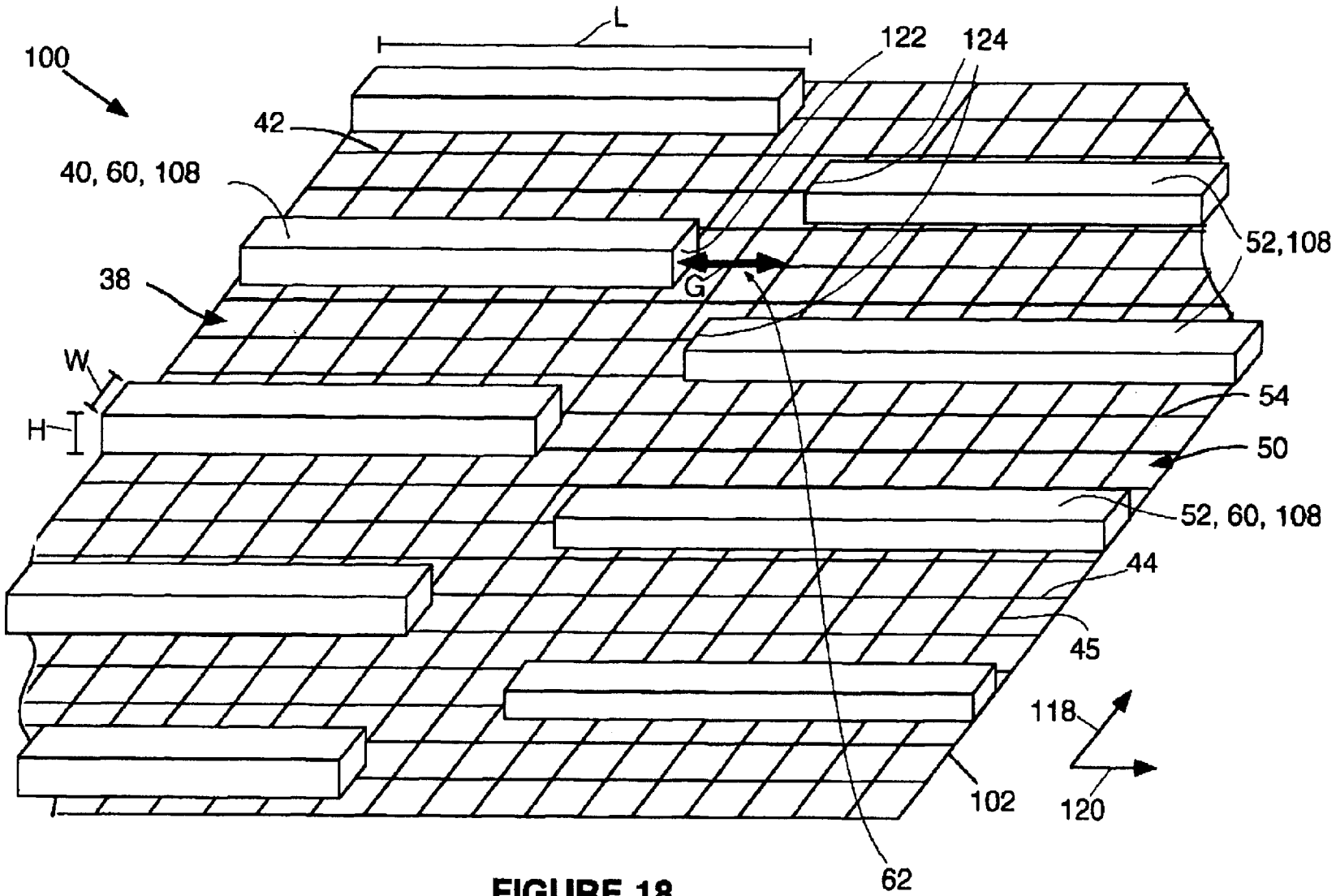
FIG. 18 is a schematic diagram of one embodiment of the fabric of the present invention.

FIG. 18 shows a schematic of a composite sculpted fabric 100 comprising a base 102 with nonwoven raised elements 108 attached thereon. Together, the base 102 and the raised elements 108 form an upper porous member 105 in the composite sculpted fabric 100 which can comprise additional layers (not shown) beneath the base 102. As discussed hereafter, the sculpted fabric 100 need not be composite, but can be formed from a single material, though composite materials such as nonwoven elements joined to a woven fabric can be useful in providing strength or other properties in some embodiments. When used as a throughdrying fabric, the sculpted fabric 100 (like other fabrics of the present invention intended for use in throughdrying) generally should be permeable enough to permit through drying under a gas pressure differential. For example, the porous upper member 105 or the entire sculpted fabric 100 can have a Frazier air permeability of about 250 standard cubic feet per square foot per minute (about 76 standard cubic meters per square meter per minute) or higher. When used as an imprinting fabric or other non-throughdrying fabric, the sculpted fabric 100 can, in some embodiments, have a lower permeability, such as a Frazier air permeability of about 150 standard cubic feet per square foot per minute (about 46 standard cubic meters per square meter per minute) or less.

The raised elements 108 as shown are aligned substantially in the machine direction 120 (orthogonal to the cross-machine direction 118) in the portion of the composite sculpted fabric 100 shown, though the raised elements 108 could be oriented in any direction and could be oriented in a plurality of directions. All embodiments shown herein for raised elements 108 oriented primarily in the machine direction can be adapted equally well to raised elements 108 oriented in the cross-machine direction, for example, or for multiple textured regions having raised elements 108 oriented in a variety of directions. The raised elements 108 as depicted have a height H (relative to the base 102), a length L, and a width W. The height H can be greater than about 0.1 mm, such as from about 0.2 mm to about 5 mm, more specifically from about 0.3 mm to about 1.5 mm, and most specifically from about 0.3 mm to about 0.7 mm. The length L can be greater than 2 mm, such as about 3 mm or greater, or from about 4 mm to about 25 mm. The width W can be greater than about 0.1 mm such as from about 0.2 mm to about 2 mm, more specifically from about 0.3 mm to about 1 mm.

In a first background region 38, the machine-direction oriented, elongated raised elements 108 act as floats 60 that serve as first elevated regions 40, with first depressed regions 42 therebetween that reside substantially on the underlying base 102, which can be a woven fabric. In a second background region 50, the raised elements 108 act as floats 60 that serve as second elevated regions 52, with second depressed regions 54 therebetween that reside substantially on the underlying base 102.

A transition region 62 is formed when a first elevated region 40 from a first background region 38 of the composite sculpted fabric 100 has an end 122 in the vicinity of the beginning 124 of two adjacent second elevated regions 52 in a second background region 50 of the composite sculpted fabric 100, with the end 122 disposed in the cross-machine direction 118 at a position intermediate to the respective cross-machine direction locations of the two adjacent second elevated regions 52, wherein the end 122 of raised elements 108 (either a first elevated region 40 or second elevated region 52) refers to the termination of the raised element 108 encountered while moving along the composite sculpted fabric 100 in the machine direction 120, and the beginning 124 of a raised element 108 refers to the initial portion of the raised element 108 encountered while moving along the composite sculpted fabric 100 in the same direction. Were the raised elements 108 oriented in another direction, the direction of orientation for each raised element 108 is the direction one moves along in identifying ends 122 and beginnings 124 of raised elements 108 in order to identify their relationship in a consistent manner. Generally, features of the raised elements 108 can be successfully identified when either of the two possible directions (forward and reverse, for example) along the raised element 108 is defined as the positive direction for travel.

The transition region 62 separates the first and second background regions 38 and 50. The shifting of the cross-machine directional locations of the raised elements 108 in the transition region 62 creates a break in the patterns of the first and second background regions 38 and 50, contributing to the visual distinctiveness of the portion of the wet tissue web 15 molded against the transition region 62 of the composite sculpted fabric 100 relative to the portion of the wet tissue web 15 molded against the surrounding first and second background regions 38 and 50. In the embodiment shown in FIG. 18, the transition region 62 is also characterized by a gap width G which is the distance in the machine direction 120 (or, more generally, whatever direction the raised elements 108 are predominantly oriented in) between an end 122 of a raised element 108 in the first background region 38 and the nearest beginning 124 of a raised element 108 in the second background region 50. The gap width G can vary in the transition region 62 or can be substantially constant. For positive gap widths G such as is shown in FIG. 18, G can vary, by way of example, from about 0 to about 20 mm, such as from about 0.5 mm to about 8 mm, or from about 1 mm to about 3 mm.

A base 102 can be a woven or nonwoven fabric, or a composite of woven and nonwoven elements or layers. The base 102 generally serves to hold the raised elements 108 in place, and can provide strength and integrity to the entire composite sculpted fabric 100, which can comprise additional layers (not shown) such as load-bearing layers beneath the base 102. The base 102 can also be made from the same material as the raised elements 108, and may be unitary with the raised elements 108, providing a unitary upper porous member 105, in contrast to the integral composite upper porous member 105 shown in FIG. 18, where raised elements 108 have been attached to a separate base 102 rather than being formed therewith or therefrom.

In the case of a unitary upper porous member 105, the upper porous member 105 can be entirely nonwoven, as can be the entire sculpted fabric 100. For example, the upper porous member 105 can be formed from a single, unitary porous web such as a fibrous nonwoven layer of a polymeric material formed by any known process, including materials such as an airlaid web, a spunbond fabric, a meltblown fabric, a bonded carded web, an electrospun fabric, or combinations thereof. The porous web can be sculpted according to the principles of the present invention to impart raised elements 108 above a base 102. Methods of sculpting can include embossing to densify selected regions to form a base 108 serving as a depressed layer unitary with raised elements 108. A variety of operations can transform an initially substantially uniform porous web into a sculpted upper porous member 105 (or sculpted fabric 100) according to the present invention. Such operations can leave the porous web with substantially the same basis weight distribution (i.e., no mass is added or subtracted from the porous web during treatment), as is commonly the case for embossing, stamping, thermal molding, and the like, or the operation can modify the basis weight of the porous web. Operations that modify the basis weight of the porous web include mechanical drilling, laser drilling, adding molten resin that is subsequently cured to from raised elements 108 (the resin can be substantially the same material as the base 102 and if properly bonded, can become substantially unitary with the base 102), and the like. A porous web can be molded by any means (cast molding, thermal molding, etc.) initially or after initial formation into a unitary sculpted upper porous member 105.

The embodiment of the base 102 depicted in FIG. 18 is a woven base fabric, with the shutes 45 extending in the cross-machine direction 118 and the warps 44 in the machine direction 120. The base 102 can be woven according to any pattern known in the art and can comprise any materials known in the art. As with any woven strands for any fabrics of the present invention, the strands need not be circular in cross-section but can be elliptical, flattened, rectangular, cabled, oval, semi-oval, rectangular with rounded edges, trapezoidal, parallelograms, bi-lobal, multi-lobal, or can have capillary channels. The cross sectional shapes may vary along a raised element 108; multiple raised elements with differing cross sectional shapes may be used on the composite sculpted fabric 100 as desired. Hollow filaments can also be used.

The raised elements 108 can be integral with the base 102. For example, a composite sculpted fabric 100 can be formed by photocuring of elevated resinous elements which encompass portions of the warps 44 and shutes 45 of the base 102. Photocuring methods can include UV curing, visible light curing, electron beam curing, gamma radiation curing, radiofrequency curing, microwave curing, infrared curing, or other known curing methods involving application of radiation to cure a resin. Curing can also occur via chemical reaction without the need for added radiation as in the curing of an epoxy resin, extrusion of an autocuring polymer such as polyurethane mixture, thermal curing, solidifying of an applied hotmelt or molten thermoplastic, sintering of a powder in place on a fabric, and application of material to the base 102 in a pattern by known rapid prototyping methods or methods of sculpting a fabric. Photocured resin and other polymeric forms of the raised elements 108 can be attached to a base 102 according to the methods in any of the following patents: U.S. Pat. No. 5,679,222, issued on Oct. 21, 1997 to Rasch et al.; U.S. Pat. No. 4,514,345, issued on Apr. 30, 1985 to Johnson et al.; U.S. Pat. No. 5,334,289, issued on Aug. 2, 1994 to Trokhan et al.; U.S. Pat. No. 4,528,239, issued on Jul. 9, 1985 to Trokhan; U.S. Pat. No. 4,637,859, issued on Jan. 20, 1987 to Trokhan; commonly owned U.S. Pat. No. 6,120,642, issued on Sep. 19, 2000 to Lindsay and Burazin; and, commonly owned patent applications Ser. Nos. 09/705,684 and 09/706,149, both filed on Nov. 3, 2000 by Lindsay et al.; all of which are herein incorporated by reference to the extent they are not contradictory herewith. The raised elements 108 can also be extruded or applied as a foam material to be joined to the base 102. Sintering, adhesive bonding, thermal fusing, or other known methods can be used to attach the raised elements 108 to the base 102, especially in the formation of a composite sculpted fabric 30 having nonwoven elements on the tissue contacting side.

U.S. Pat. No. 6,120,642, issued on Sep. 19, 2000 to Lindsay and Burazin, discloses methods of producing sculpted nonwoven throughdrying fabrics, and such methods can be applied in general to create composite sculpted fabrics 100 of the present invention. In one embodiment, such composite sculpted fabrics 100 comprise an upper porous nonwoven member and an underlying porous member supporting the upper porous member, wherein the upper porous nonwoven member comprises a nonwoven material (e.g., a fibrous nonwoven, an extruded polymeric network, or a foam-based material) that is substantially deformable. More specifically, the can have a High Pressure Compressive Compliance (hereinafter defined) greater than 0.05, more specifically greater than 0.1, and wherein the permeability of the wet molding substrate is sufficient to permit an air pressure differential across the wet molding substrate to effectively mold said web onto said upper porous nonwoven member to impart a three-dimensional structure to said web.

As used herein, "High Pressure Compressive Compliance" is a measure of the deformability of a substantially planar sample of the material having a basis weight above 50 gsm compressed by a weighted platen of 3-inches in diameter to impart mechanical loads of 0.2 psi and then 2.0 psi, measuring the thickness of the sample while under such compressive loads. Subtracting the ratio of thickness at 2.0 psi to thickness at 0.2 psi from 1 yields the High Pressure Compressive Compliance. In other word, High Pressure Compressive Compliance=1−(thickness at 2.0 psi/thickness at 0.2 psi). The High Pressure Compressive Compliance can be greater than about 0.05, specifically greater than about 0.15, more specifically greater than about 0.25, still more specifically greater than about 0.35, and most specifically between about 0.1 and about 0.5. In another embodiment, the High Pressure Compressive Compliance can be less than about 0.05, in cases where a less deformable composite sculpted fabric 100 is desired.

Other known methods can be used to created the composite sculpted fabrics 100 of the present invention, including laser drilling of a polymeric web to impart elevated and depressed regions, ablation, extrusion molding or other molding operations to impart a three-dimensional structure to a nonwoven material, stamping, and the like, as disclosed in commonly owned patent applications Ser. Nos. 09/705,684 and 09/706,149, both filed on Nov. 3, 2000 by Lindsay et al.; previously incorporated by reference.

Figure 19:
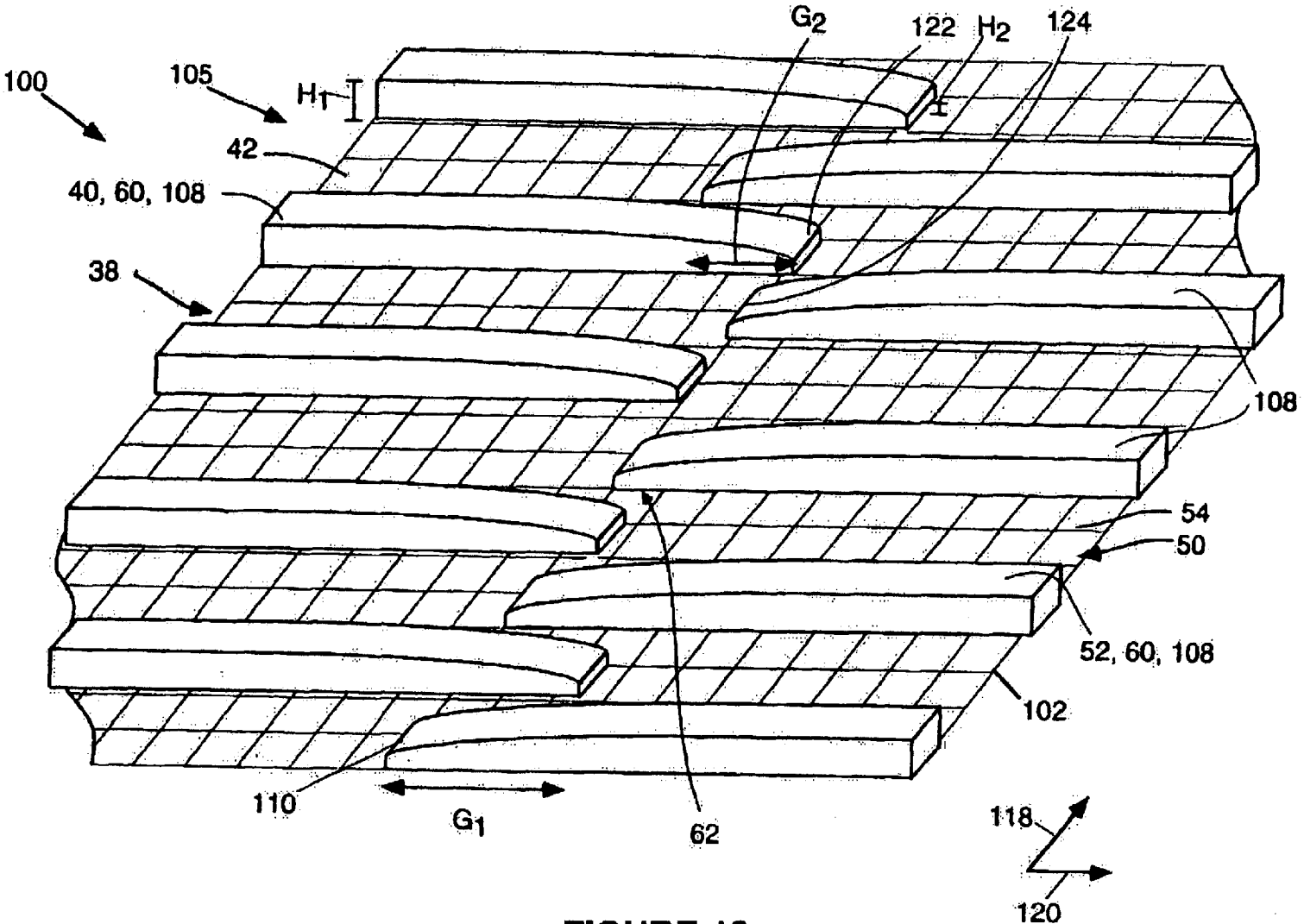
FIG. 19 is a schematic diagram of one embodiment of the fabric of the present invention.

FIG. 19 depicts another embodiment of a composite sculpted fabric 100 comprising a base 102 with raised elements 108 attached thereon, similar to that of FIG. 18 but with raised elements 108 that taper to a low height $H_2$ relative to the minimum height $H_1$ of the raised element 108. $H_1$ can be from about 0.1 mm to about 6 mm, such as from about 0.2 mm to about 5 mm, more specifically from about 0.25 mm to about 3 mm, and most specifically from about 0.5 mm to about 1.5 mm. The ratio of $H_2$ to $H_1$ can be from about 0.01 to about 0.99, such as from about 0.1 to about 0.9, more specifically from about 0.2 to about 0.8, more specifically still from about 0.3 to about 0.7, and most specifically from about 0.3 to about 0.5. The ratio of $H_2$ to $H_1$ can also be less than about 0.7, about 0.5, about 0.4, or about 0.3. Further, the gap width G, the distance between the beginning 124 and ends 122 of nearby raised elements 108 from adjacent first and second background regions 38 and 50, is now negative, meaning that the end 122 of one raised element 108 (a first elevated region 40) in the first background region 38 extends in machine direction 120 past the beginning 124 of the nearest raised element 108 (a second elevated region 52) in the second background region 50 such that raised elements 108 overlap in the transition region 62. Two gap widths G are shown: $G_1$ and $G_2$ at differing locations in the composite sculpted fabric 100. Here the gap width G has nonpositive values, such as from about 0 to about −10 mm, or from about −0.5 mm to about 4 mm, or from about −0.5 mm to about −2 mm. However, a given composite sculpted fabric 100 may have portions of the transition region 62 that have both nonnegative and nonpositive (or positive and negative) values of G.

It is recognized that other topographical elements may be present on the surface of the composite sculpted fabric 100 as long as the ability of the raised elements 108 and the transition region 62 to create a visually distinctive molded wet tissue web 15 is not compromised. For example, the composite sculpted fabric 100 could further comprise a plurality of minor raised elements (not shown) such as ovals or lines having a height less than, for example, about 50% of the minimum height $H_1$ of the raised elements 108.

Figure 20:
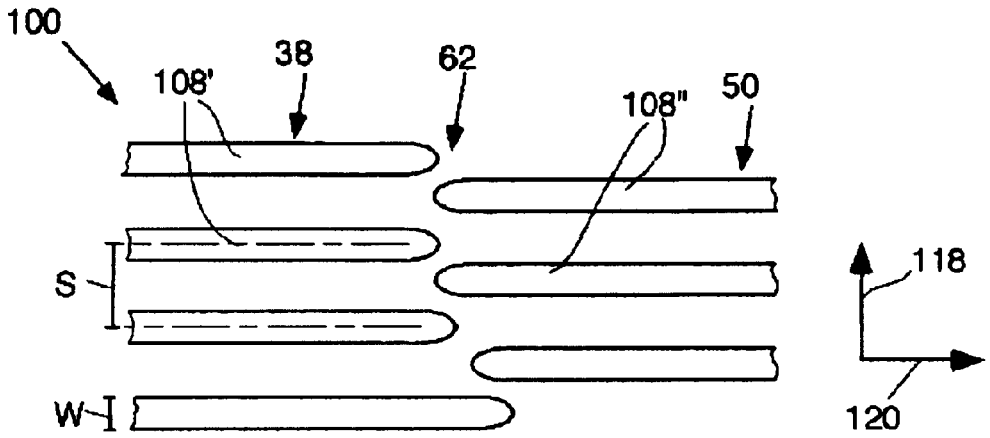
FIG. 20 is a schematic diagram of one embodiment of the fabric of the present invention.
Figure 21:
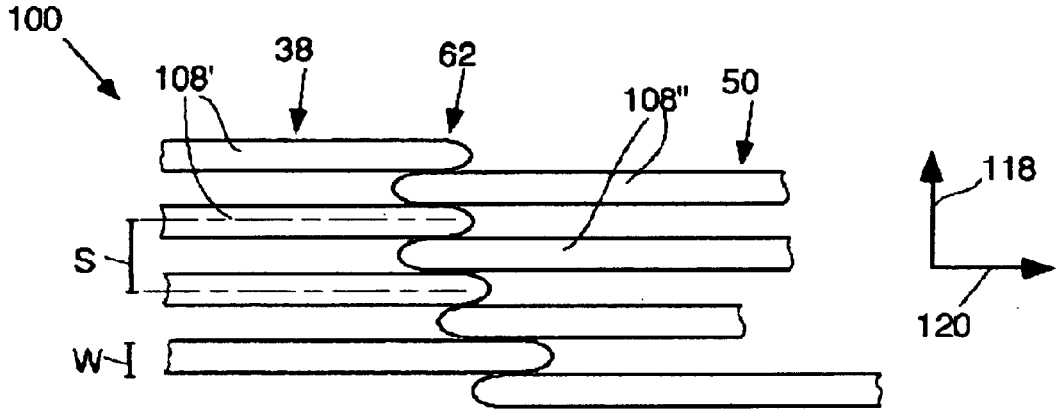
FIG. 21 is a schematic diagram of one embodiment of the fabric of the present invention.
Figure 22:
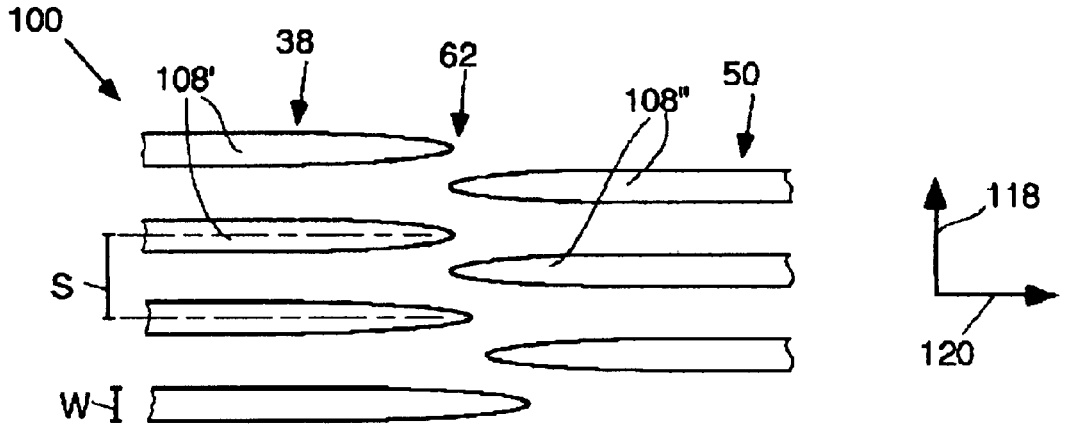
FIG. 22 is a schematic diagram of one embodiment of the fabric of the present invention.

FIGS. 20–22 are schematic diagram views of the raised elements 108 in a composite sculpted fabric 100 depicting alternate forms of the raised elements 108 according to the present invention. In each case, a set of first raised elements 108' in a first background region 38 interacts with a set of second raised elements 108" in a second background region 128 to define a transition region 62 between the first and second background regions 38 and 50, wherein both the discontinuity or shift in the pattern across the transition region 62 as well as an optional change in surface topography along the transition region 62 contribute to a distinctive visual appearance in the wet tissue web 15 molded against the composite sculpted fabric 100, wherein the loci of transition regions 62 define a visible pattern in the molded wet tissue web 15 (not shown). In FIG. 20, the first and second raised elements 108' and 108" overlap slightly and define a nonlinear transition region 62 (i.e., there is a slight curve to it as depicted). Further, parallel, adjacent raised elements 108 in either a first or second background region 38 or 50, are spaced apart in the cross-machine direction 118 by a distance S slightly greater than the width W of a first or second raised element 108' or 108" (e.g., the cross-machine direction spacing from centerline to centerline of the first and second raised elements 108' and 108" divided by the width W of the first and second raised elements 108' and 108" can be greater than about 1, such as from about 1.2 to about 5, or from about 1.3 to about 4, or from about 1.5 to about 3. In FIG. 21, the spacing S is nearly the same as the width W (e.g., the ratio S/W can be less than about 1.2, such as about 1.1 or less or about 1.05 or less). Further, the overlapping first and second raised elements 108' and 108" in the transition region 62 results in a gap width of about −2 W or less (meaning that the ends 122 and beginnings 124 of the first and second raised elements 108' and 108" overlap by a distance of about twice or more the width W of the first and second raised elements 108' and 108"). In FIG. 22, the tapered raised elements 108 are depicted which are otherwise similar to the raised elements 108 as shown in FIG. 20.

It will be recognized that the shapes and dimensions of the raised elements 108 need not be similar throughout the composite sculpted fabric 100, but can differ from any of the first and second background region 38 or 50 to another or even within a first or second background region 38 or 50. Thus, there may be a first background region 38 comprising cured resin first raised elements 108' having a shape and dimensions (W, L, H, and S, for example) different from those of the second raised elements 108" of the second background region 50.

The raised elements 108 need not be straight, as generally depicted in the previous figures, but may be curvilinear.

Figure 23:
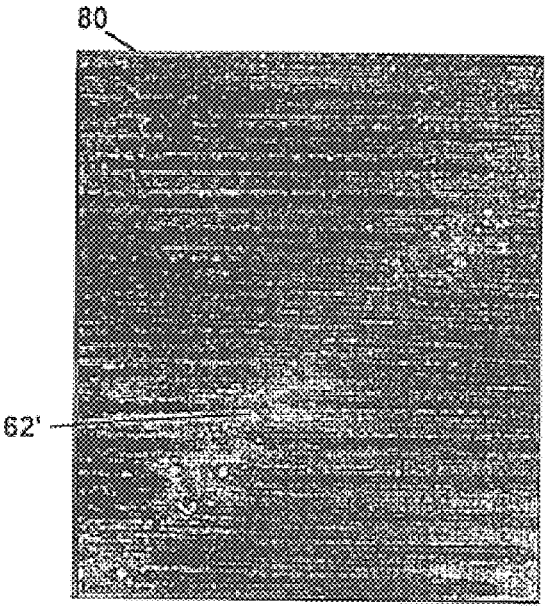
FIG. 23 is a CADEYES display screen shot of a putty impression of one embodiment of the fabric of the present invention.
Figure 24:
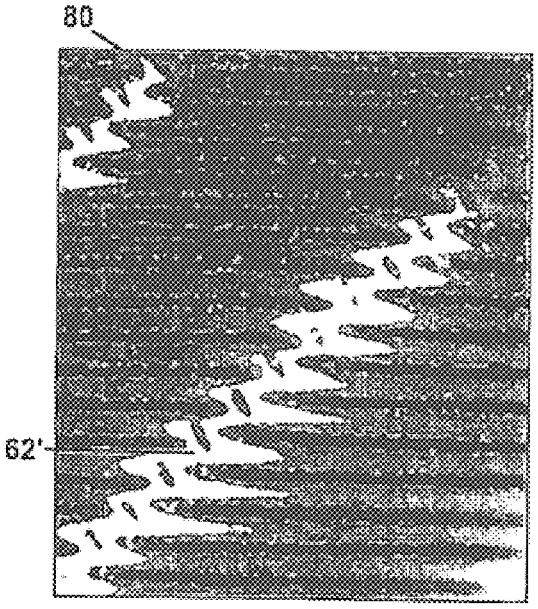
FIG. 24 is a CADEYES display screen shot of a putty impression of one embodiment of the fabric of the present invention.

In FIGS. 23 and 24, a portion of the CADEYES height map 80 referred to in FIG. 17 was used to identify the approximate contour of elevated portions of the transition region 62'. The original portion of the height map 80 is shown in FIG. 23. The modified version is shown in FIG. 24. The modified version was created by importing the original into the PhotoPlus 7® graphics program for the PC by Serif, Inc. (Hudson, N.H.). The image was treated with the "Stretch" command to distribute the color histogram levels more fully across the spectrum. Then the most elevated portion of the transition region 62' in the lower half of the image was selected by clicking with the color selection tool set to a tolerance value of 12. The selected region of the transition region 62' was then filled with white. The same procedure was applied to the transition region 62' in the upper left hand corner of the image. The white portions of the transition region 62' in effect show the shape of the contour encompassing the highest portions of the surface, and correspond roughly to the upper contours that could be imparted to a dried tissue web 23. The elevated contours have a generally sinuous shape, with depresses islands corresponding to the floats 60 or knuckles of the woven sculpted fabric 30.

Figure 25:
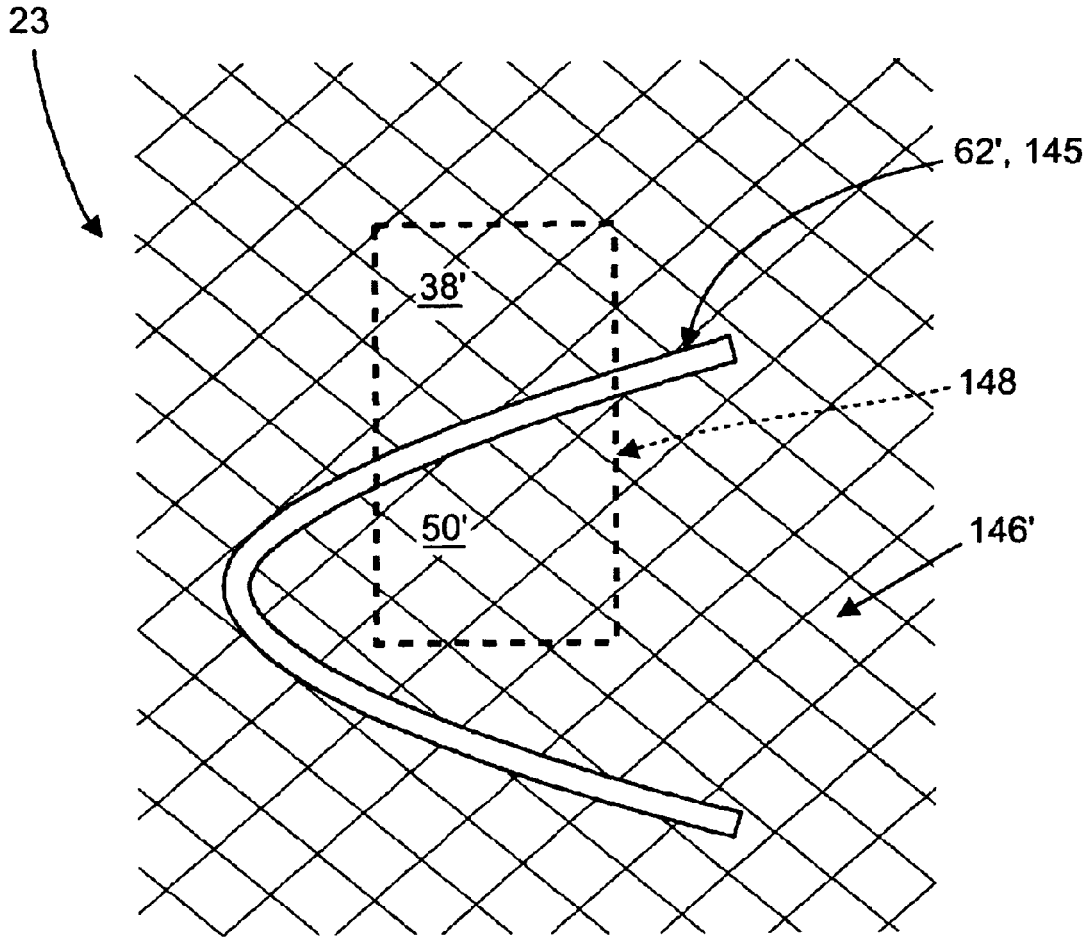
FIG. 25 is a schematic diagram of one embodiment of the fabric of the present invention.

FIG. 25 depicts a portion of a dried tissue web 23 having a continuous background texture 146 depicted as a rectilinear grid, though any pattern or texture could be used. The dried tissue web 23 further comprises a raised transition region 62' which has a visually distinctive primary pattern 145. In a local region 148 of the dried tissue web 23 that spans both sides of a portion of the transition region 62', two portions the background texture 146 define, at a local level, a first background region 38' and a second background region 50' separated by a transition region 62' in the dried tissue web 23. Thus, the first background region 38' and the second background region 50', though separated by the transition region 62', are nevertheless contiguous outside the local region 148 of the dried tissue web 23. In other embodiments, the transition region 62' can define enclosed first and second background regions 38' and 50', respectively, that are contiguous outside of a local region 148 or fully separated first and second background regions 38' and 50', respectively, that are not contiguous.

Figure 26:
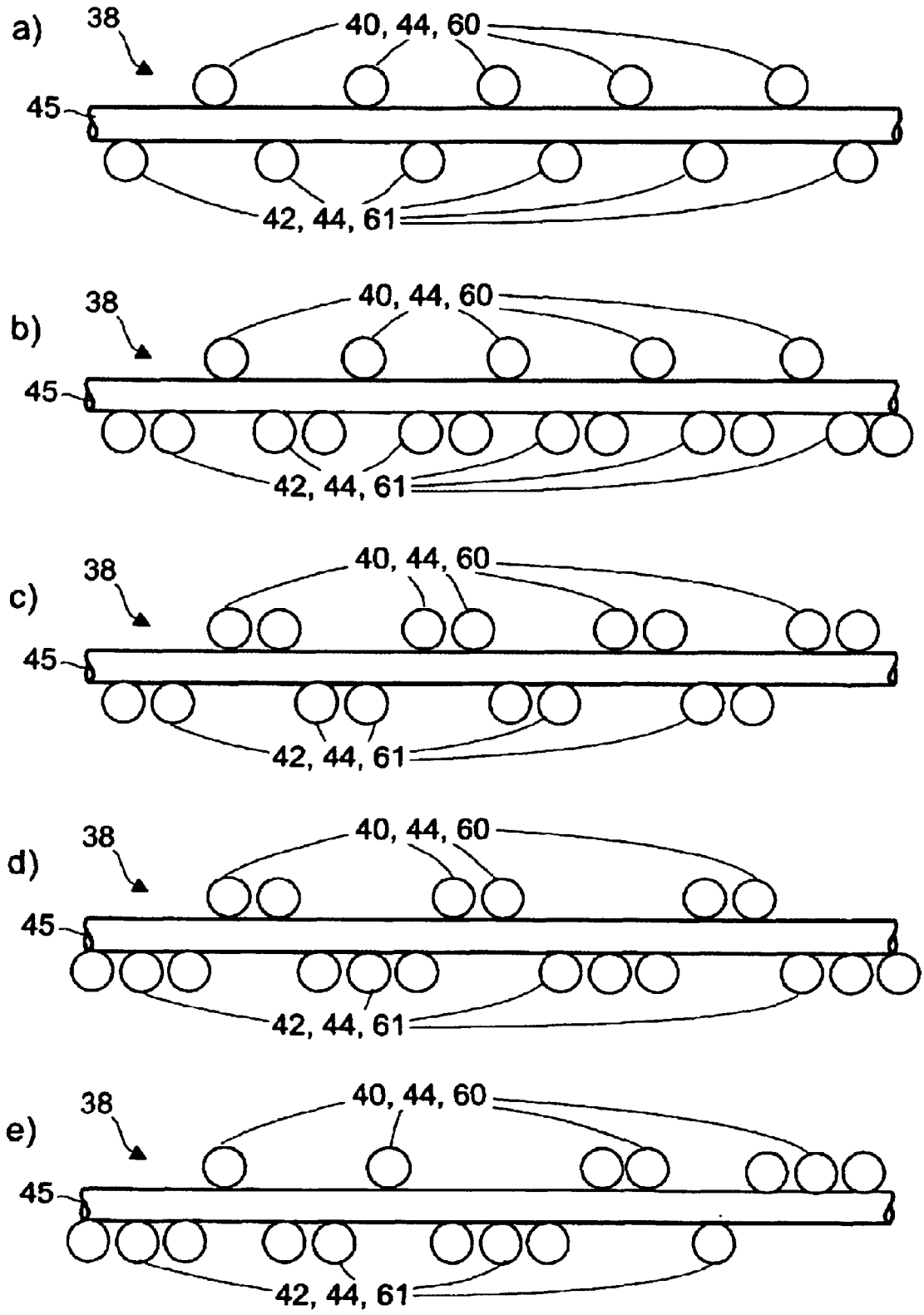
FIG. 26A is a schematic diagram of one embodiment of the fabric of the present invention.
FIG. 26B is a schematic diagram of one embodiment of the fabric of the present invention.
FIG. 26C is a schematic diagram of one embodiment of the fabric of the present invention.
FIG. 26D is a schematic diagram of one embodiment of the fabric of the present invention.
FIG. 26E is a schematic diagram of one embodiment of the fabric of the present invention.

FIGS. 26*a*–26*e* show other embodiments for the arrangement of the warps 44 in the first background region 38 of a woven sculpted fabric 30 (though the embodiment shown could equally well be applied to a second background region 50), taken in cross-sectional views looking into the machine direction. FIG. 26*a* shows an embodiment related to those of FIGS. 1*a*, 1*b*, and 2, wherein each single float 60 is separated from the next single float 60 by a single sinker 61. However, single strands are not the only way to form the first elevated regions 40 (which could equally well be depicted as second elevated regions 52) or the first depressed regions 42 (which could equally well be depicted as second depressed regions 54). Rather, FIGS. 26*b*–26*e* show embodiments in which at least one of the first elevated regions 40 or first depressed regions 42 comprises more than one warp 44. FIG. 26*b* shows single spaced apart single strand floats 60 forming the first elevated regions 40, interspaced (with respect to a view from above the shute 45) by double-strand sinkers 61 (or, equivalently, pairs of adjacent single-strand sinkers 61) which define first depressed regions 42 between each first elevated region 40. In FIG. 26*c*, the first elevated regions 40 each comprise pairs of warps 44, while the interspaced first depressed regions 42 likewise comprise pairs of warps 44 forming double-strand sinkers 61. In FIG. 26*d*, double-strand first elevated regions 40 are interspaced by triple-strand first depressed regions 42. In FIG. 26*e*, the single-, double-, and triple-strand groups form both the first elevated regions 40 and the first depressed regions 42. Many other combinations are possible within the scope of the present invention. Thus, any machine-direction oriented elevated or depressed region in a woven sculpted fabric 30 can comprise a group of any practical number of warps 44, such as any number from 1 to 10, and more specifically from 1 to 5. Such groups can comprise parallel monofilament strands or multifilament strands such as cabled filaments.

The Product

Figure 28:
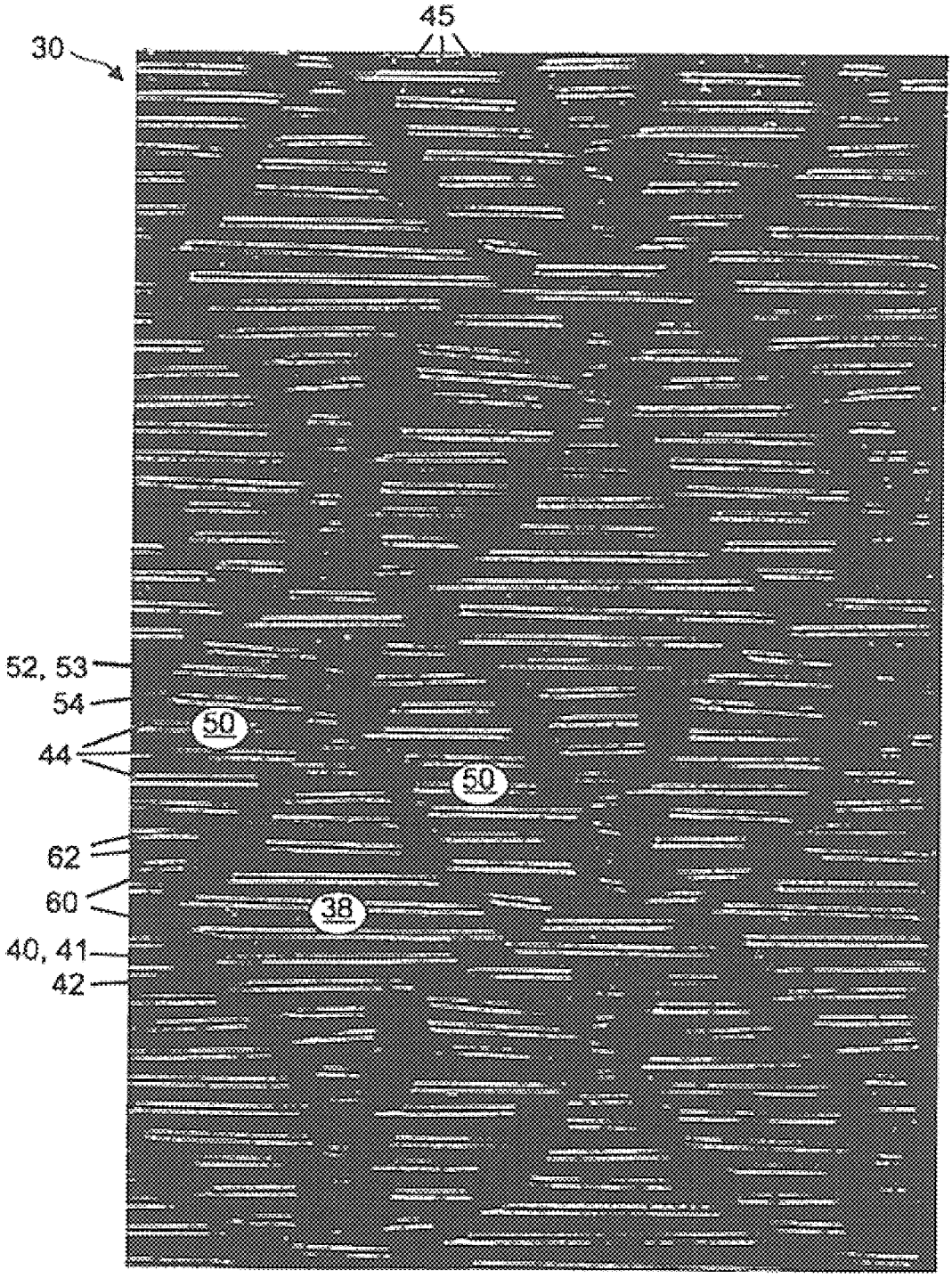
FIG. 28 is a photograph of one embodiment of the fabric of the present invention.

FIG. 28 is a photograph of a woven sculpted fabric 30 embodiment of the present invention. The decorative pattern repeats in a rectangular unit cell which is about 33 mm MD by 38 mm CD in size. The width of the floats 60 is about 0.70 mm. The adjacent elevated floats 60 are separated by a distance which averages about 0.89 mm.

In the woven sculpted fabric 30 shown in FIG. 28, the plane difference varies in the MD and CD throughout the fabric unit cell. For a given float 60, the plane difference tends to be minimal near transition regions 62 and maximal half way between two transition regions 62 in the MD. In general, plane difference is larger for a long sinker 61 between two long floats 60 than a short sinker 61 between two short floats 60. This variation in plane difference contributes to the aesthetics of the overall decorative pattern.

In the woven sculpted fabric 30 shown in FIG. 28, the separation distance between adjacent elevated floats 60 varies in the MD and CD throughout the fabric unit cell. This variation in separation distance between adjacent elevated floats 60 contributes to the aesthetics of the overall decorative pattern.

Figure 29:
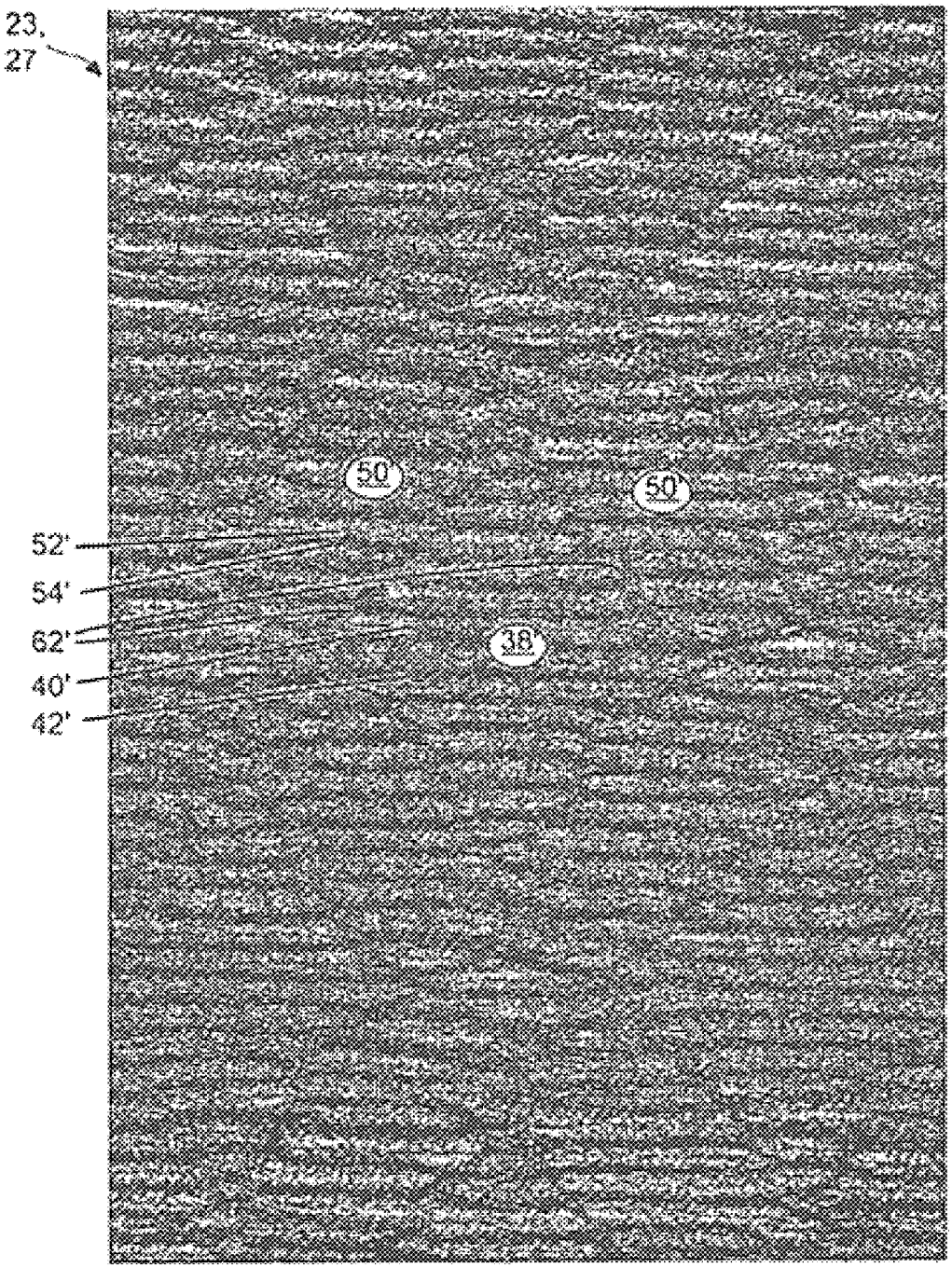
FIG. 29 is a photograph of the air side of a dried tissue web made using one embodiment of the fabric of the present invention.
Figure 30:
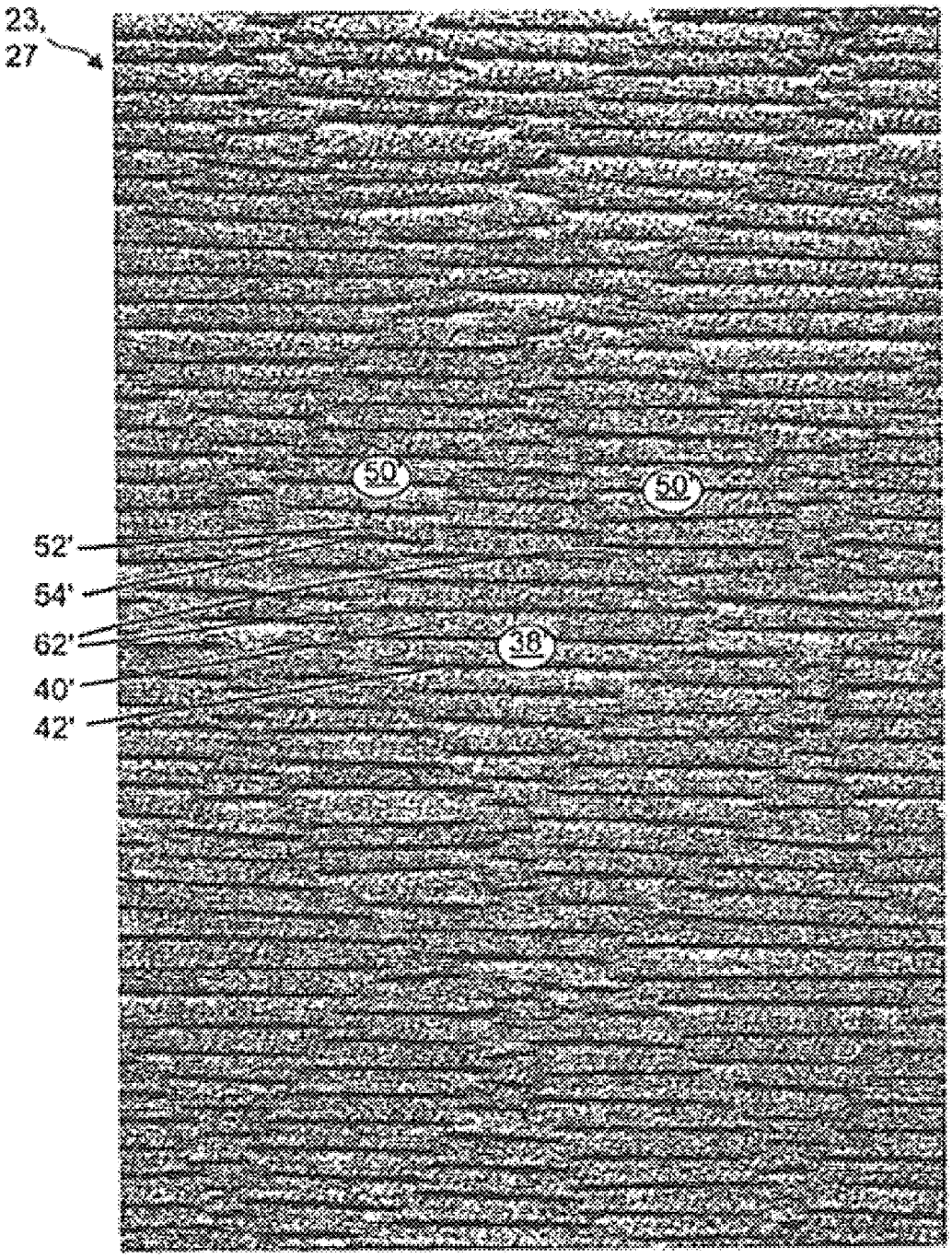
FIG. 30 is a photograph of the fabric side of a dried tissue web made using one embodiment of the fabric of the present invention.

FIGS. 29 and 30 shows the air side and the fabric side an absorbent tissue product 27 made in accordance with the present invention as described herein in the Example, depicting an interlocking circular primary pattern 64 made from the distinctive background textures 39 and 51 and curvilinear decorative elements on the dried tissue web 23 by a plurality of transition areas 62 of throughdrying fabric 19. The distinctive background textures 39 and 51 and curvilinear decorative elements, in addition to providing valuable consumer preferred aesthetics, also unexpectedly improve physical attributes of the absorbent tissue product 27. The distinctive background textures 39 and 51 and curvilinear decorative elements in the dried tissue web 23 produced by the transition areas 62 form multi-axial hinges improving drape and flexibility of the finished absorbent tissue product 27. In addition, the distinctive background textures 39 and 51 and curvilinear decorative elements are resistant to tear propagation improving tensile strength and machine runnability of the dried tissue web 23.

In yet another advantage, the increased uniformity in spacing of the raised MD floats 60 possible with the present invention, while still producing distinctive background textures 39 and 51 and curvilinear line primary patterns 64, maintains higher levels of caliper and CD stretch compared to decorative webs produced by the fabrics disclosed in U.S. Pat. No. 5,429,686. The possibility of optimizing the uniformity and spacing of the raised MD floats 60 in the CD direction, without regard to spacing considerations in order to form the distinctive background textures 39 and 51 and curvilinear decorative elements in the dried tissue web 23, is a significant advantage within the art of papermaking. The present invention allows for improved uniformity of the raised MD floats 60 in the CD direction, and the flexibility to form a multitude of complex distinctive background textures 39 and 51 and curvilinear decorative elements in the dried tissue web 23 within a single processing step.

EXAMPLE

In order to further illustrate the absorbent tissue products of the present invention, an uncreped throughdried tissue product was produced using the method substantially as illustrated in FIG. 27. More specifically, a blended single-ply towel basesheet was made in which the fiber furnish comprised about 53% bleached recycled fiber (100% post consumer content), about 31% bleached northern softwood Kraft fiber, and about 16% bleached southern softwood Kraft fiber.

The fiber was pulped for 30 minutes at about 4–5 percent consistency and diluted to about 2.7 percent consistency after pulping. Kymene 557LX (commercially available from Hercules in Wilmington, Del.) was added to the fiber at about 9 kilograms per tonne of pulp.

The headbox net slice opening was about 23 millimeters. The consistency of the stock fed to the headbox was about 0.26 weight percent.

The resulting wet tissue web 15 (shown in FIG. 27) was formed on a c-wrap twin-wire, suction form roll, former with outer forming fabric 12 and inner forming fabric 13 being Voith Fabrics 2164-A33 fabrics (commercially available from Voith Fabrics in Raleigh, N.C.). The speed of the forming fabrics was about 6.9 meters per second. The newly-formed wet tissue web 15 was then dewatered to a consistency of about 22–24 percent using vacuum suction from below inner forming fabric 13 before being transferred to transfer fabric 17, which was traveling at about 6.3 meters per second (10 percent rush transfer). The transfer fabric 17 was a Voith Fabrics 2164-A33 fabric. Vacuum shoe 18 pulling about 420 millimeters of mercury vacuum was used to transfer the wet tissue web 15 to the transfer fabric 17.

The wet tissue web 15 was then transferred to a throughdrying fabric 19 (Voith Fabrics t4803–7, substantially as shown in FIG. 28). The throughdrying fabric 19 was traveling at a speed of about 6.3 meters per second. The wet tissue web 15 was carried over a pair of Honeycomb throughdryers (like the throughdryer 21 and commercially available from Valmet, Inc. (Honeycomb Div.) in Biddeford, Me.) operating at a temperature of about 195 degrees C. and dried to final dryness of at least about 97 percent consistency. The resulting uncreped dried tissue web 23 was then tested for physical properties without conditioning.

The fabric side of the resulting towel basesheet may appear substantially as shown in FIG. 29. The air side of the resulting towel basesheet may appear substantially as shown in FIG. 30.

The resulting dried tissue web 23 had the following properties: Basis Weight, 42 grams per square meter; CD Stretch, 5.5 percent; CD Tensile Strength, 1524 grams per 25.4 millimeters of sample width; Single Sheet Caliper, 0.55 millimeters; MD Stretch, 8.0 percent; MD Tensile Strength, 1765 grams per 25.4 millimeters of sample width; and, an wedding ring pattern as shown in FIGS. 29 and 30.

It will be appreciated that the foregoing examples and description, given for purposes of illustration, are not to be construed as limiting the scope of this invention, which is defined by the following claims and all equivalents thereto.

We claim:

1. A sculpted fabric for the manufacture of a tissue web, having a tissue machine contacting side and a tissue contacting side, and comprising, on the tissue contacting side an upper porous member comprising a base with nonwoven elevated regions thereon comprising a first group of nonwoven raised elements and a second group of nonwoven raised elements, both raised relative to the base, wherein the first group of nonwoven raised elements extends in at least a first direction and the second group of nonwoven raised elements extends in at least a second direction, wherein the first and second groups of nonwoven raised elements are arranged on the base to produce elevated and depressed regions defining a three-dimensional tissue contacting surface comprising:

a) a first background region having a set of substantially parallel first elevated regions comprising at least a subset of the first group of nonwoven raised elements, and comprising a first group of depressed regions, wherein the first elevated regions and the first depressed regions alternate;

b) a second background region having a set of substantially parallel second elevated regions comprising at least a subset of the second group of nonwoven raised elements, and comprising a second group of depressed regions, wherein the second elevated regions and the second depressed regions alternate; and, c) a transition region positioned between the first and second background regions, wherein the first elevated regions of the first background region terminate and the second elevated regions of the second background region terminate.

2. The sculpted fabric of claim 1, wherein the upper porous member consists essentially of nonwoven materials.

3. The sculpted fabric of claim 2, wherein the sculpted fabric consists essentially of nonwoven materials.

4. The sculpted fabric of claim 2, wherein the upper porous member is joined to an underlying strength layer.

5. The sculpted fabric of claim 4, wherein the underlying strength layer comprises a woven fabric.

6. The sculpted fabric of claim 1, wherein the base of the upper porous member is unitary with at least one of the first group of nonwoven raised elements or the second group of nonwoven raised elements.

7. The sculpted fabric of claim 1, wherein the sculpted fabric is substantially unitary.

8. The sculpted fabric of claim 1, wherein the sculpted fabric comprises a three-dimensional fibrous nonwoven layer.

9. The sculpted fabric of claim 1, wherein the sculpted fabric comprises a nonwoven layer of substantially uniform basis weight.

10. The sculpted fabric of claim 1, wherein the upper porous member comprises a fibrous nonwoven web of substantially nonuniform basis weight.

11. The sculpted fabric of claim 1, wherein the upper porous member comprises a fibrous nonwoven web.

12. The sculpted fabric of claim 11, wherein the base of the upper porous member comprises a fibrous nonwoven web.

13. The sculpted fabric of claim 1, wherein at least one of the first elevated regions of the first background regions overlap with at least one of the second elevated regions of the second background region within the transition region by a distance of 10 mm or less.

14. The sculpted fabric of claim 1, wherein the first direction of the first group of nonwoven raised elements is in the cross-machine direction.

15. The sculpted fabric of claim 1, wherein the first direction of the first group of nonwoven raised elements at an acute angle to the cross-machine direction.

16. The sculpted fabric of claim 1, wherein the first direction of the first group of nonwoven raised elements is in the machine direction.

17. The sculpted fabric of claim 1, wherein the first direction of the first group of nonwoven raised elements is at an acute angle to the machine direction.

18. The sculpted fabric of claim 1, wherein the first direction of the first group of nonwoven raised elements is substantially orthogonal to the second direction of the second group of nonwoven raised elements.

19. The sculpted fabric of claim 1, wherein the first direction of the first group of nonwoven raised elements is at an acute angle to the second direction of the second group of nonwoven raised elements.

20. The sculpted fabric of claim 1, wherein the first direction of the first group of nonwoven raised elements is substantially the same as the second direction of the second group of nonwoven raised elements.

21. The sculpted fabric of claim 1, wherein the transition region has greater surface depth than the first background region.

22. The sculpted fabric of claim 1, wherein the transition region has greater surface depth than the second background region.

23. The sculpted fabric of claim 1, wherein the transition region is filled.

24. The sculpted fabric of claim 1, wherein the transition region has substantially the same surface depth of the first background region.

25. The sculpted fabric of claim 1, wherein the transition region has substantially the same surface depth of the second background region.

26. The sculpted fabric of claim 1, wherein each nonwoven raised element of the first group of nonwoven raised elements has a width and the maximum plane difference of the first group of nonwoven raised elements is at least about 30% of the width of one of the nonwoven raised elements of the first group of nonwoven raised elements.

27. The sculpted fabric of claim 1, wherein the maximum plane difference of the first group of nonwoven raised elements is at least about 0.12 mm.

28. The sculpted fabric of claim 1, wherein each nonwoven raised element of the second group of nonwoven raised elements has a width and the maximum plane difference of the second group of nonwoven raised elements is at least about 30% of the width of one nonwoven raised element of the second group of nonwoven raised elements.

29. The sculpted fabric of claim 1, wherein the maximum plane difference of the second group of nonwoven raised elements is at least about 0.12 mm.

30. The sculpted fabric of claim 1, wherein the first background region has a first background texture and the second background region has a second background texture.

31. The sculpted fabric of claim 30, wherein the first background texture of the first background region is substantially the same as the second background texture of the second background region.

32. The sculpted fabric of claim 30, wherein the first background texture of the first background region is different than the second background texture of the second background region.

33. The sculpted fabric of claim 1, wherein each nonwoven raised element of the first group of nonwoven raised elements has a first beginning point and a first ending point, each nonwoven raised element of the second group of nonwoven raised elements has a second beginning point and a second ending point wherein the first ending point of at least one of the nonwoven raised elements of the first group of nonwoven raised elements is separated in the transition region by a gap having a width ranging from about 10 mm to about negative 10 mm from the second ending point of at least one of the nearest nonwoven raised elements of the second group of nonwoven raised elements.

34. The sculpted fabric of claim 33, wherein the gap has a width ranging from about 4 mm to about negative 4 mm.

35. The sculpted fabric of claim 1 wherein the maximum distance between adjacent nonwoven raised elements of the first group of nonwoven raised elements is at least 0.3 mm.

36. The sculpted fabric of claim 35, wherein the maximum distance between adjacent nonwoven raised elements of the first group of nonwoven raised elements is greater than the width of one of the adjacent nonwoven raised elements of the first group of nonwoven raised elements.

37. The sculpted fabric of claim 1, wherein the maximum distance between adjacent nonwoven raised elements of the second group of nonwoven raised elements is at least 0.3 mm.

38. The sculpted fabric of claim 37, wherein the maximum distance between adjacent nonwoven raised elements of the second group of nonwoven raised elements is greater than the width of one of the adjacent nonwoven raised elements of the second group of nonwoven raised elements.

39. The sculpted fabric of claim 1, wherein the sculpted fabric is a forming wire.

40. The sculpted fabric of claim 1, wherein the sculpted fabric is a through air drying fabric.

41. The sculpted fabric of claim 1, wherein the sculpted fabric is a transfer fabric.

42. The sculpted fabric of claim 1, wherein the tissue contacting surface of the sculpted fabric is non-macroscopically monoplanar.

43. The sculpted fabric of claim 1, wherein the tissue contacting surface of the sculpted fabric is macroscopically monoplanar.

44. The sculpted fabric of claim 1, wherein the base fabric comprises a nonwoven material.

45. The sculpted fabric of claim 1, wherein the base fabric comprises a woven material.

* * * * *